US009483910B2

(12) United States Patent
Okada

(10) Patent No.: US 9,483,910 B2
(45) Date of Patent: Nov. 1, 2016

(54) BILL PROCESSING UNIT AND GAMING MACHINE INCLUDING SAME

(75) Inventor: Kazuo Okada, Tokyo (JP)

(73) Assignees: UNIVERSAL ENTERTAINMENT CORPORATION, Koto-ku, Tokyo (JP); ARUZE GAMING AMERICA, INC., Las Vegas, NV (US)

( * ) Notice: Subject to any disclaimer, the term of this patent is extended or adjusted under 35 U.S.C. 154(b) by 375 days.

(21) Appl. No.: 13/978,383

(22) PCT Filed: Nov. 28, 2011

(86) PCT No.: PCT/JP2011/077298

§ 371 (c)(1),
(2), (4) Date: Jul. 11, 2013

(87) PCT Pub. No.: WO2012/093527

PCT Pub. Date: Jul. 12, 2012

(65) Prior Publication Data

US 2015/0038217 A1 Feb. 5, 2015

(30) Foreign Application Priority Data

Jan. 5, 2011 (JP) ..... 2011-000794

(51) Int. Cl.
*G07F 7/04* (2006.01)
*G07F 17/32* (2006.01)
*G07D 11/00* (2006.01)

(52) U.S. Cl.
CPC ..... *G07F 17/3246* (2013.01); *G07D 11/0018* (2013.01); *G07D 11/0021* (2013.01); *G07D 11/0081* (2013.01); *G07D 11/0054* (2013.01); *G07D 11/0087* (2013.01); *G07F 7/04* (2013.01)

(58) Field of Classification Search
CPC ..... G07D 11/0021; G07D 11/0054; G07D 11/0066; G07D 11/0087; G07D 2211/00; G07F 7/04
USPC ..... 194/206, 215, 217; 209/534; 235/379; 700/221, 226, 232, 233, 238
See application file for complete search history.

(56) References Cited

U.S. PATENT DOCUMENTS 8,763,779 B2 * 7/2014 Nireki ..... G07F 19/202 194/206
2001/0015309 A1 * 8/2001 Ikuta ..... 194/206
(Continued)

FOREIGN PATENT DOCUMENTS

CN 1445728 A 1/2003
CN 101589410 A 11/2009
(Continued)

OTHER PUBLICATIONS

IPRP in connection with underlying PCT application PCT/JP2011/077298, and translation thereof, (Dated Mar. 6, 2012) ( 5 pages).

*Primary Examiner* — Mark Beauchaine
(74) *Attorney, Agent, or Firm* — KMF Patent Services, PLLC; Kenneth M. Fagin; S. Peter Konzel

(57) ABSTRACT

In order to make it easy to change the necessary device specifications when adapted to paper currencies in circulation in a plurality of countries and regions, a paper currency processing device (M1) has: a paper currency slot (M5) which is capable of handling the paper currency (T) of multiple currency circulation regions from the outside of the device; a paper currency transfer mechanism for transferring the paper currency (T) between the paper currency slot (M5) and various locations inside the device; and a plurality of paper currency cases linked to the paper currency transfer mechanism. The paper currency transfer mechanism is controlled in such a manner that the paper currency case associated with a currency circulation area is identified, and the paper currency (T) is transferred into the identified paper currency case.

8 Claims, 40 Drawing Sheets

(56) References Cited

U.S. PATENT DOCUMENTS

| | | | | |
|---|---|---|---|---|
| 2002/0088850 | A1 | 7/2002 | Katou et al. | |
| 2002/0198839 | A1 | 12/2002 | Uozumi et al. | |
| 2003/0062242 | A1* | 4/2003 | Hallowell et al. | 194/302 |
| 2003/0085510 | A1 | 5/2003 | Abe et al. | |
| 2003/0178281 | A1* | 9/2003 | Goto | G07F 19/20 194/206 |
| 2009/0176582 | A1* | 7/2009 | Cole et al. | 463/46 |
| 2009/0183967 | A1* | 7/2009 | Hamasaki | G07F 19/202 194/320 |
| 2009/0229950 | A1* | 9/2009 | Nakamoto | G07D 5/00 194/302 |
| 2010/0025911 | A1 | 2/2010 | Sakamoto | |
| 2010/0303333 | A1 | 12/2010 | Nireki | |
| 2012/0135799 | A1 | 5/2012 | Okada et al. | |

FOREIGN PATENT DOCUMENTS

| | | | |
|---|---|---|---|
| CN | 101896945 | A | 11/2010 |
| EP | 2 226 768 | A1 | 9/2010 |
| JP | H6-051967 | U | 7/1994 |
| JP | 2000-020783 | A | 1/2000 |
| JP | 2002-352298 | A | 12/2002 |
| JP | 2003-002484 | A | 1/2003 |
| JP | 2003-123122 | | 4/2003 |
| JP | 2003-296794 | A | 10/2003 |
| JP | 2005-293389 | | 10/2005 |
| WO | WO 2009/093717 | A1 | 7/2009 |
| WO | WO 2010/137184 | | 12/2010 |

* cited by examiner

FIG.10

BILL MANAGEMENT TABLE

| STORAGE STAGE | TRANSPORTATION CAPABILITY | BILL TYPE (BILL AMOUNT、CURRENCY UNIT) | MAXIMUM STORAGE AMOUNT | STORAGE AMOUNT | STORED AMOUNT OF MONEY |
|---|---|---|---|---|---|
| 1 | IMPORT、EXPORT | 10USD | 1000 | 253 | 2530USD |
| 2 | IMPORT、EXPORT | 100USD | 500 | 480 | 48000USD |
| 3 | EXPORT | 1000JPY | 1000 | 873 | 873000JPY |
| 4 | IMPORT | 10000JPY | 300 | 18 | 180000JPY |
| 5 | IMPORT | 100AUD | 300 | 51 | 5100AUD |
| 6 | IMPORT | 0 | 500 | 51 | |

FIG.23

| | FIRST SYMBOL COLUMN | SECOND SYMBOL COLUMN | THIRD SYMBOL COLUMN | FOURTH SYMBOL COLUMN | FIFTH SYMBOL COLUMN |
|---|---|---|---|---|---|
| CODE NUMBER | SYMBOL | SYMBOL | SYMBOL | SYMBOL | SYMBOL |
| 00 | JACKPOT 7 | JACKPOT 7 | JACKPOT 7 | JACKPOT 7 | JACKPOT 7 |
| 01 | PLUM | BELL | CHERRY | ORANGE | APPLE |
| 02 | ORANGE | APPLE | ORANGE | PLUM | ORANGE |
| 03 | PLUM | BELL | APPLE | STRAWBERRY | BELL |
| 04 | ORANGE | CHERRY | ORANGE | BELL | PLUM |
| 05 | PLUM | ORANGE | PLUM | PLUM | BLUE 7 |
| 06 | ORANGE | PLUM | ORANGE | APPLE | ORANGE |
| 07 | PLUM | CHERRY | PLUM | BLUE 7 | APPLE |
| 08 | BLUE 7 | BELL | ORANGE | PLUM | PLUM |
| 09 | CHERRY | APPLE | PLUM | ORANGE | BELL |
| 10 | ORANGE | BELL | ORANGE | BELL | CHERRY |
| 11 | BELL | STRAWBERRY | PLUM | ORANGE | PLUM |
| 12 | ORANGE | PLUM | BELL | PLUM | BELL |
| 13 | STRAWBERRY | BLUE 7 | STRAWBERRY | CHERRY | ORANGE |
| 14 | BLUE 7 | BELL | BLUE 7 | APPLE | APPLE |
| 15 | ORANGE | APPLE | BELL | STRAWBERRY | PLUM |
| 16 | APPLE | BELL | CHERRY | CHERRY | CHERRY |
| 17 | PLUM | STRAWBERRY | PLUM | BELL | ORANGE |
| 18 | ORANGE | PLUM | ORANGE | PLUM | BELL |
| 19 | PLUM | CHERRY | PLUM | ORANGE | ORANGE |
| 20 | BLUE 7 | BELL | ORANGE | CHERRY | PLUM |
| 21 | CHERRY | APPLE | PLUM | PLUM | STRAWBERRY |

FIG.24

PAYOUT CONTROL TABLE

| WINNING COMBINATION | BASE GAME |
|---|---|
| PLUM | 5 |
| ORANGE | 8 |
| BELL | 10 |
| CHERRY | 20 |
| STRAWBERRY | 30 |
| BLUE 7 | 40 |

FIG.25

FREE GAME QUANTITY TABLE

| ACCUMULATED POINTS | NUMBER OF FREE GAMES TO BE PLAYED |
|---|---|
| 0 | 10 |
| 1 | 20 |
| 2 | 40 |
| 3 | 60 |
| 4 | 80 |
| 5 | 100 |
| 6 | 120 |
| 7 | 140 |
| 8 | 160 |
| 9 | 180 |
| 10 | 200 |

BILL PROCESSING UNIT AND GAMING MACHINE INCLUDING SAME

TECHNICAL FIELD

The present invention relates to a bill processing unit storing bills and a gaming machine including the same.

BACKGROUND ART

According to a known arrangement, a plurality of stackers storing stacked bills are provided as bill processing units for storing bills, the type of each bill is specified when it is taken into the machine, and the bills are sorted by type by transporting the bills to the stackers of the respective types (Patent Literatures 1-4). Furthermore, Patent Literature 5 discloses an authenticity determination method taking into account of bill specifications of respective countries, such as ink and paper quality.

CITATION LIST

Patent Literatures

[Patent Literature 1] Japanese Utility-Model Publication No. 6-51967

[Patent Literature 2] Japanese Unexamined Patent Publication No. 2002-352298

[Patent Literature 3] Japanese Unexamined Patent Publication No. 2003-2484

[Patent Literature 4] Japanese Unexamined Patent Publication No. 2003-296794

[Patent Literature 5] Pamphlet of International Publication No, 2009/093717

SUMMARY OF INVENTION

Technical Problem

The known bill processing unit aims at sorting and storing only bills distributed in a particular country or area. For this reason, the known bill processing unit must be adjusted, before used in each country or area, to conduct information processing and to have the mechanical specifications corresponding to the bills distributed in the country or area. It has therefore been desired to conceive of a way to easily change such settings.

An object of the present invention is therefore to provide a bill processing unit in which a change in the specifications of the unit required to correspond to bills distributed in a plurality of countries or areas is easily done, and a gaming machine provided with the bill processing unit.

Solution to Problem

According to the present invention, a bill processing unit includes: a bill slot allowing bills of a plurality of currency circulation zones to be dealt with from an outside; a bill transportation mechanism configured to transport the bills between the bill slot and parts of the bill processing unit; a plurality of bill cases connected to the bill transportation mechanism; a storage configured to store identification data of each of the bill cases and identification data of each of the currency circulation zones in association with one another; a bill reader configured to read information from the bills while the bills are being transported by the bill transportation mechanism; a bill identifying unit configured to identify the currency circulation zone of each of the bills based on bill information data read by the bill reader; and an import control unit configured to specify one of the bill cases associated with the currency circulation zone identified by the bill identifying unit based on the identification data stored in the storage and control the bill transportation mechanism to import the bills to the specified bill case.

According to the arrangement above, because the bills in the currency circulation zone identified by the bill identifying unit are imported to the bill case associated with that currency circulation zone, it is possible to sort the bills in accordance with the currency circulation zones in which the bills are issued and store the bills. With this, it is possible to adjust the device specifications in accordance with the currency circulation zone of the bills simply by, for example, selecting a bill case in consideration of the capacity thereof and the frequency of the use of the bills, in such a way that a bill case having a large capacity is selected for the bills of a frequently-used currency circulation zone, whereas a bill case having a small capacity is selected for the bills of a not-frequently-used currency circulation zone.

According tot present invention, in addition to the above, the bill processing unit may further include: a currency circulation zone classification unit configured to classify sets of information data of the respective currency circulation zones stored in the storage into information data of a particular currency circulation zone and information data of other currency circulation zones; a payout instruction unit configured to receive from the outside an instruction to pay out the bills; and an export control unit configured to specify, in response to an instruction from the payout instruction unit, one of the bill cases associated with the particular currency circulation zone based on the identification data stored in the storage, and control the bill transportation mechanism to export the bills from the specified bill case to the bill slot.

According to the arrangement above, when an instruction to pay out the bills is made to the payout instruction unit from the outside, the bills of the particular currency circulation zone are exported to the bill slot by the bill transportation mechanism. The bills of the particular currency circulation zone are therefore easily received.

According to the present invention, the bill processing unit may further include: a payout amount specifying unit configured to receive a payout amount of the bills from the outside, the export control unit controlling the bill transportation mechanism to export the bills, the number of which corresponds to the payout amount specified in the payout amount specifying unit, to the bill slot.

According to the arrangement above, as the bills the number of which has been specified from the outside, are exported to the bill slot by the bill transportation mechanism, with the result that the bills corresponding to a desired amount of money are received.

According to the present invention, the bill processing unit may be arranged so that the currency circulation zone classification unit sets a currency circulation zone in which the bill processing unit is installed as the particular currency circulation zone.

According to the arrangement above, when an instruction to pay out the bills is made to the payout instruction unit from the outside, the bills of the currency circulation zone in which the bill processing unit is installed, i.e., the bills of the player's country are exported to the bill slot. As such, the bills of the player's country are easily received.

According to the present invention, the bill processing unit may further include: a currency circulation zone selection unit that allows one of the currency circulation zones stored in the storage to be selectable from the outside, the export control unit setting, when one of the currency circulation zones is selected in the currency circulation zone selection unit, the selected one of the currency circulation zones as the particular currency circulation zone.

According to the arrangement above, as the bills of the currency circulation zone selected from the outside are exported to the bill slot, the bills of the desired currency circulation zone are received for a desired amount of money.

According to the present invention, the bill processing unit may further include: a total amount calculation unit configured to calculate the total monetary amount of the bills stored in the bill case; and an export determination unit configured to compare the payout amount specified by the payout amount specifying unit with the total monetary amount in the bill case from which payout is conducted, and prohibit the export control unit from controlling the bill transportation mechanism to conduct export when the payout amount is equal to or larger than the total monetary amount.

According to the arrangement above, it is possible to prevent in advance the occurrence of the case where the bills stored in the bill case run out while the bills are being paid out and the case is refilled with bills.

According to the present invention, the bill processing unit may further include: a countermeasure information output unit configured to, when the export determination unit prohibits the export, output at least one set of countermeasure information regarding the prohibition of the export to be recognizable by an operator who has instructed payout of the bills; a countermeasure information selection unit configured to allow the operator to select a set of the countermeasure information; and a countermeasure information execution unit configured to execute a process associated with the set of countermeasure information selected in the countermeasure information selection unit.

According to the arrangement above, because at least one set of countermeasure information in case of the prohibition of the payout of the bills is presented to the operator, the operator is able to take measures in line with his/her intention.

According to the present invention, the at least one countermeasure information may include: staff person calling information with which a staff person dealing with the bills in the bill cases is called; selection encouragement information with which the operator is encouraged to select another one of the currency circulation zones with which the payout is possible; and payout cancellation information with which the payout of the bills is canceled.

According to the arrangement above, because at least one set of countermeasure information in case of the prohibition of the payout of the bills is selectable by the operator, the operator is able to take measures in line with his/her intention.

According to the present invention, each of the bill cases may include: a storing frame configured to store the bills in a stacked form; a partition plate configured to contact an end of each of the bills stored in the storing frame; and a partition plate supporting mechanism configured to support the partition plate to be movable forward and backward with respect to the end of each of the bills.

Because this allows a bill case of a single type to store differently sized and/or differently shaped bills, the manufacturing cost of the bill case is reduced as compared to cases where bill cases are provided for respective types and sizes of bills.

According to the present invention, a gaming machine may include the bill processing unit arranged as described above.

According to the arrangement above, when installing a gaming machine in each country, only a simple initial setting is required to play games on the gaming machine with bills issued or circulated in each country.

Advantageous Effects of Invention

According to the present invention, a change in device specifications required to correspond to bills distributed in a plurality of countries or areas is easily done.

BRIEF DESCRIPTION OF DRAWINGS

FIG. 10 shows a bill management table.

FIG. 23 is an explanatory diagram of a code No. determination table.

FIG. 24 is an explanatory drawing of a payout control table.

FIG. 25 is an explanatory drawing of a free game quantity table.

DESCRIPTION OF EMBODIMENTS (Outline of Bill Processing Unit)

Figure 1:
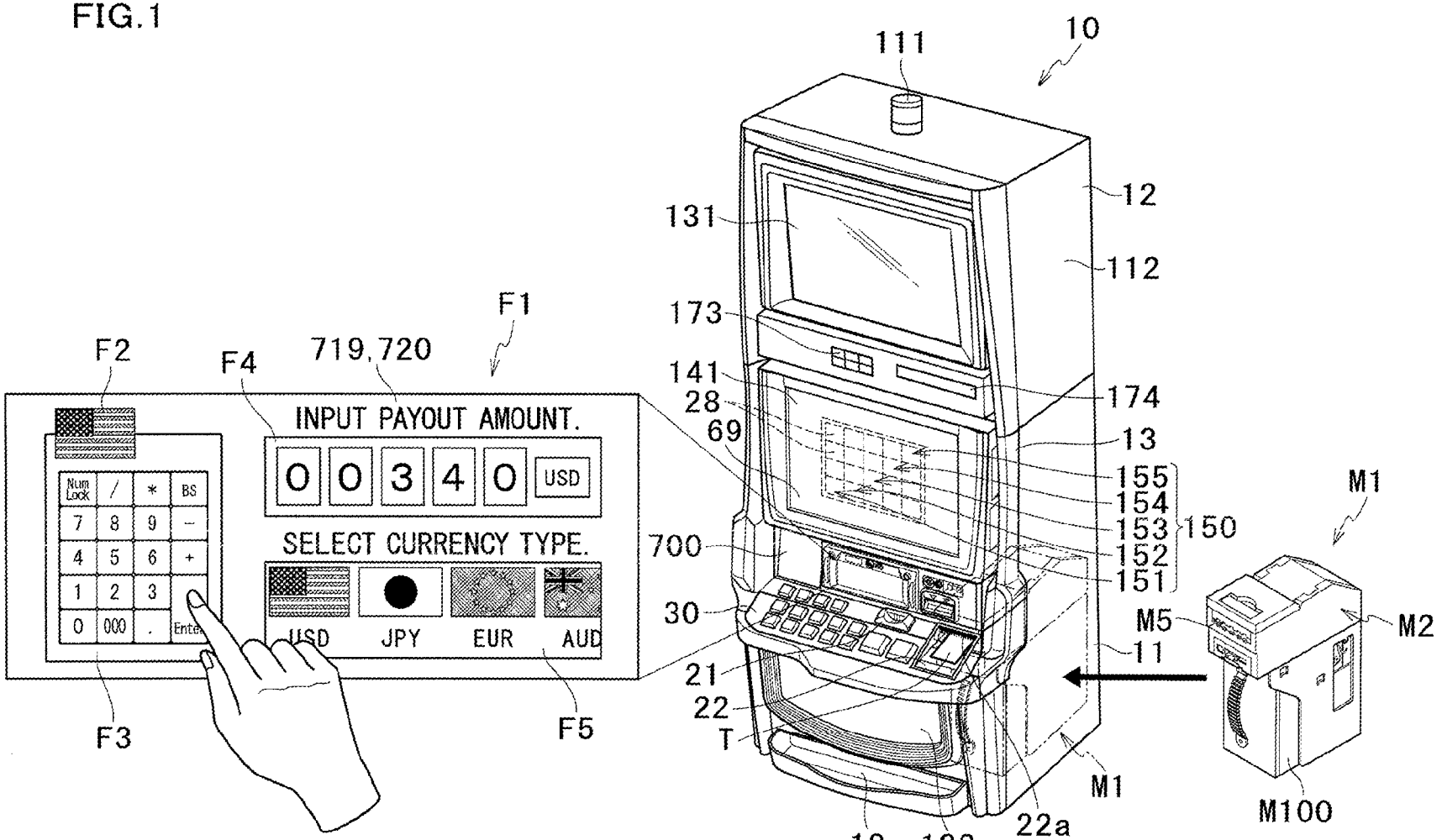
FIG. 1 illustrates an operation state of a bill processing unit mounted on a gaming machine.
Figure 2:
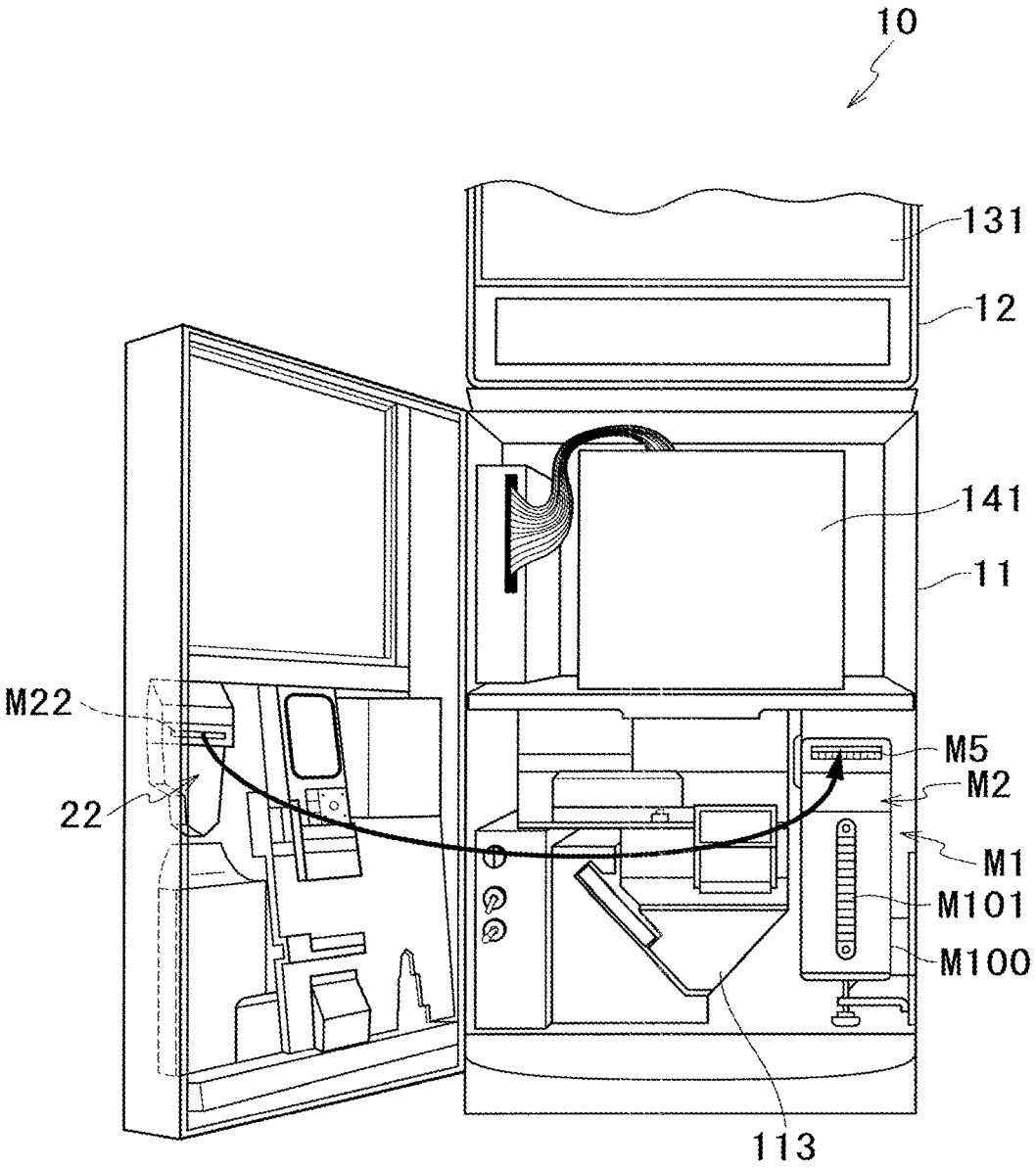
FIG. 2 illustrates the internal arrangement of the components in the gaming machine.

As shown in FIG. 1 and FIG. 2, a bill processing unit M1 is arranged to be able to sort bills T that are a type of currency in accordance with each currency circulation zone in a country or area and individually store each type of sorted bills T, and is detachably provided in a cabinet 11 of a slot machine 10. While the present embodiment assumes that the bill processing unit M1 is used for the slot machine 10, the unit may be used for gaming machines other than the slot machine 10 and devices other than gaming machines. Details of the gaming machine having the bill processing unit M1 and the slot machine 10 will be given later.

Figure 5:
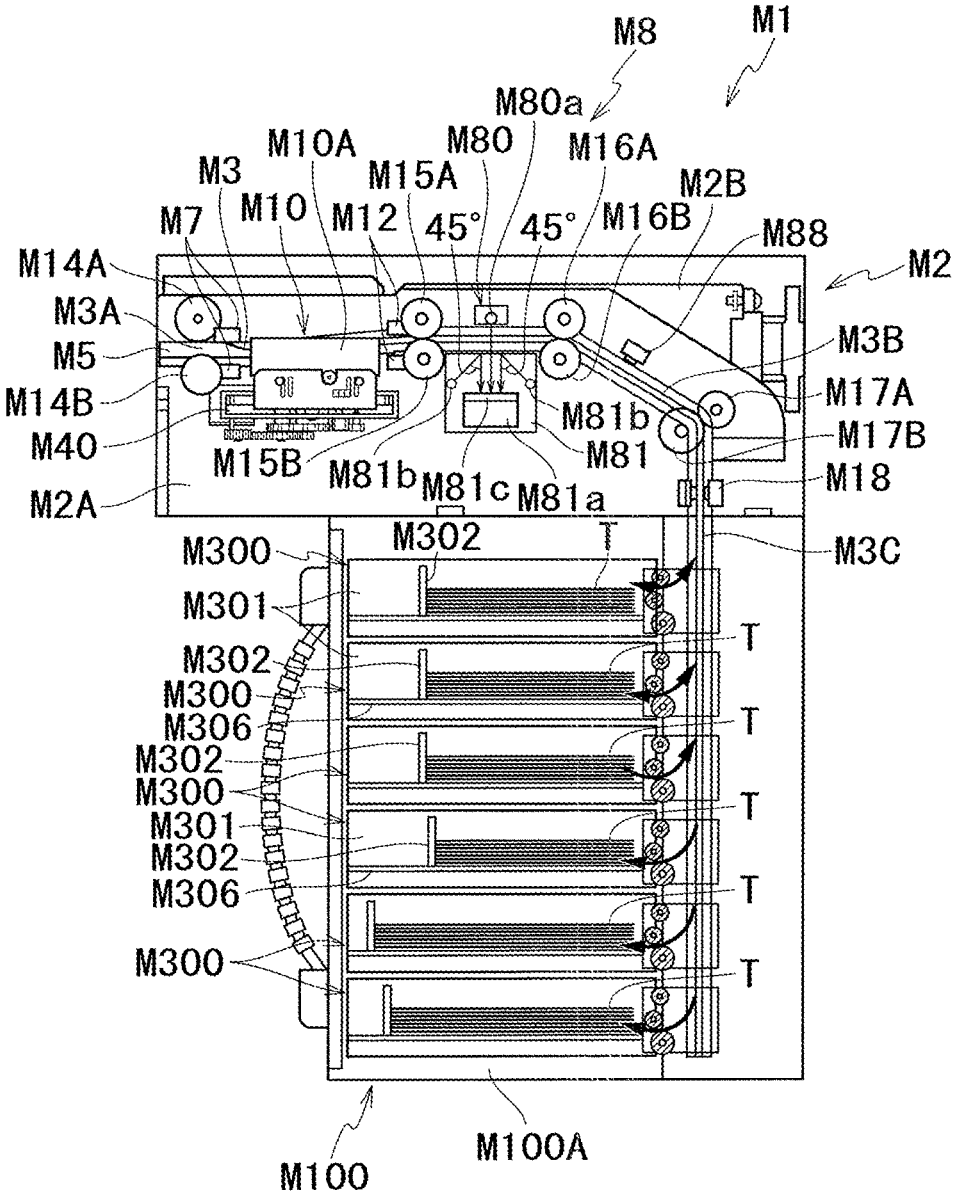
FIG. 5 illustrates the internal structure of the bill processing unit.
Figure 9:
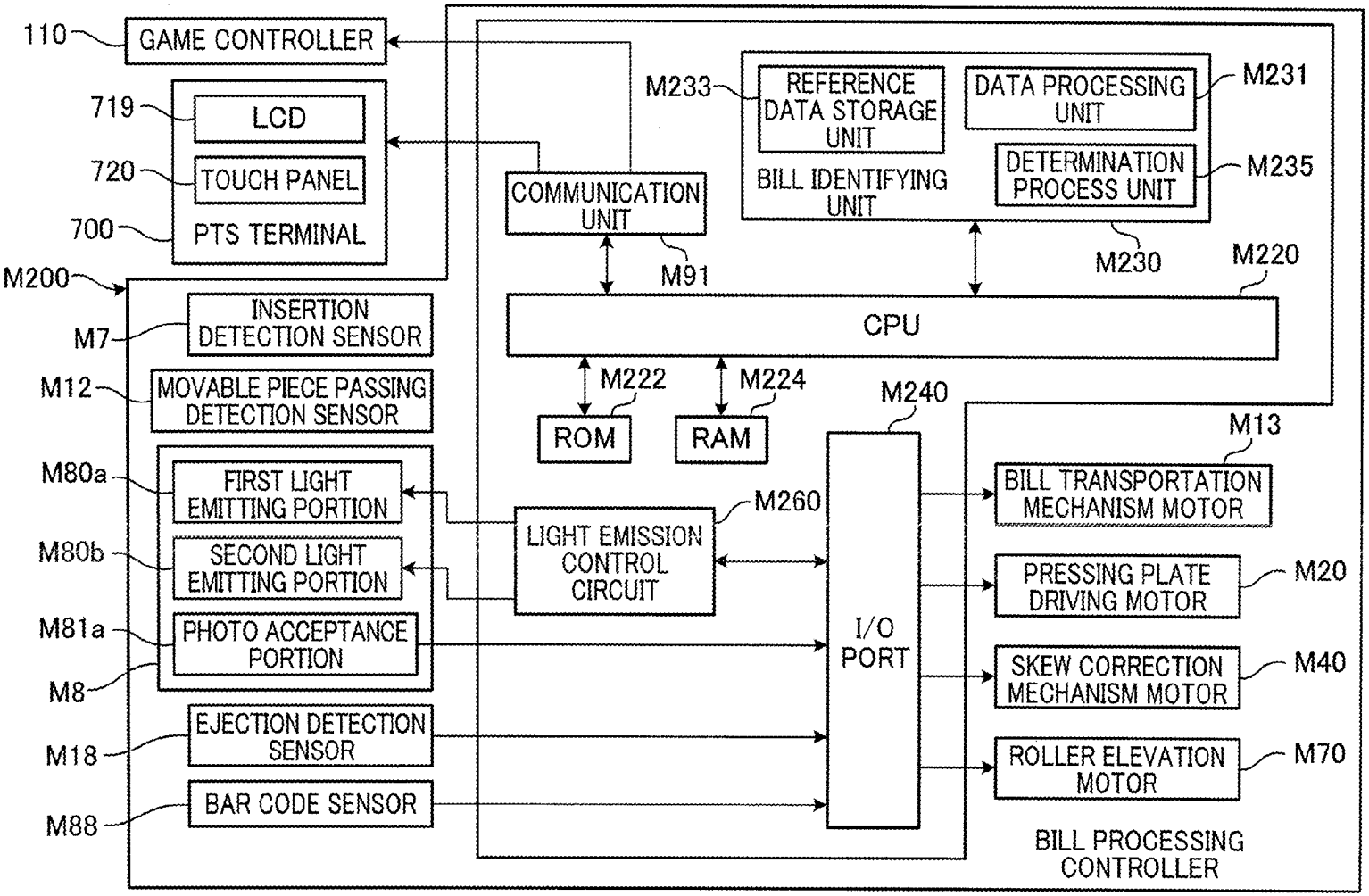
FIG. 9 is a block diagram of the bill processing controller.

To describe the bill processing unit M1 more specifically, as shown in FIG. 5, the bill processing unit M1 includes: a bill slot M5 that makes it possible to introduce bills T of a plurality of currency circulation zones into the device; a bill transportation mechanism (including components such as a bill transportation path M3 and transportation rollers M14B, 15B, 16B, and 17B) that transports bills T from the bill slot M5 to various parts in the device; a plurality of bill cases M300 connected to the bill transportation mechanism; a storage (a ROM M222 and a RAM M224 in FIG. 9 and a bill management table in FIG. 10) configured to store the identification data of each bill case M300 and the identification data of a currency circulation zone in association with one another; a bill reader M8 configured to read information from a bill T while the bill T is being transported by the bill transportation mechanism; a bill identifying unit M230 shown in FIG. 9 configured to specify the currency circulation zone of a bill T based on bill information data read by the bill reader M8; and an import control unit (a ROM M222, a RAM M224, and a CPU M220 in FIG. 9) configured to specify which bill case M300 is associated with the currency circulation zone specified by the bill identifying unit M230 based on the identification data (storage stage, bill type, or the like) stored in the storage (a bill management table in FIG. 10) and control the bill transportation mechanism to import the bill T into the specified bill case M300.

It is noted that the term "bill T" is a type of currency. The term "currency" encompasses not only legal currencies issued by governments but also local currencies each used in a particular community and international currencies transacted internationally, such as Euro and United States Dollar. The term "currency circulation zone" indicates a geographical range in which the currency is used for transaction. For example, in case of a currency circulated in a country, the range within the border of the country is the currency circulation zone. In case of a common currency circulated in an area constituted by a plurality of countries, the area is the currency circulation zone. Furthermore, in case of a currency circulated in a region of a country, the region is the currency circulation zone.

The bill processing unit M1 arranged as above is able to import the bills T associated with the currency circulation zone identified by the bill identifying unit M230 to the bill case M300 associated with that currency circulation zone. Bills T are therefore sorted by the currency circulation zone where each bill T was issued and stored. With this, it is possible to adjust the device specifications in accordance with the currency circulation zone of the bills T simply by, for example, selecting a bill case M300 in consideration of the capacity thereof and the frequency of the use of the bills T, in such away that a bill case M300 having a large capacity is selected for the bills T of a frequently-used currency circulation zone, whereas a bill case M300 having a small capacity is selected for the bills T of a not-frequently-used currency circulation zone. In this way, in the bill processing unit M1 the replacement of the bill case M300 or the collection of the bills T when the bill case M300 is fully filled with the bills T is less frequently required, and hence the availability of the device such as the gaming machine is improved.

Furthermore, while a conventional bill processing unit M1 is designed solely in consideration of bills T in the currency circulation zone in which the unit is installed, the bill processing unit M1 arranged as described above is designed in consideration of not only bills T in the currency circulation zone in which the unit is installed but also bills T circulated outside that currency circulation zone. This allows foreigners living outside the currency circulation zone to play games without doing troublesome currency exchange from the currencies circulated in their homes.

The bill processing unit M1 further has an arrangement of paying out bills T of a particular currency circulation zone such as a player's country. More specifically, the bill processing unit M1 includes: a currency circulation zone classification unit (bill processing controller M200 shown in FIG. 9) configured to classify information data of currency circulation zones stored in a storage into information data of a particular currency circulation zone and information data of other currency circulation zones; a payout instruction unit (a touch panel 720 of a PTS terminal 700 in FIG. 1) which is able to receive an instruction from the outside to pay out a bill T; and an export control unit (a bill processing controller M200 shown in FIG. 9) configured to specify a bill case M300 (storage stage) associated with the particular currency circulation zone based on the identification data stored in the storage, in response to an instruction input to the payout instruction unit, and control the bill transportation mechanism to export a bill T from the specified bill case M300 to the bill slot M5.

In connection with the above, while the payout instruction unit of the present embodiment utilizes the touch panel 720 of the PTS terminal 700 shown in FIG. 1 as an operation panel, an operation panel dedicated to the bill processing unit M1 may be used as the payout instruction unit.

Figure 27:
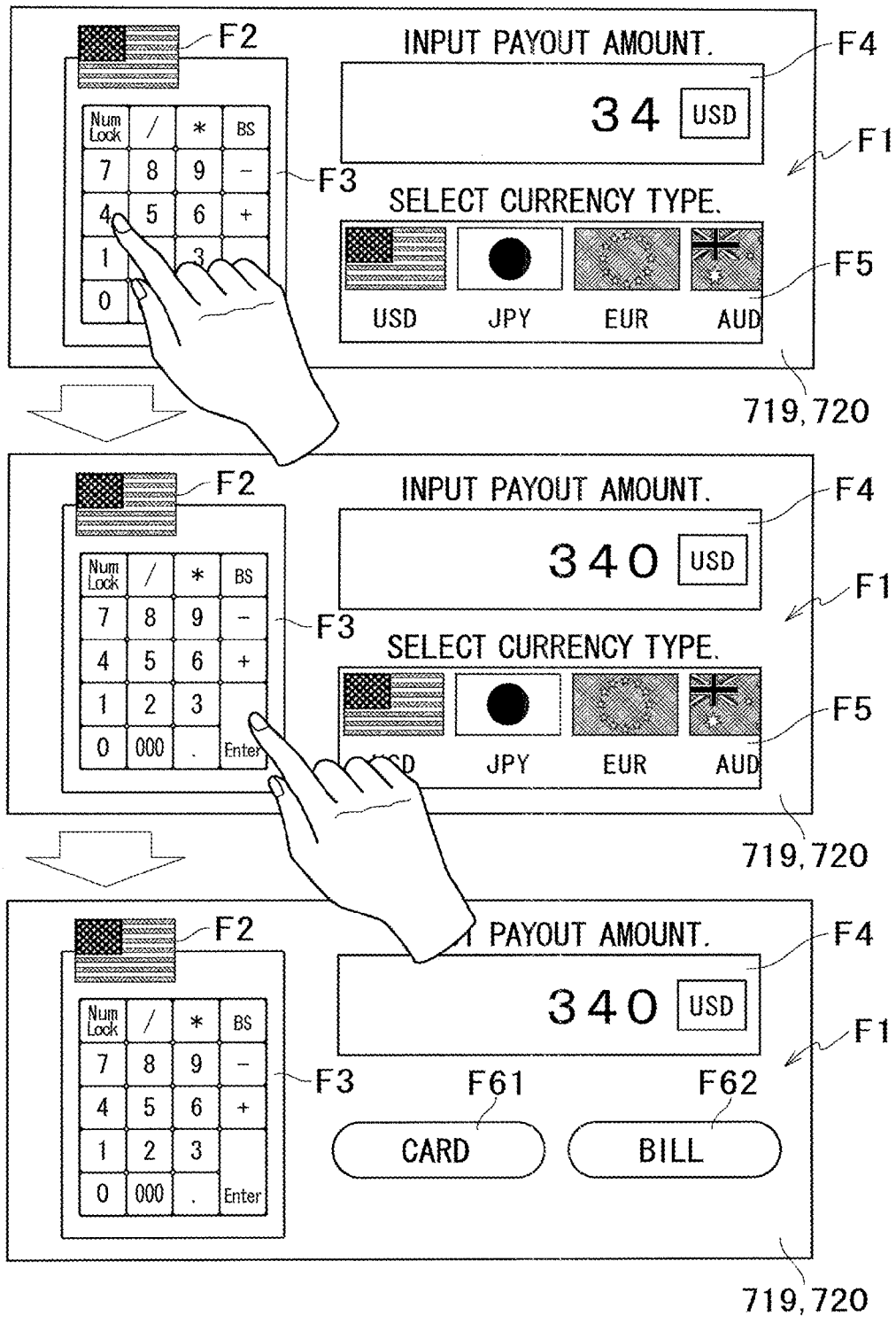
FIG. 27 illustrates a bill payout screen.

In the bill processing unit M1 arranged as above, when, for example, in the bill payout screen F1 shown in FIG. 27 an instruction to payout a bill T is made from the outside through the payout instruction unit, a bill T in a particular currency circulation zone indicated by the U.S. flag or the like on the currency displaying portion F2 is exported to the bill slot M5 by the bill transportation mechanism. As such, the bill T of the particular currency circulation zone is easily receivable.

In addition to the above, the bill processing unit M1 has an arrangement of specifying a payout amount. More specifically, the bill processing unit M1 is arranged to include a payout amount specifying unit (e.g., the touch panel 720 of the PTS terminal 700) that makes it possible to specify the payout amount of bills T from the outside and the export control unit is arranged to control the bill transportation mechanism such that the bills T, the monetary amount of which has been specified by the payout amount specifying unit, are exported to the bill slot M5.

In the bill processing unit M1 arranged as above, when, for example, a payout amount displaying portion F3 is pressed in the bill payout screen F1 shown in FIG. 27, the bills T the monetary amount of which has been specified from the outside are exported to the bill slot M5 by the bill transportation mechanism. As such, a desired number of bills T is received.

In addition to the above, the bill processing unit M1 is arranged to exchange bills T of a player's own currency circulation zone to bills T of a particular currency circulation zone and pay out the exchanged bills T. More specifically, the currency circulation zone classification unit of the bill processing unit M1 is arranged so that the currency circulation zone where the bill processing unit M1 is installed is set as the particular currency circulation zone. In the bill processing unit M1 arranged as above, when an instruction to pay out bills T is made from the outside through the payout instruction unit, bills T of the currency circulation zone where the bill processing unit is installed, i.e., bills T of the player's country is exported to the bill slot M5. As such, bills T of the player's own country are easily receivable.

In addition to the above, the bill processing unit M1 is arranged to be able to specify the currency circulation zone. More specifically, the bill processing unit M1 includes a currency circulation zone selection unit (such as the touch panel 720 of the PTS terminal 700) which makes it possible to select one of currency circulation zones stored in the storage from the outside, and when one of the currency circulation zones is selected by using the currency circulation zone selection unit, the export control unit sets the selected currency circulation zone as the particular currency circulation zone.

Figure 28:
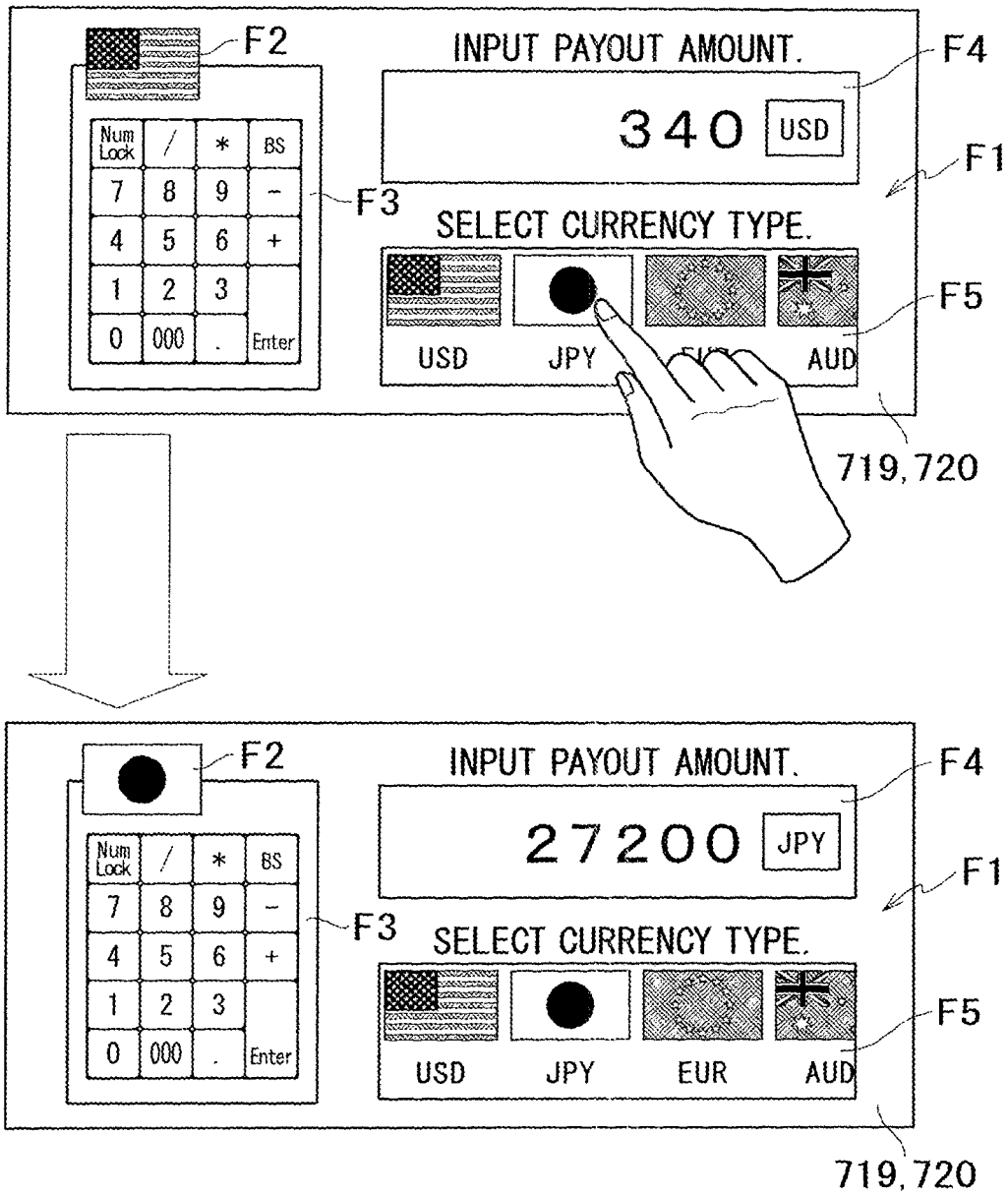
FIG. 28 illustrates a bill payout screen.

In the bill processing unit M1 arranged as above, when, for example, the currency selection portion F5 is pressed in the bill payout screen F1 shown in FIG. 28, bills T of the externally-selected currency circulation zone are exported to the bill slot M5. As such, it is possible to receive a desired monetary amount of bills T of a desired currency circulation zone.

In addition to the above, the bill processing unit M1 has an arrangement of prohibiting the export of bills T when it is impossible to payout the total amount. More specifically, the bill processing unit M1 includes a total amount calculation unit (the bill processing controller M200 in FIG. 9) configured to calculate the total monetary amount of bills T stored in the bill case M300 and an export determination unit (bill processing controller M200 in FIG. 9) configured to compare a payout amount specified by the payout amount specifying unit with the total amount in the bill case M300 from which the payout is conducted, and prevent the export control unit from instructing the bill transportation mechanism to export when the payout amount is larger than the total amount.

In the bill processing unit M1 arranged above, it is possible to prevent in advance the occurrence of the case where the bills T stored in the bill case M300 run out while the bills T are being paid out and the case M300 is refilled with bills T.

In addition to the above, the bill processing unit M1 has an arrangement of notifying countermeasure information concerning the export prohibition by sound or image display. More specifically, the bill processing unit M1 includes: when the export control is prohibited by the export determination unit, a countermeasure information output unit (such as the LCD 719 of the PTS terminal 700) configured to output at least one set of countermeasure information regarding the prohibition of the export control to be recognizable by the operator who has instructed the payout of bills T, a countermeasure information selection unit (such as the touch panel 720 of the PTS terminal 700) which allows the operator to select a set of countermeasure information, and a countermeasure information execution unit (the bill processing controller M200 in FIG. 9) configured to execute a process associated with the set of countermeasure information selected by the countermeasure information selection unit.

Figure 29:
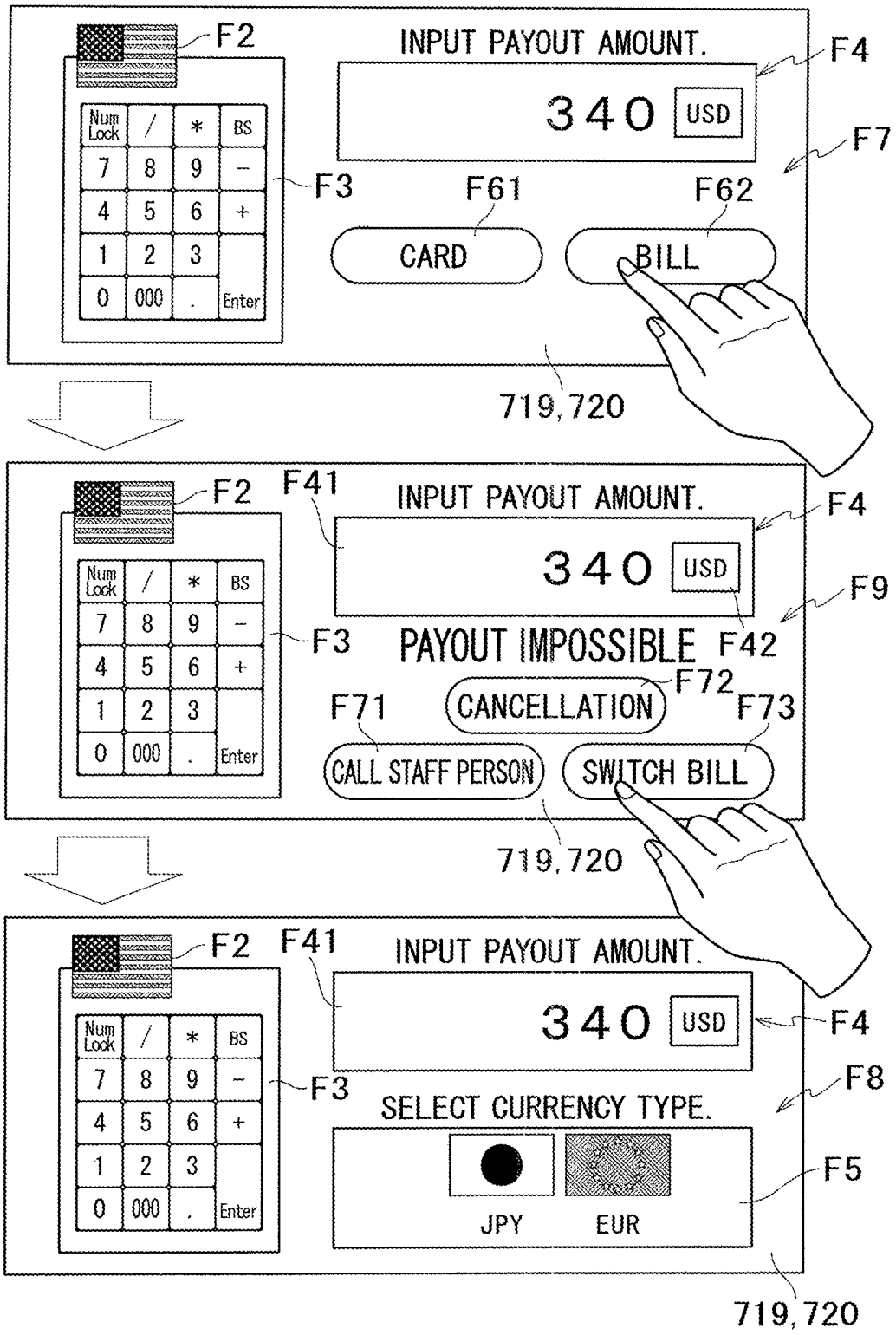
FIG. 29 illustrates a payout selection screen and a bill selection screen.

In the bill processing unit M1 arranged as above, for example, in the payout-impossible screen F9 shown in FIG. 29 at least one set of countermeasure information when the payout of bills T is prohibited, such as a cancellation button F72, a staff person calling button F71, and a bill switching button F73, is presented to the operator, and hence the operator is able to take measures in line with his/her intention.

In addition to the above, the bill processing unit M1 has an arrangement of notifying specific functions of sets of countermeasure information regarding the prohibition of export. More specifically, the bill processing unit M1 is arranged to be able to notify one of the following sets of information as the countermeasure information: staff person calling information for calling a staff person dealing with bills T in the bill cases M300; selection encouragement information encouraging the operator to select a currency circulation zone with which payout is possible; and payout cancellation information with which payout of bills T is canceled. The bill processing unit M1 arranged as above allows the operator to select a set of specific information of at least one set of countermeasure information concerning the prohibition of the payout of bills T, and hence the operation is able to easily take measures in line with his/her intention.

(Bill Processing Unit: Device Main Body M2)

The bill processing unit M1 arranged as above is installed so that the bill slot M5 allowing bills T to pass through matches an insertion slot 22*a* of the bill entry 22 as shown in FIG. 1 and FIG. 2. The bill processing unit M1 includes a device main body M2 having the bill slot M5 and a bill housing unit M100 provided in the device main body M2 to house bills T therein.

Figure 3:
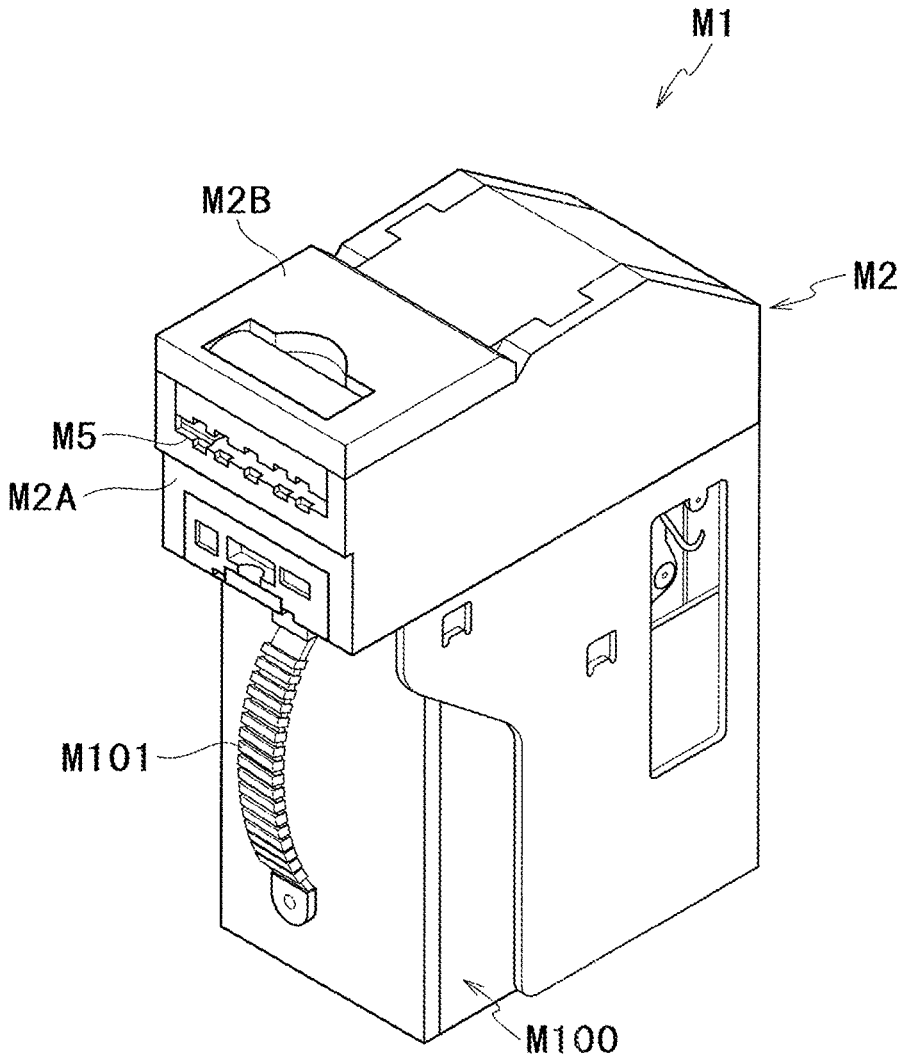
FIG. 3 is a perspective view of the bill processing unit.

As shown in FIG. 3, the device main body M2 includes a main body frame M2A and a door member M2B arranged to be rationally opened or closed about one end portion of the main body frame M2A. The main body frame M2A and the door member M2B are arranged so that, when the door member M2B is closed with respect to the main body frame M2A, a gap (bill transportation path M3) where bills T are transported is formed between these members, and the bill slot M5 is formed to match the bill transportation path M3, on the side on which the members are exposed to the front surface. The bill slot M5 is a slit allowing bills T to be inserted into the device main body M2 with the short side of each bill T being the leading end.

Figure 4:
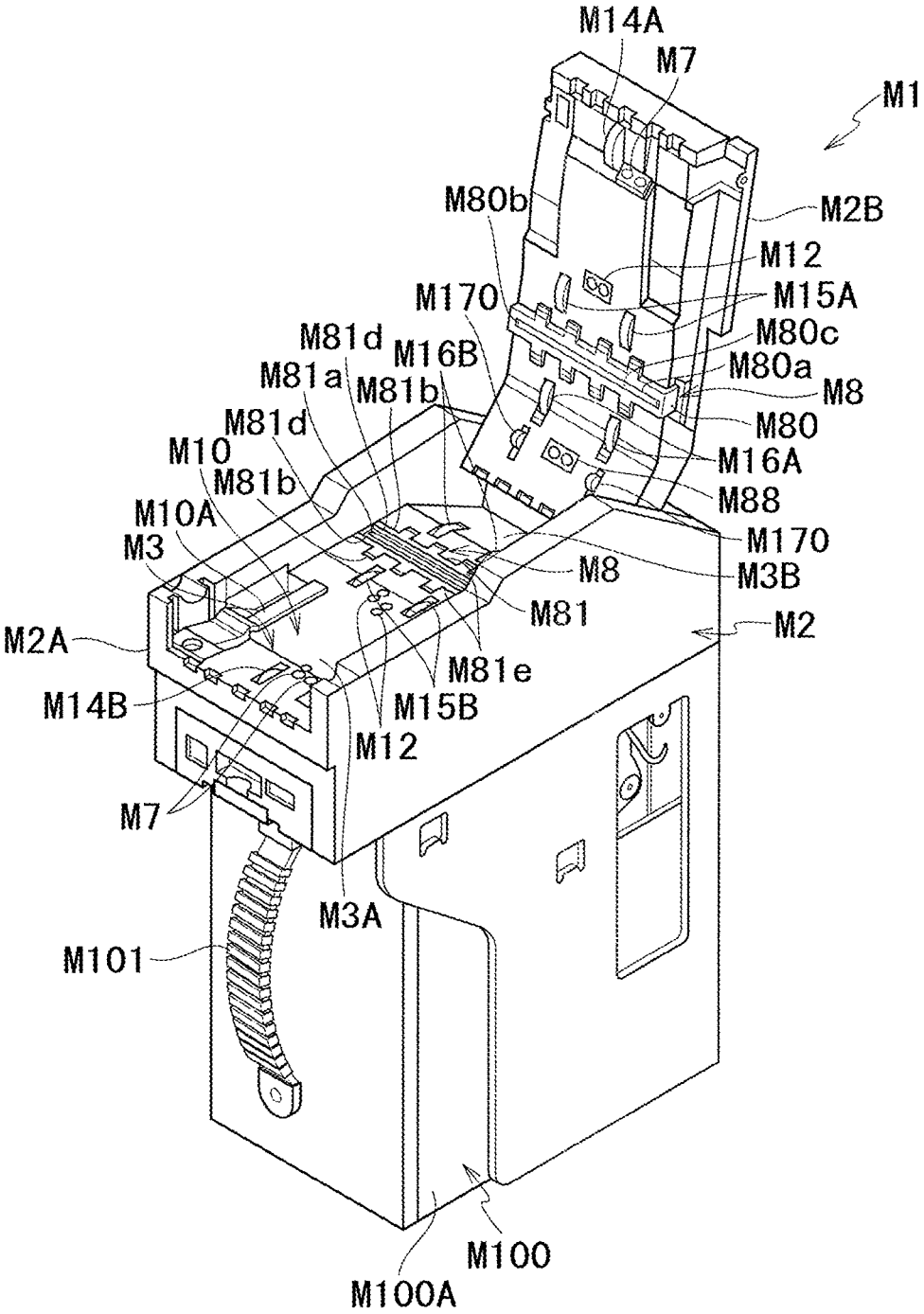
FIG. 4 is a perspective view of the bill processing unit.

Furthermore, as shown in FIG. 4 and FIG. 5, in the device main body M2 are provided: a bill transportation path M3; a bill transportation mechanism configured to transport bills T along the bill transportation path M3; an insertion detection sensor M7 configured to detect bills T inserted into the bill slot M5; a bill reader M8 provided on the downstream of the insertion detection sensor M7 to read information on each bill T being transported; a skew correction mechanism M10 configured to precisely position each bill T with respect to the bill reader M8; a movable piece passing detection sensor M12 configured to detect that a bill T passes through a pair of movable pieces constituting the skew correction mechanism; and an ejection detection sensor M18 configured to detect that a bill T has been ejected to the bill housing unit M100.

Now, the components of the device main body M2 will be detailed. The bill transportation path M3 extends toward the rear side from the bill slot M5, and includes a first transportation path M3A, a second transportation path M3B that extends to the downstream from the first transportation path M3A and is inclined downward from the first transportation path M3A at a predetermined angle, and a third transportation path M3C connected to the downstream end of the second transportation path M3B. The third transportation path M3C is vertically positioned along the rear end face of the bill housing unit M100. The third transportation path M3C is able to be connected with the leasing end of the bill case M300, to allow bills T to be imported to or exported from the bill case M300.

The bill transportation mechanism allows bills T having been inserted through the bill slot M5 to be transported to each bill case M300 along the insertion direction, and allows bills T being stored in the third transportation path M3C or being inserted to be sent back toward the bill slot M5. This bill transportation mechanism includes a motor provided in the device main body M2 as a driving source and transportation roller pairs M14A and 14B, M15A and 15B, M16A and 16B, and M17A and 17B that are rotated by the motor and are provided at predetermined intervals in the bill transportation path M3 along the bill transportation direction.

The transportation roller pairs are disposed so that a part of the pairs is exposed to the bill transportation path M3, and are each arranged so that a transportation roller below the bill transportation path M3 is driven by the motor whereas a transportation roller M14A, 15A, 16A or M17A provided above the path is a pinch roller driven by the motor-driven roller. A single pair of transportation rollers M14A and M14B that sandwiches a bill T inserted through the bill slot M5 first and transports the bill T toward the rear side is provided at a central portion of the bill transportation path M3, and pairs of transportation rollers M15A and M15B, M16A and M16B, and M17A and M17B that are serially provided on the downstream of the pair of rollers M14A and M14B are provided at two parts along the width direction of the bill transportation path M3.

In regard to the aforesaid pair of transportation rollers M14A and M14B in the vicinity of the bill slot M5, the pair is normally arranged so that the upper transportation roller M14A is detached from the lower transportation roller M14B, and the upper transportation roller M14A is moved toward the lower transportation roller M14B to sandwich an inserted bill T, when the insertion of the bill T is detected by the insertion detection sensor M7.

That is to say, the upper transportation roller M14A is driven by a roller elevation motor M70 (see FIG. 9) which is a driving source to contact or move away from the lower transportation roller M14B. In this regard, when the skew correction mechanism M10 executes a process (skew correction process) of correcting the tilting of an inserted bill T and aligning the bill T with the bill reader M8, the upper transportation roller M14A moves away from the lower transportation roller M14B to dismiss the load on the bill T, and when the skew correction process ends, the upper transportation roller M14A is driven again toward the lower transportation roller M14B to sandwich the bill T between the rollers. The driving source may be a solenoid or the like instead of the motor.

In addition to the above, the skew correction mechanism M10 is provided with a pair of left and right movable pieces M10A for skew correction. As a motor M40 for the skew correction mechanism is driven, the left and right movable pieces M10A move close to each other, so that a process of skew correction of the bill T is conducted.

The transportation roller provided below the above-described bill transportation path M3 is rotationally driven by a motor and a pulley provided at an end of the driving shaft of each transportation roller. That is to say, a driving pulley is attached to the output shaft of the motor, and a driving belt wraps the pulley provided at an end of the driving shaft of each transportation roller and the driving pulley of the motor. The driving belt is engaged with tension pulleys at suitable parts so that the loosening of the belt is prevented.

As the motor rotates forward in the structure described above, the transportation rollers are rotated forward in sync with the motor and transport the bill T in the insertion direction. On the other hand, when the motor rotates backward, the transportation rollers are rotated backward in sync with the motor, and the bill T is transported toward the bill slot M5.

The insertion detection sensor M7 generates a detection signal when detecting a bill T having been inserted into the bill slot M5. When the detection signal is output, the motor rotates forward and the bill T is transported in the insertion direction. The insertion detection sensor M7 of the present embodiment is provided between the pair of transportation rollers M14A and M14B and the skew correction mechanism M10, and is constituted by an optical sensor, e.g., a retro-reflective photo sensor. Alternatively, the sensor M7 may be constituted by a mechanical sensor.

In addition to the above, the movable piece passing detection sensor M12 generates a detection signal when a detection result indicates that the leading end of the bill T has passed through the pair of left and right movable pieces M10A constituting the skew correction mechanism M10. When this detection signal is output, the motor is stopped and the skew correction process is conducted. The movable piece passing detection sensor M12 of the present embodiment is provided upstream of the bill reader M8, and is constituted by an optical sensor or a mechanical sensor in the same manner as the insertion detection sensor.

In addition to the above, the ejection detection sensor M18 detects the rear end of the passing bill T to find that the bill T is ejected to the bill housing unit M100. The sensor M18 is provided immediately upstream of the bill housing unit M100, on the downstream side of the second transportation path M3B. Once the ejection detection sensor M18 outputs the detection signal, the motor is stopped and the process of transporting the bill T is terminated. The ejection detection sensor M18 is also constituted by an optical sensor or a mechanical sensor in the same manner as the insertion detection sensor.

The bill reader M8 has a function of reading bill information data from a bill T which is transported after the skew thereof is corrected by the skew correction mechanism M10. The bill information data is used not only for the validity (authenticity) of the bill T but also to identify the currency circulation zone of the bill T. In the present embodiment, the bill reader M8 is arranged to include a line sensor that reads information by applying light to the both sides of the transported bill T and receiving transmitted light and reflected light by light receiving elements. This bill reader M8 is provided on the first transportation path M3A.

(Bill Processing Unit: Bill Housing Unit M100)

The device main body M2 arranged as above is detachably provided with a bill housing unit M10. The bill housing unit M100 is removed from the device main body M2 in such a way that a handle M101 on the front surface is pulled after an unillustrated locking mechanism is unlocked.

The bill housing unit M100 includes a box-shaped cabinet M100A and bill cases M300 provided in the cabinet M100A. The cabinet M100A has the handle M101 on its front surface and detachably houses the bill case M300 therein in a horizontal manner.

Figure 6:
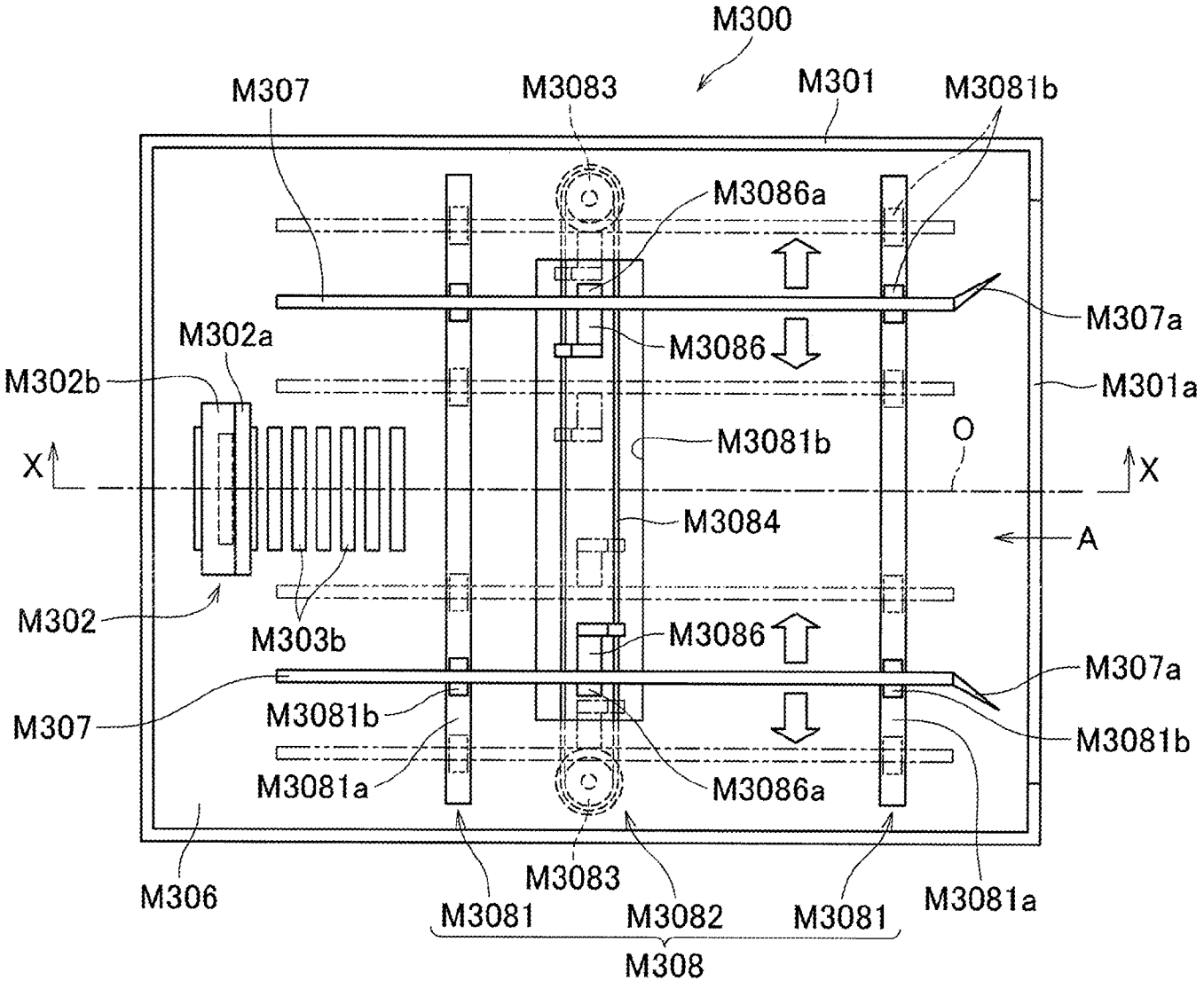
FIG. 6 is a plan view of the bill case.
Figure 7:
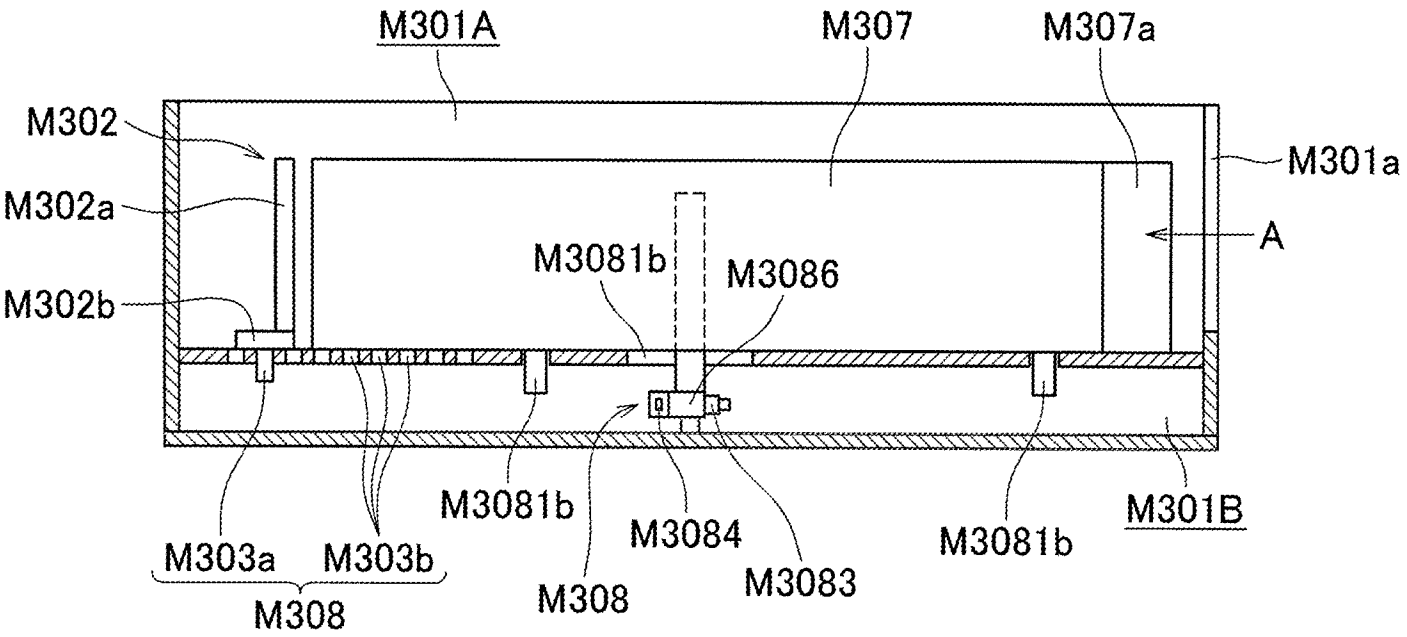
FIG. 7 is a cross section taken along the X-X line in FIG. 6.

As shown in FIG. 6 and FIG. 7, each bill case M300 includes a storing frame M301 storing stacked bills T, a first partition plate M302 contacting the ends of the bills T stored in the storing frame M301, and a first partition plate supporting mechanism M303 that supports the first partition plate M302 to be movable with respect to the ends of the bills T. Because this allows a bill case M300 of a single type to store differently sized and/or differently shaped bills T as the supporting position of the first partition plate M302 is changed, the manufacturing cost of the bill case M300 is reduced as compared to cases where bill cases M300 are provided for respective types and sizes of bills T.

To more specifically describe the bill case M300, the storing frame M301 of the bill case M300 is rectangular parallelepiped in shape and is open-top to allow a staff person to supply or remove bills T. Alternatively, the storing frame M301 may have an openable lid on the upper surface.

In addition to the above, a bill passing hole M301*a* is made through the downstream end face of the storing frame M301 in an import direction A. The bill passing hole M301*a* is open to the third transportation path M3C to allow bills T to move between the storing frame M301 and the third transportation path M3C. Furthermore, in the vicinity of the bill passing hole M301*a*, an import/export mechanism M309 is provided to import and export bills T from and to the storing frame M301. This import/export mechanism M309 may be provided in the bill case M300 or in the third transportation path M3C. The import/export mechanism M309 is preferably formed as a unit and detachable to the bill case M300 or the third transportation path M3C.

Inside the storing frame M301 is provided a horizontal supporting plate M306 supporting the first partition plate M302, bills T, or the like. Above the bottom surface of the storing frame M301, the horizontal supporting plate M306 is disposed to be in parallel to the bottom surface of the storing frame M301. As the horizontal supporting plate M306 divides the internal space of the storing frame M301 into upper and lower spaces, a first housing chamber M301A is formed above the supporting plate M306 and a second housing chamber M301B is formed below the supporting plate M306.

On the upper surface of the horizontal supporting plate M306 is provided a first partition plate M302 that positions the bills T in the longitudinal direction. This first partition plate M302 is provided upstream of bills T in the import direction A. The first partition plate M302 includes a bill contacting portion M302*a* that positions the bills T in the import direction A and a partition plate supporter M302*b* supporting the bill contacting portion M302*a*. The bill contacting portion M302*a* is formed so that at least the surface contacting the bills T is flat to be able to contact the entirety of the upstream side of the bills T in the import direction A. The bill contacting portion M302*a* is disposed to be vertical with respect to the horizontal supporting plate M306, and is arranged so that the upper end thereof is higher than the height of the maximally-stacked bills T. On the other hand, the partition plate supporter M302*b* is provided at the lower end portion of the bill contacting portion M302*a*. The partition plate supporter M302*b* is formed so that the contacting surface contacting the horizontal supporting plate M306 is a rectangular flat plate to surface-contact the horizontal supporting plate M306, so as to keep the bill contacting portion M302*a* to be vertically positioned.

The first partition plate M302 described above is supported by the first partition plate supporting mechanism M303 to be movable forward and backward. The first partition plate supporting mechanism M303 includes a fitting member M303*a* provided on the lower surface of the partition plate supporter M302*b* and fitting holes M303*b* made through the horizontal supporting plate M306. The fitting member 303*a* is rectangular parallelepiped in shape and is positioned to be long in the direction orthogonal to the import direction A of bills T. Each fitting hole M303*b* is shaped and sized to be fitted with the fitting member 303*a*. The direction in which the fitting hole M303*b* are lined up is in parallel to the import direction A of bills T. With this, the first partition plate supporting mechanism M303 is able to position the first partition plate M302 in forward and backward directions with respect to the import direction A, as a fitting hole M303*b* to which the fitting member is fitted is selected.

The fitting holes M303*b* may be provided at regular intervals or provided at intervals corresponding to the sizes of the bills to be stored. When the fitting holes M303*b* are at regular intervals, it is possible to position the first partition plate M302 to be optimal for many sizes of bills. On the other hand, when the fitting holes M303*b* are provided at intervals corresponding to the sizes of the bills to be stored, the first partition plate M302 is easily disposed.

In addition to the above, on the upper surface of the horizontal supporting plate M306 are provided two second partition plates M307 configured to position the bills T in the width directions. These second partition plates M307 are disposed to face each other and to be able to contact or get close to the respective ends of the bills T in the width directions.

The second partition plates M307 are provided to be horizontal with respect to the import direction A, and in each of which at least the surface contacting the bills T has a planar shape. The second partition plates M307 are disposed to be vertical with respect to the horizontal supporting plate M306 and the height of the upper end of each plate is arranged to be higher than the height of the maximally-stacked bills T. The second partition plates M307 are arranged to be symmetrical about the crosswise center line O of the horizontal supporting plates M306, and are movable forward and backward with respect to the center line. With this, by adjusting the distance between the second partition plates M307, it is possible to set the storage width to be optical for bills T of various sizes.

Figure 8:
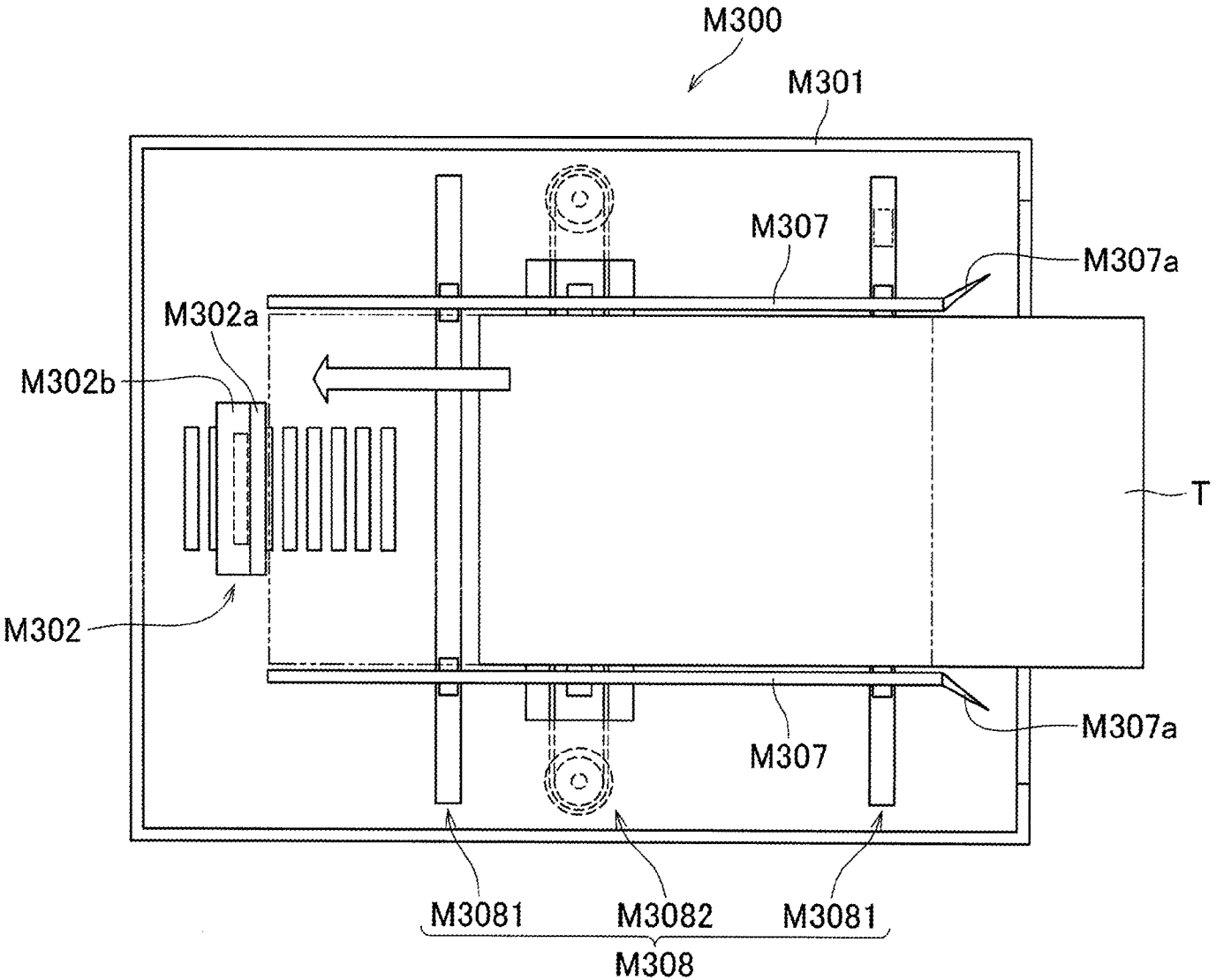
FIG. 8 illustrates how bills are imported into the case bill.

In addition to the above, as shown in FIG. 8, the distance between the second partition plates M307 is wide at the downstream ends in the import direction A. That is to say, each second partition plate M307 has a guide portion M307*a* at the downstream end portion in the import direction A. The guide portion M307*a* is curved outward in the width direction from the upstream to the downstream in the import direction A. With this, the second partition plates M307 make it possible to import bills T by guiding the bills T between the second partition plates M307 without clogging the bills T, even if, at the initial stage of the import of the bills T, the transportation direction and the crosswise transportation position of the bills T are slightly deviated from the correct direction and position.

The second partition plates M307 are supported by the second partition plate supporting mechanism M308. The second partition plate supporting mechanism M308 includes guide mechanisms M3081 and a symmetrical movement mechanism M3082. The guide mechanisms M3081 are provided on the upstream side and on the downstream side in the import direction A, respectively. Each guide mechanisms M3081 includes a guide groove hole M3081*a* formed to extend in the width direction of the horizontal supporting plate M306 and a fitting member M3081*b* movably fitted to the guide groove hole M3081*a*. The guide groove holes M3081*a* are arranged to be in parallel to each other. The fitting members M3081*b* fitted to the guide groove holes M3081*a* are connected to the lower ends of the second partition plates M307. This allows the guide mechanisms M3081 to move the second partition plates M307 while keeping the plates to be in parallel to the import direction A.

Between the above-described guide mechanisms M3081 is provided a symmetrical movement mechanism M3082. The important part of the symmetrical movement mechanism M3082 is provided at the second housing chamber M301B below the horizontal supporting plate M306. The symmetrical movement mechanism M3082 includes an insertion hole M3081*b* made through the horizontal supporting plate M306, gears M3083 provided at the crosswise ends of the horizontal supporting plate M306 to be symmetrical with each other, a chain M3084 attached to the gears M3083, and connecting members M3086 connecting the chain M3084 with the second partition plates M307.

One connecting member M3086 is attached to a predetermined part of the chain M3084 on the upstream in the import direction A. The other connecting member M3086 is attached to a predetermined part of the chain M3084 on the downstream in the import direction A. With this, when one of the second partition plates M307 is moved for a predetermined distance in the width direction, the second partition plate supporting mechanism M308 moves the other second partition plate M307 for a predetermined distance in the opposite direction.

(Electrical Structure of Bill Processing Unit)

A bill processing controller M200 controlling the bill processing unit M1 will be described with reference to the block diagram in FIG. 9.

The bill processing controller M200 illustrated by the block diagram in FIG. 9 includes a control board M210 controlling the operations of the driving units described above. This control board M210 controls the operations of the driving units, and on the control board M210 are mounted a CPU (Central Processing Unit) M220, a ROM (Read Only Memory) M222, a RAM (Random Access Memory) M224, the bill identifying unit M230, and a communication unit M91 constituting a bill identification unit.

The ROM M222 stores operation programs of the driving units such as the motor M13 for the bill transportation mechanism, the motor M20 for driving the pressing plate, the motor M40 for driving the skew correction mechanism, and the motor M70 for the roller elevation, and permanent data such as various programs including an authenticity determination program for the a bill identifying unit M230 and a currency circulation zone determination program.

The CPU M220 operates in accordance with a program stored in the ROM M222 to exchange signals with the above-described driving units via an I/O port M240 so as to perform the overall control of the bill processing unit. That is to say, via the I/O port M240, the CPU M220 is connected to the motor M13 for the bill transportation mechanism, the motor M20 for driving the pressing plate, the motor M40 for driving the skew correction mechanism, and the motor M70 for the roller elevation, and these driving units are controlled by control signals from the CPU M220 based on an operation program stored in the ROM M222. Furthermore, via the I/O port M240, the CPU M220 receives detection signals from the insertion detection sensor M7, the movable piece passing detection sensor M12, and the ejection detection sensor M18. Based on the detection signals, the above-described driving units are controlled.

Furthermore, via the I/O port M240, the CPU M220 receives a detection signal generated based on transmitted or reflected light from an identification target, from the photo acceptance portion M81*a* of the light emitting/receiving unit M81 of the bill reader M8 described above.

The RAM M224 temporarily stores data and programs used when the CPU M220 operates, and obtains and temporarily stores light receiving data from a bill T which is the identification target (i.e., image data constituted by pixels).

The bill identifying unit M230 conducts an authenticity determination process and a currency circulation zone determination process for a bill T to be transported, and determines the authenticity of the bill T and identifies the currency circulation zone and the face value. This bill identifying unit M230 includes a converter M231 configured to convert receiving light data of the identification target stored in the RAM M224 into pixel information including color information (gray level) having brightness for each pixel and a data processing unit M231 configured to process image data regarding the bill T obtained from the reflected light and the transmitted light based on the pixel information converted by the converter M231, such as specifying the print length of the transported bill T and conducting a correction process based on the print length.

In addition to the above, the bill identifying unit M230 includes a reference data storage unit M233 storing reference data regarding genuine bills T and a determination process unit M235 configured to compare comparison data for which various types of data processes regarding the bills T of different face values and currency circulation zones, the authenticity of which is to be determined, have been conducted by the data processing unit M231, with reference data which is stored in the reference data storage unit M233, and determines the authenticity and specifies the currency circulation zone and the face value of the bill T. In this regard, the reference data storage unit M233 stores data such as image data regarding genuine bills T used in the authenticity determination process and the currency circulation zone determination process, a reference value of the print length of each type of genuine bills T, and allowable range data indicating an allowable range determined based on the reference value.

While the reference data is stored in the dedicated reference data storage unit M233, the reference data may be stored in the ROM M222 described above. Furthermore, while the reference value and the allowable range data referred to at the time of the comparison may be stored in the reference data storage unit M233 in advance, receiving light data of a predetermined number of genuine bills may be obtained while transporting them by the bill transportation mechanism M6, and a reference value and an allowable range may be calculated form the obtained data and stored as reference data.

In addition to the above, the CPU M220 is connected to the first light emitting portion M80*a* and the second light emitting portion M81*b* of the above-described bill reader M8 via the I/O port M240. The lighting intervals and the turning-on/off of the first light emitting portion M80*a* and the second light emitting portion M81*b* are controlled by a control signal from the CPU M220 based on an operation program stored in the above-described ROM M222, via the light emission control circuit M260.

(Bill Management Table)

FIG. 10 is a table referred to when the types of bills T and the number of stored bills are managed in the bill processing unit M1. The bill management table is stored in the RAM M224 shown in FIG. 9. The bill management table has a storage stage field, a transportation function field, a bill type field, a maximum number of stored bills field, a number of stored bills field, and an amount of money stored field, and the table associates stored sets of data with these fields.

The storage stage field is a data field used for specifying the bill cases M300 attached to the bill processing unit M1. In the present embodiment, as bill cases M300 of six stages are attached to be vertically lined up, the bill case M300 of the uppermost stage is "1" whereas the bill case M300 of the lowermost stage is "6". In the meanwhile, when, for example, a single bill case M300 is sized to be as large as the fourth to sixth stages, the total number of stages is four and hence the bill case M300 of the uppermost stage is "1" whereas the bill case M300 of the lowermost stage is "4".

The transportation function field is a data field indicating the transportation mode of bills T in the bill case M300 of each stage. When the field indicates "import", the transportation mode in which bills T are imported to the bill case M300 is set. When the field indicates "export", the transportation mode in which bills T are exported from the bill case M300 is set. When the field indicates "import and export", the transportation mode in which bills T are imported to and exported from the bill case M300.

The bill type field is a data field that indicates a type of a bill T. The type of a bill T includes a bill amount and a currency unit. Based on this type of a bill T, the size of the bill T is specified. The bill amount indicates a face value in a legal currency, an international currency, or a local currency, whereas the currency unit is a unit such as U.S. dollar and yen. For example, the data of the bill type indicates 10 USD, the data indicates that the bill T is U.S. 10 dollar bill, and the bill case is dealt with as a for-one-type storage stage for 10 USD. That is to say, the bill case M300 of the first stage functions as a for-one-type storage stage storing 10 dollar bills T. When the bill type field indicates "0", the case is dealt with as a for-mixed-types storage stage for storing any types of bills T. In other words, the for-mixed-types storage stage stores bills T of types that are different from the types of bills T stored in for-one-type storage stages, among the types of bills T registered in advance.

The maximum number of stored bills field is a data field indicating the maximum number of bills stored in the bill case M300. For example, when the field indicates "1000", the bill case M300 of the corresponding stage can store up to 1000 bills. This data is utilized for determining, for example, a timing to collect the bills T.

The number of stored bills field is a data field indicating the number of currently-stored bills T. The amount of money stored field is a data field indicating the total monetary amount of the stored bills T, and is calculated by multiplying the data in the number of stored bills field by the data in the bill type field.

(Gaming Machine Overview)

Figure 11:
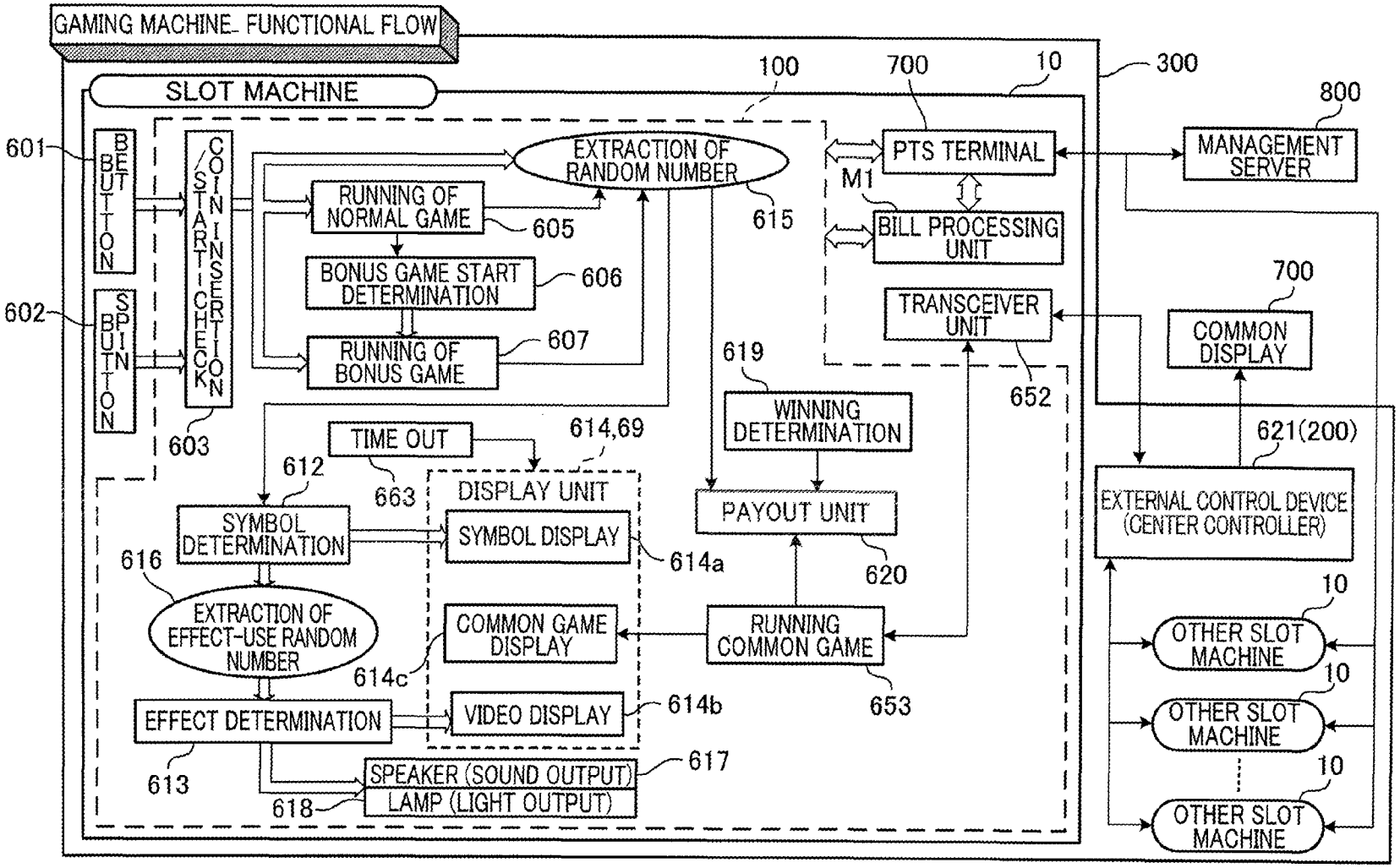
FIG. 11 is an explanatory diagram of a functional flow of the gaming machine.
Figure 12:
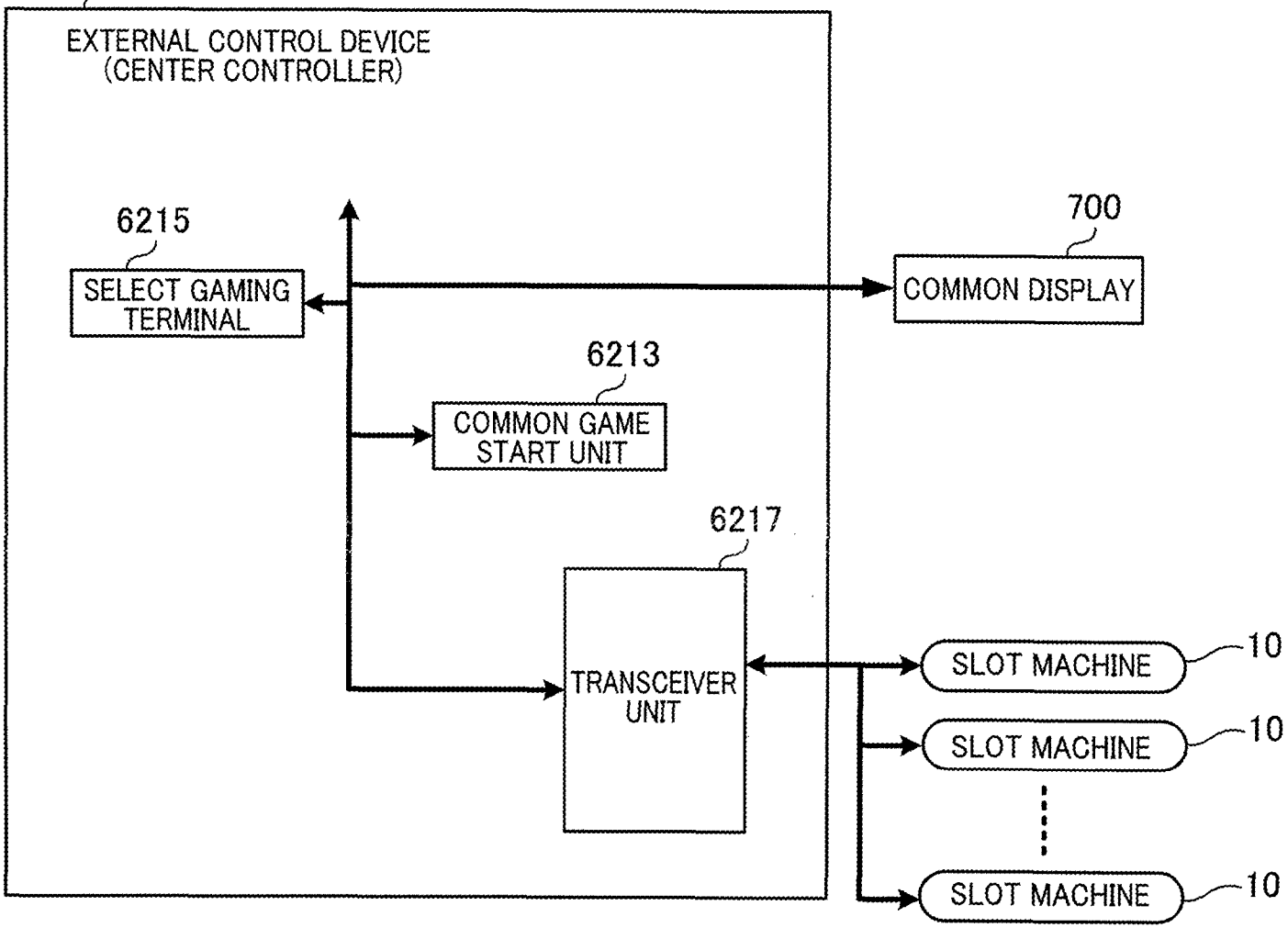
FIG. 12 is a block diagram of a game system.
Figure 13:
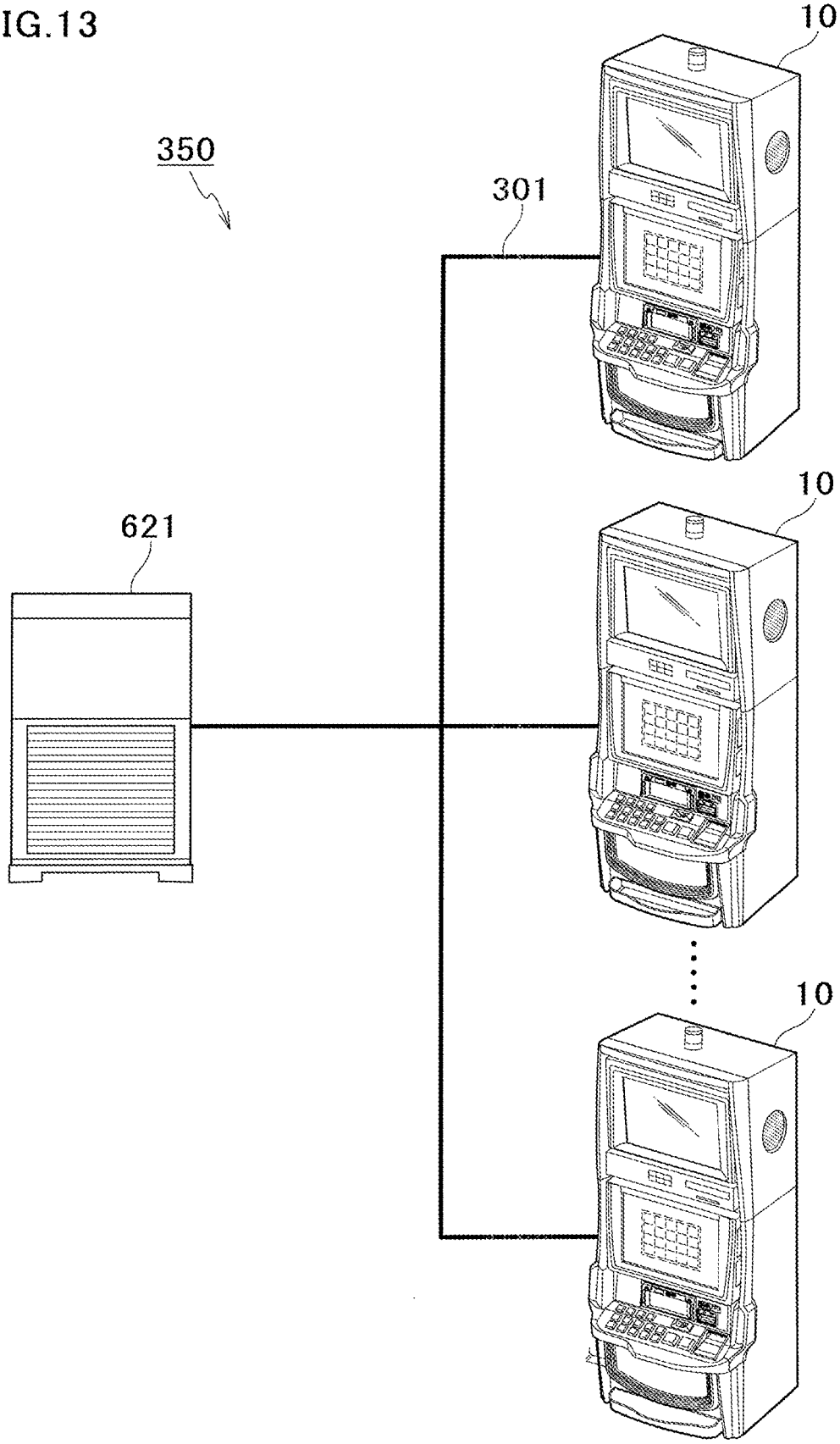
FIG. 13 is a perspective view of an entire gaming machine.

The bill processing unit M1 arranged as above is mounted in a gaming machine. The gaming machine 300 has a multi-player type structure, where a plurality of slot machines 10 each provided as a gaming terminal are connected to a center controller 200 so as to allow data communication therebetween, as shown in FIGS. 11 to 13. The gaming machine 300 is configured in such a manner that a base game such as slot game is runnable individually at each slot machine 10, and a common game is runnable in synchronization among each slot machine 10. Note that the connection between the slot machines 10 and the center controller 200 may be wireless, wired, or a combination of these. Further, a unit of a bet amount may be a national or regional currency such as dollar, yen, and Euro, or a game point passable only at a hall where the gaming machine 300 is installed or an industry related to the gaming machine 300.

More specifically, the gaming machine 300 includes the slot machines 10 and the center controller 200. The slot machines 10 each have an input device which accepts an external input, and a terminal controller which runs the base game and which is programmed to execute various steps in order to run a common game executed at more than one of the slot machines 10. The center controller 200 is connected in communication with the slot machines 10 and is programmed to execute various steps.

The terminal controller of the gaming machine 300 is arranged to be able to execute at least a first process in which a base game is run in response to a start command input to the input device, a second process in which a common game is run in response to a game start command from the center controller 200, and a third process in which a game result of the common game is determined based on game result information from the center controller 200.

It is noted that the "common game" is a sub game different from the main game of the gaming machine 300, and is run along with the basic game or run while the basic game is stopped. Examples of the common game include craps, baseball, and soccer.

The center controller 200 of the gaming machine 300 is arranged to be able to execute at least a first process in which a game start command is output at a predetermined timing to a slot machine 10 which satisfies a game running condition, a second process in which the game result of the common game is determined, and a third process in which the game result determined in the second process is output, as game result information, serially to the slot machines 10.

The "game running condition" is a condition for being qualified to participate in the common game. Examples of the game running condition include a cumulative value of a base game bet amount equal to or greater than a minimum bet amount, and the number of base game played being equal to or greater than a minimum number of bets. Note that the game running condition can be satisfied at the will of a player before the common game is begun. For example, when the cumulative value of bet amounts in the base game falls short of the minimum bet amount and the game running condition is not satisfied for this reason, the game running condition can be satisfied by paying a bet amount to compensate the differential between the minimum bet amount and the cumulative value of the bet amounts or making a payment for satisfying a predetermined condition, immediately before the common game is started. Further, in cases where the number of base games falls short, the game running condition can be satisfied by payment corresponding to the shortage, or by making a payment for satisfying a predetermined condition.

Further, the "predetermined timing" at which a game start command is outputted is a timing when a common game start condition has been satisfied at any one of the slot machines 10. Here, examples of the common game start condition include: information of accumulated bet amounts, and an accumulated base game count. Note that the present embodiment is described using the gaming machine 300 having a center controller 200 aside from the slot machines 10; however, the present invention is not limited to this. In other words, the gaming machine 300 may be configured in such a manner that at least one slot machine 10 has a function of the center controller 200, and the slot machines 10 may be connected with each other so as to allow data communication therebetween.

The "slot machines 10" each are a type of gaming terminal in the gaming machine 300. Note that the present embodiment is described using slot machines 10 as an example of gaming terminals; however, the present invention is not limited to this: The present invention may adopt a model which has a terminal controller capable of independently running some base game.

The "base game" in the present embodiment is run by the slot machines 10. The base game is a slot game where a plurality of symbols 501 are rearranged. Note that the base game is not limited to slot game: The base game may be any type as long as it is independently runnable at gaming terminals such as slot machines 10.

The rearrangement of the symbols 501 in the slot game is conducted on the symbol display region 614*a* of the display 614. The slot game includes processes of: running a normal game on condition that a game value is bet, in which normal game the symbols 501 are rearranged, and awarding a normal payout according to the symbols 501 rearranged; when the symbols 501 are rearranged on a predetermined condition, running a bonus game where the symbols 501 are rearranged under such a condition that a payout rate thereof is greater than that of the normal game, and awarding a bonus payout according to the symbols 501 rearranged; and when a rescue start condition is met, running a rescue process.

Figure 26:
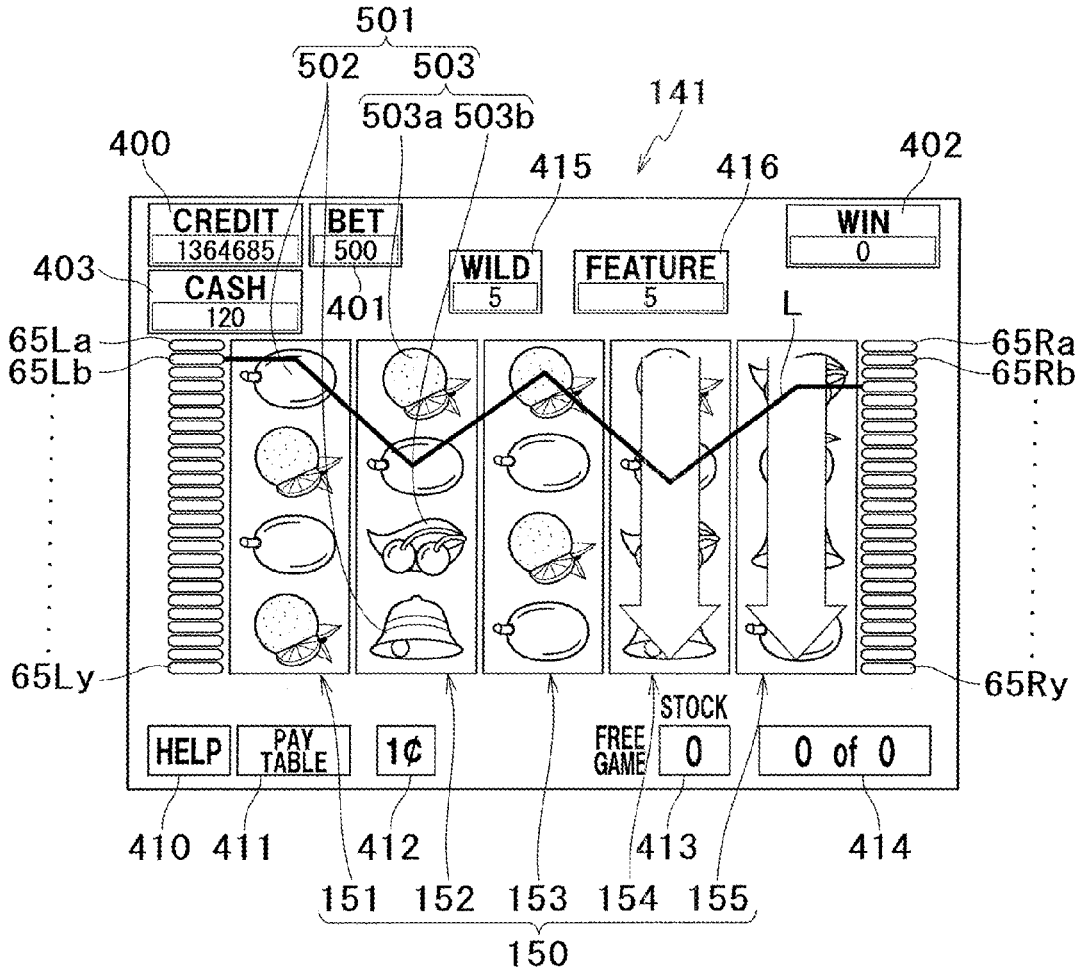
FIG. 26 is an explanatory diagram of a display state of a symbol display device.

The symbols 501 include "specific symbols 503" and "normal symbols 502." That is, the "symbols 501" is a superordinate conception of the specific symbols 503 and normal symbols 502. The specific symbols 503 include wild symbols 503*a* and trigger symbols 503*b*, as shown in FIG. 26. Each of the wild symbols 503*a* is a symbol substitutable for any type of symbols 501. Each of the trigger symbols 503*b* is a symbol which triggers at least a bonus game. That is, a trigger symbol 503*b* triggers transition from the normal game to the bonus game, and triggers stepwise increases in the number of specific symbols 503 at an interval from the start of the bonus game. Further, the trigger symbol 503*b* triggers increases in the number of specific symbols 503 in the bonus game, that is, the trigger symbol 503*b* triggers increases in the number of trigger symbols 503*b* and/or wild symbols 503*a*. Note that the trigger symbol 503*b* may trigger an increase in the number of games in the bonus game.

The "game value" is a coin, a bill T, or electronic valuable information corresponding to these. Note that the game value in the present invention is not particularly limited. Examples of the game value include game media such as medals, tokens, cyber money, tickets, and the like. A ticket is not particularly limited, and a later-mentioned barcoded ticket may be adopted for example.

The "bonus game" has a same meaning as a "feature game." In the present embodiment, the bonus game is a game in which free games are repeated. However, the bonus game is not particularly limited and may be any type of game, provided that the bonus game is more advantageous than the normal game for a player. Another bonus game may be adopted in combination, provided that a player is given more advantageous playing conditions than the normal game. For example, the bonus game may be a game that provides a player with a chance of winning more game values than the normal game or a game that provides a player with a higher chance of winning game values than the normal game. Alternatively, the bonus game may be a game that consumes fewer amounts of game values than the normal game. In the bonus game, these games may be provided alone or in combination.

The "free game" is a game runnable with a bet of fewer game values than the normal game. Note that "bet of fewer amounts of game values" encompasses a bet of zero game value. The "free game" therefore may be a game runnable without a bet of a game value, which free game awards an amount of game values based on symbols 501 rearranged. In other words, the "free game" may be a game which is started without consumption of a game value. To the contrary, the "regular game" is a game runnable on condition that a game value is bet, which regular game awards an amount of game value based on the symbols 501 rearranged. In other words, the "normal game" is a game which starts with consumption of a game value.

The expression "rearrange" in this specification means dismissing an arrangement of symbols 501, and arranging symbols 501 once again. "Arrangement" means a state where the symbols 501 can be visibly confirmed by a player.

The phrase "base payout based on the rearranged symbols 501" means a normal payout corresponding to a rearranged winning combination. The phrase "bonus payout based on the rearranged symbols 501" means a bonus payout corresponding to a rearranged winning combination. Furthermore, the term "winning combination" indicates that a winning is established.

Examples of a "condition in which a payout rate is higher than in the normal game" includes the running of a free game and the running of a game in which the number of wild symbols or trigger symbols is increased or a replaced symbol table is used. In the base game, a rescue process may be executed when a rescue start condition is established.

The "rescue process" is a process for rescuing players. Examples of the rescue process include: running a free game, running a game in which the number of wild symbols or trigger symbols is increased or a replaced symbol table is used, and awarding an insurance payout.

Examples of the "rescue start condition" include a state in which the normal game is excessively repeated, i.e., the normal game is repeated a predetermined number or more times and a state in which the total amount of the obtained payout is excessively small, i.e., the normal payout and the bonus payout that a single player obtained as a result of playing a game a predetermined number or more times are not higher than a predetermined value. The "rescue process" is a process for rescuing players. Examples of the rescue process include the running of a free game, the running of a game in which the number of wild symbols or trigger symbols is increased or a replaced symbol table is used, and the awarding of an insurance payout.

In addition to the above, the gaming machine 300 includes a common display 700 which is installed to be visible from the operating positions of all slot machines 10. The center controller 200 may cause the common display 700 to display states until the common game start condition is established. It is noted that the "operating position" is the eye-level position of the player at each slot machine 10. The gaming machine 300 arranged in this way allows each player to estimate the waiting time until the common game starts, by displaying on the common display 700 the states until the common game start condition is established.

(Functional Flow of Gaming Machine 300: Slot Machine)

The gaming machine 300 having the above structure has slot machines 10 and an external controller 621 (center controller 200) connected to the slot machines 10 so as to allow data communication therebetween. The external controller 621 are connected to the slot machines 10 installed in the hall so that data communication is possible therebetween.

The slot machines 10 each include a bet button 601, a spin button 602, a display 614, and a game controller 100 which controls these units. Note that the bet button 601 and the spin button 602 each are a kind of an input device. Further, the slot machine 10 includes a transceiver unit 652 which enables data communication with the external controller 621.

The bet button 601 has a function of accepting a bet amount through a player's operation. The spin button 602 has a function of accepting a start of a game such as normal game through a player's operation, that is, a start operation. The display 614 has a function of displaying still-image information and moving-image information. Examples of the still-image information are various types of symbols 501, numeral values, and signs. Examples of the moving-image information include effect video. The display 614 has a symbol display region 614*a*, an image display region 614*b*, and a common game display region 614*c*.

The symbol display region 614*a* displays symbols 501, as shown in FIG. 26. The image display region 614*b* displays various types of effect image information to be displayed during a game, in the form of a moving image or a still image. The common game display region 614*c* is a region where a common game such as a jackpot game is displayed.

The game controller 100 includes: a coin insertion/start-check unit 603; a normal game running unit 605; a bonus game start determining unit 606; a bonus game running unit 607; a random number sampling unit 615; a symbol determining unit 612; an effect-use random number sampling unit 616; an effect determining unit 613; a speaker unit 617; a lamp unit 618; a winning determining unit 619; and a payout unit 620.

The normal game running unit 605 has a function of running a normal game on condition that the bet button unit 601 has been operated. The bonus game start determining unit 606 determines whether to run a bonus game, based on a combination of rearranged symbols 501 resulted from the normal game. In other words, the bonus game start determining unit 606 has functions of: (i) determining that the player is entitled to a bonus game when one or more trigger symbols 503*b* rearranged satisfy a predetermined condition; and (b) activating the bonus game running unit 607 so as to run a bonus game from the subsequent unit game.

Note that a unit game includes a series of operations executed within a period between a start of receiving a bet and a point where a winning may be resulted. For example, bet reception, rearrangement of symbols 501 having been stopped, and a payout process to award a payout are executed once each within a single unit game of the normal game. Note that a unit game in a normal game is referred to as a unit normal game.

The bonus game running unit 607 has a function of running the bonus game which repeats a free game for a plurality of times, merely in response to an operation on the spin button 602.

The symbol determining unit 612 has functions of: determining symbols 501 to be rearranged based on a random number given from the random number sampling unit 615; rearranging the determined symbols 501 in the symbol display region 614*a* of the display 614; outputting information on rearrangement of the rearranged symbols 501 to the winning determining unit 619; and outputting an effect specifying signal to the effect-use random number sampling unit 616, based on the rearrangement of the symbols 501.

The effect-use random number sampling unit 616 has functions of: when receiving the effect instruction signal from the symbol determining unit 612, extracting an effect-use random number; and outputting the effect-use random number to the effect determining unit 613. The effect determining unit 613 has functions of: determining an effect by using the effect-use random number; outputting image information on the determined effect in the image display region 614*b* of the display 614; outputting audio and illumination information on the determined effect to the speaker unit 617 and the lamp unit 618, respectively.

The winning determining unit 619 has functions of: determining whether a winning is achieved when information on symbols 501 rearranged and displayed on the display 614 is given; calculating an amount of payout based on a winning combination formed when it is determined that a winning has been achieved; outputting to the payout unit 620 a payout signal which is based on the payout amount. The payout unit 620 has a function of paying out a game value to a player in the form of a coin, a medal, a credit, or the like. Further, the payout unit 620 has a function of adding credit data to credit data stored on an IC card 500 inserted into a later-described PTS terminal 700, the credit data to be added corresponding to the credit to be paid out.

In addition to the above, the game controller 100 includes an unillustrated storage unit which stores various types of bet amount data. The storage unit is a storage device which stores data in a rewritable manner, such as a hard disc and a memory.

Further, the game controller 100 has a common game running unit 653. The common game running unit 653 has functions of: outputting bet amount information to the external controller 621 for each unit base game, the bet amount information being based on a bet amount placed as a bet on a normal game; running a common game in response to a game start command from the external controller 621; and accepting a bet input through the bet button unit 601 when the bet input corresponds to common game bet amount data indicating a bet amount bettable on the common game.

Figure 18:
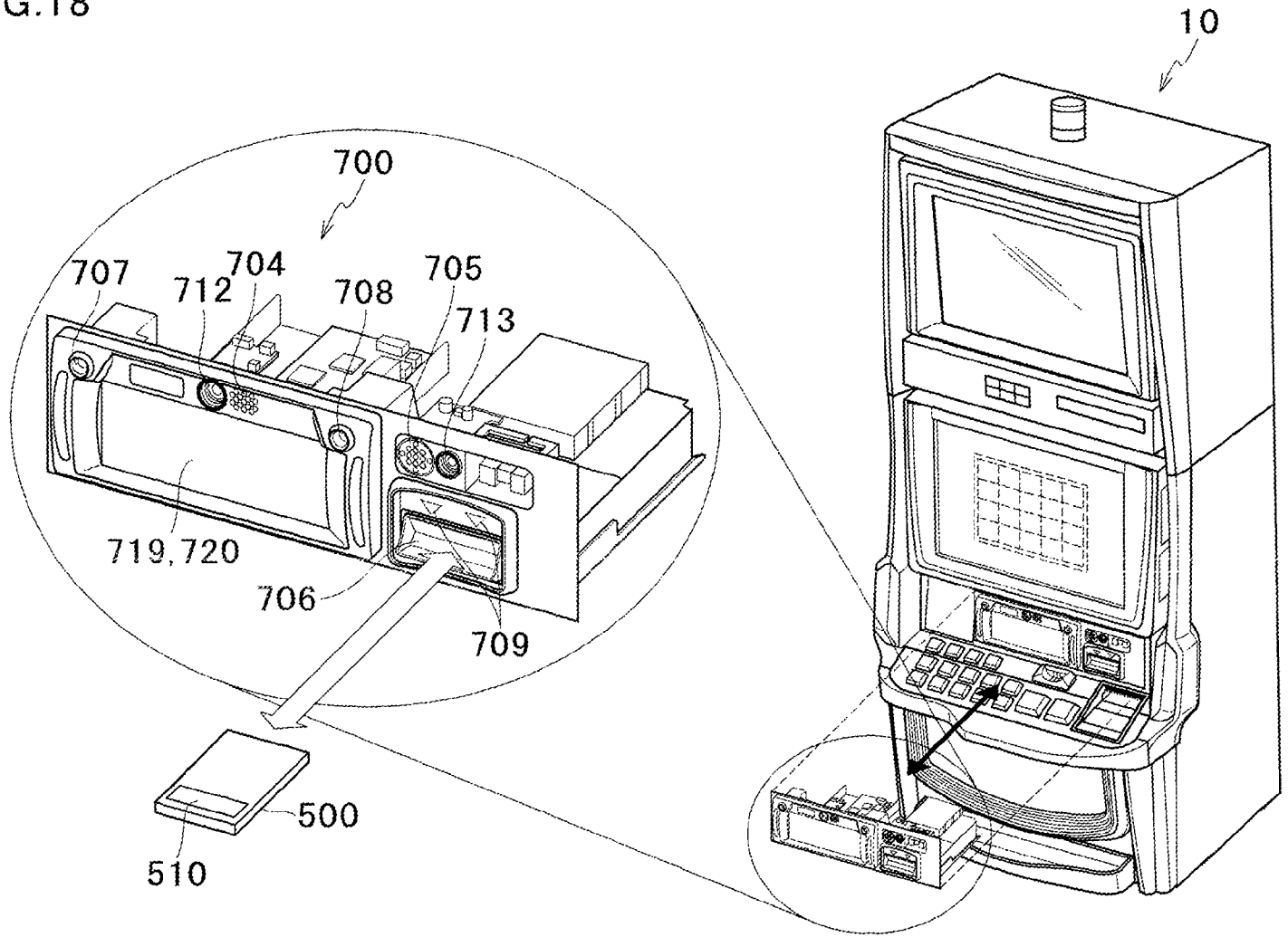
FIG. 18 is a magnified perspective view of a PTS terminal.

Further, the game controller 100 is connected to the PTS terminal 700. The PTS terminal 700 is, as shown in FIG. 18, a unit in which components such as a LCD 719, microphones 704 and 705, and human detection cameras 712 and 713 are integrated. By mutually communicating with the game controller 100 and the bill processing controller M200, the PTS terminal 700 performs, for example, effects in games and permission to the player to instruct the payout of bills T to the bill processing unit M1. Particularly, the PTS terminal 700 is provided with a card insertion slot 706, where an IC card 500 can be inserted. Thus allows a player to use a credit stored on an IC card 500 at a slot machine 10, by inserting the IC card 500 into the card insertion slot 706. Note that a mechanical structure of the PTS terminal 700 is detailed later.

Further, when receiving credit data from the PTS terminal 700, the game controller 100 updates a credit display on the display 614. Further, when a cash out occurs, the game controller 100 outputs cash-out credit data to the PTS terminal 700.

The PTS terminal 700 of each of the slot machines 10 constituting the gaming machine 300 is connected in communication with a management server 800, which performs central management of image downloading, IC cards 500, and credits.

(Functional Flow of Gaming Machine 300: External Controller)

The gaming machine 300 arranged as above is connected to an external controller 621. The external controller 621 has a function of remotely operating and remotely monitoring an operating status of each slot machine 10 and a process such as change in various game setting values. Furthermore, the external controller 621 has a function of determining the common game start condition for each gaming terminal, and running the common game at a plurality of slot machines 10 when a result satisfying the common game start condition is achieved in any one of the gaming terminals.

More specifically, as shown in FIG. 11, the external controller 621 includes a common game start unit 6213, a gaming terminal selection unit 6215, and a transceiver unit 6217. The common game start unit 6213 has functions of: determining whether the common game start condition is established, based on information of accumulated bet amounts transmitted from each slot machine 10 in each unit base game; outputting a game start command to the slot machines 10; and displaying on the common display 700 a screen showing states until the common game start condition is established.

Note that the determination of whether the common game start condition is established is made based on the information of accumulated bet amounts, as well as all the accumulated values which increase according to repetition of the unit base games. For example, the number of base games, the time spent in playing the base game, or the like may be used as the accumulated value.

In addition to the above, the common game start unit 6213 has a function of outputting a game start command to a slot machine 10 in which the accumulated value which increases as the base game is repeated satisfies the game running condition. Accordingly, the common game start unit 6213 does not qualify the one or more slot machines 10 whose accumulated value is less than the minimum setting value to participate in the common game. This motivates the player to proactively repeat base games.

Further, the common game start unit 6213 has functions of monitoring the no-input period during which no start operation is executed, and outputting a game start command to all the slot machines 10 except one or more slot machines 10 whose no-input period equals or exceeds the time-out period. Thus, the common game start unit 6213 is capable of determining that no player is present at a slot machine 10 where no base game is run for a period of time equal to or longer than the time-out period, thus preventing such a slot machine 10 from running the common game.

The gaming terminal selection unit 6215 has a function of selecting a specific slot machine 10 from among the slot machines 10, and outputting a common game start command signal to the specific slot machine 10. The transceiver unit 6217 has a function of enabling data communication with the slot machines 10.

(Entire Structure of Game System)

The following describes a game system 350 having the gaming machine 300 with the above structure.

As shown in FIG. 13, the game system 350 includes a plurality of slot machines 10, and an external controller 621 which is connected to the slot machines 10 through communication lines 301.

The external controller 621 is for controlling the slot machines 10. In the present embodiment, the external controller 621 is a so-called hall server installed in a game arcade where the plurality of slot machines 10 are provided. Each slot machine 10 is allotted a unique identification number. The external controller 621 distinguishes an origin of data transmitted from each slot machine 10. Further, the external controller 621 determines transmission destination of data with the identification number when transmitting data to a slot machine 10.

Note that the game system 350 may be installed in one game arcade where various games take place such as a casino, or between a plurality of game arcades. In a case of the game system 350 being installed in one game arcade, gaming systems 350 may be provided for each floor or each section of the game arcade. The communication line 301 may have a wired or wireless structure. A dedicated line or exchange line may be employed as the communication line 301.

Figure 14:
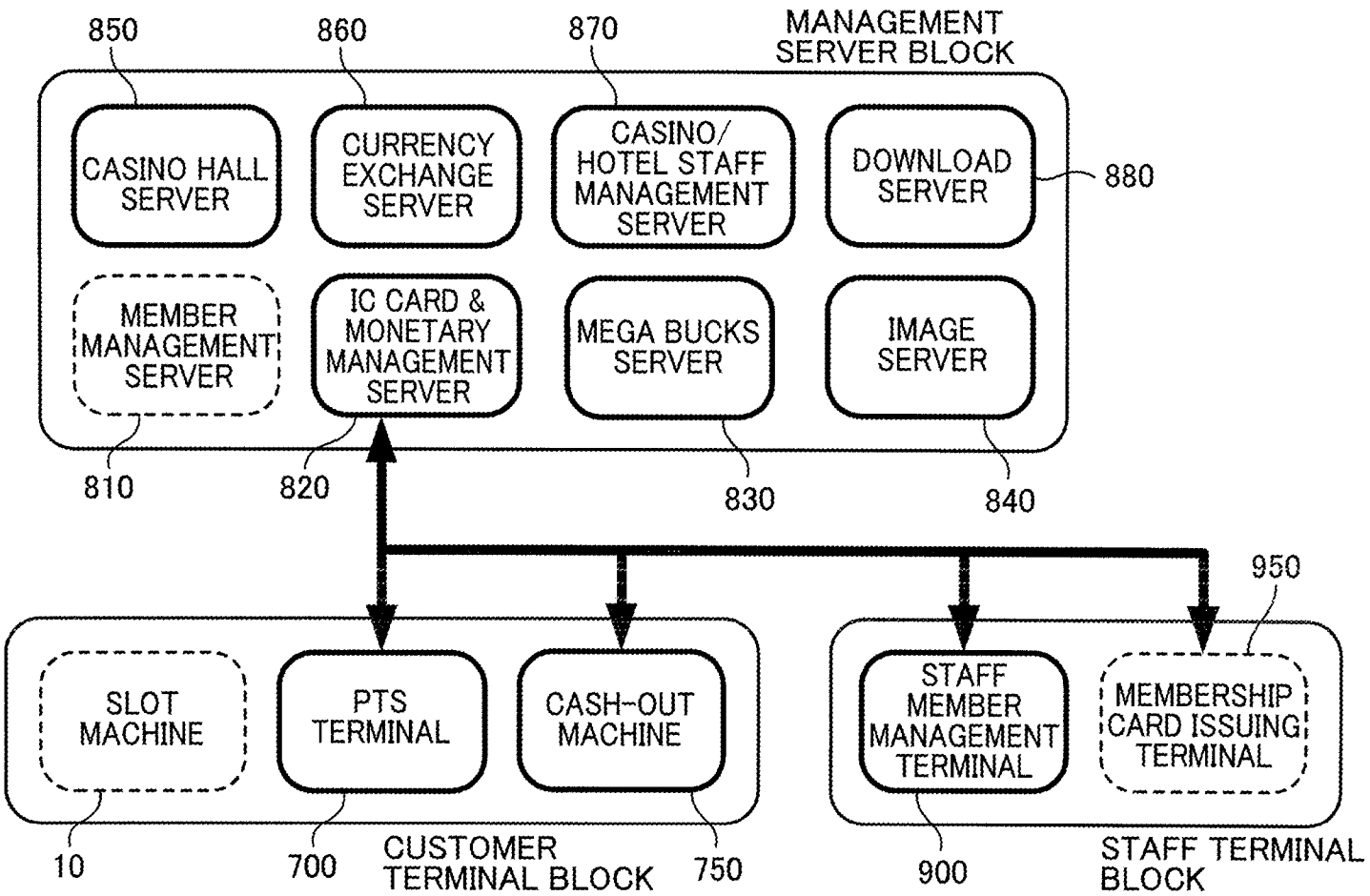
FIG. 14 is a block diagram of a PTS system.

As shown in FIG. 14, the game system 350 is divided into three major blocks: a management server block, a customer terminal block, and a staff terminal block. The management server block has a casino hall server 850, a currency exchange server 860, a casino/hotel staff management server 870, and a download server 880.

The casino hall server 850 manages an entire casino hall where slot machines 10 are installed. The currency exchange server 860 creates currency exchange rate data, based on currency exchange information and the like. The casino/hotel staff management server 870 manages the casino hall, or staff persons of a hotel associated with the casino hall. The download server 880 downloads the newest information such as information or news related to a game, and informs a player to the newest information through the PTS terminal 700 of each slot machine 10.

Further, the management server block has a member management server 810, an IC card & money management server 820, a megabucks server 830, and an image server 840.

The member management server 810 manages membership information of a player who plays at the slot machine 10. The IC card & money management server 820 manages an IC card 500 utilized at the slot machine 10. Specifically, the IC card & money management server 820 stores broken number cash data in association with an identification code, outputs the broken number cash data to the PTS terminal 700, and the like. Note that the IC card & money management server 820 creates and manages denomination rate data and the like. The megabucks server 830 manages a megabucks which is a game where a total amount of wagers is utilized as a payout, the wagers being placed at slot machines 10 provided at a plurality of casino halls and the like, for example. The image server 840 downloads a newest image such as an image or news related to a game, and informs the player thereof, through the PTS terminal 700 of each slot machine 10.

The customer terminal block includes a slot machine 10, a PTS terminal 700, and a settlement machine 750. The PTS terminal 700 is attachable to a slot machine 10, and is capable of communicating with the management server 800.

The settlement machine 750 performs settlement by converting cash data into cash, stores coins or bills T as cash data onto the IC card 500, and the like, the cash data being stored on the IC card 500 carried by the player.

The staff terminal block has a staff person management terminal 900 and a member card issuance terminal 950. The staff person management terminal 900 is provided for a staff person at the casino hall to manage various types of slot machines 10. Particularly in the present embodiment, the staff person management terminal 900 allows a staff person at the casino hall to check for a possible excess number of IC cards 500 stocked in the PTS terminal 700, or shortage of IC cards 500 in the PTS terminal 700. The member card issuance terminal 950 is for a player who plays games at the casino hall to obtain a member card.

Figure 15:
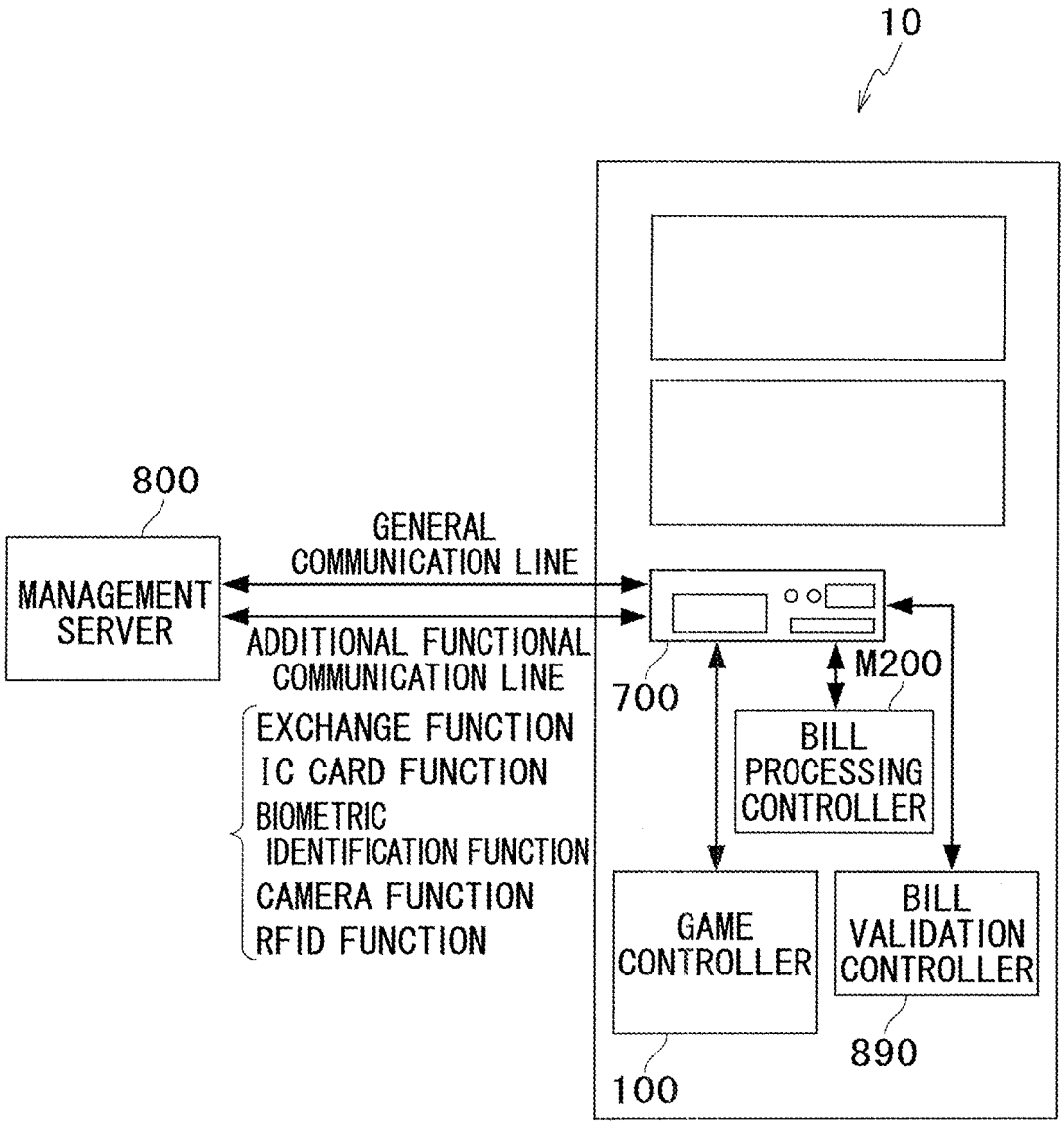
FIG. 15 is a block diagram of a PTS system.

The PTS terminal 700 is incorporated in a PTS system, as shown in FIG. 15. The PTS terminal 700 provided to a slot machine 10 is connected in communication with the game controller 100, a bill validation controller 890, and a bill processing controller M200 of the slot machine 10.

Through communication with the game controller 100, the PTS terminal 700 executes an effect of a game with a sound or an image, updates credit data, and the like. Further, through communication with the bill validation controller 890, the PTS terminal 700 transmits credit data necessary for settlement.

Further, the PTS terminal 700 is connected in communication with the management server 800. The PTS terminal 700 communicates with the management server 800 through the two lines: a normal communication line and an additional function communication line.

Through the normal communication line, the PTS terminal 700 communicates data such as cash data, identification code data, player membership information, and the like. Meanwhile, through the additional function communication line, the PTS terminal 700 executes communication related to an additional function. In the present embodiment, through the additional function communication line, the PTS terminal 700 executes communication related to an exchange function, and IC card function, a biometric identification function, a camera function, a RFID (Radio Frequency Identification) function which is for executing a solid-matter identification function with radio wave.

(Mechanical Structure of Slot Machine)

Figure 16:
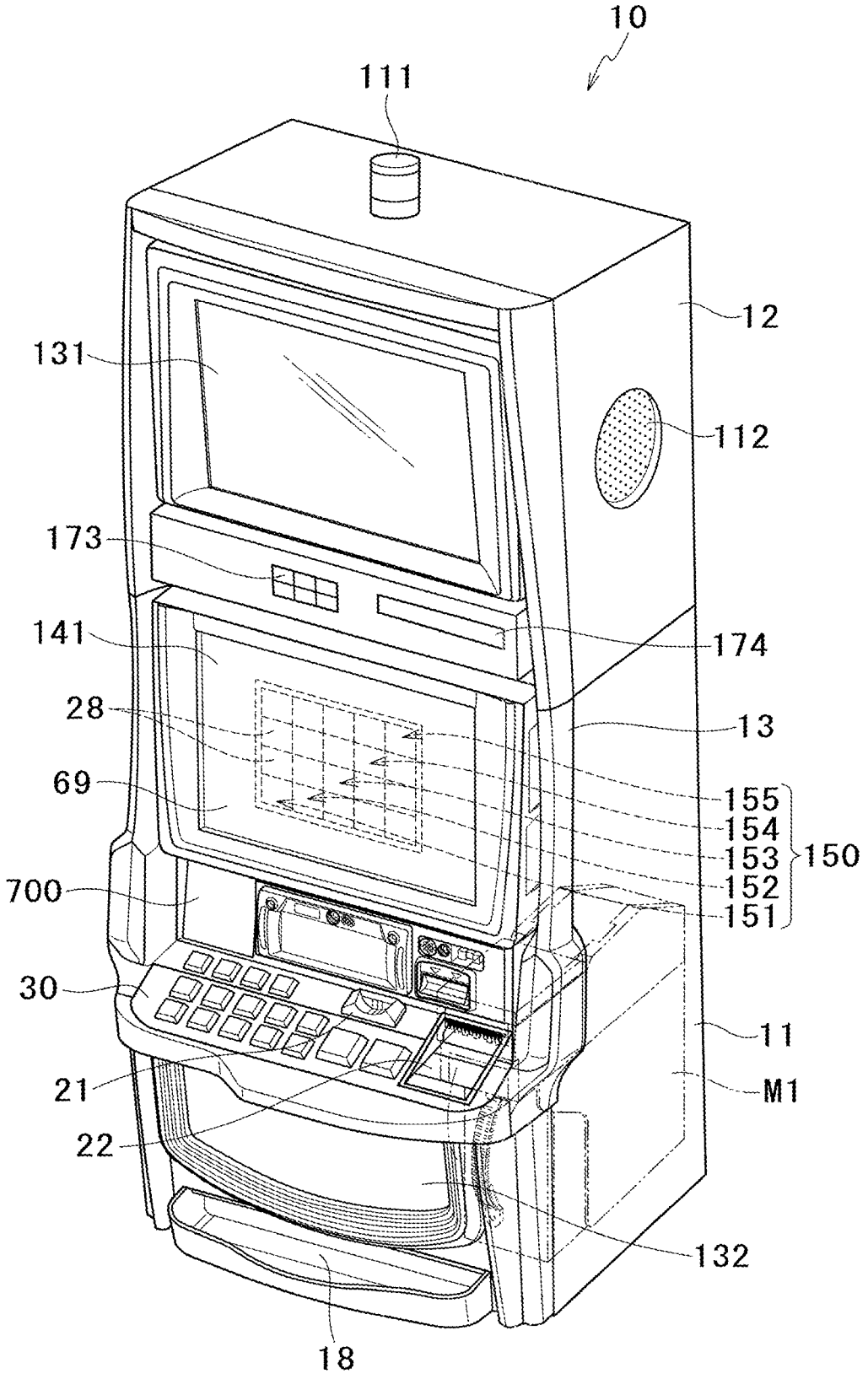
FIG. 16 is a perspective view of a slot machine in the gaming machine.

The following describes an entire structure of a slot machine 10 with reference to FIG. 16.

At a slot machine 10, a coin, a bill T, or electronic valuable information corresponding to these are utilized as game medium. Specifically, credit-related data such as cash data stored on the IC card 500 is utilized in the present embodiment.

The slot machine 10 has a cabinet 11, a top box 12 provided above the cabinet 11, and a main door 13 provided on the front face of the cabinet 11.

The main door 13 is provided with a lower image display panel 141 (display 614). The lower image display panel 141 is made of a transparent liquid crystal panel. A screen displayed on the lower image display panel 141 has display windows 150 at its center portion. The display window 150 includes twenty display blocks 28 which are arranged in five columns and four rows. The columns form simulated reels 151 to 155, each having four display blocks 28. The four display blocks 28 in each of the simulated reels 151 to 155 are displayed as if all the display blocks 28 are moving downward at various speeds. This enables rearrangement, in a manner that symbols 501 respectively displayed in the display blocks 28 are rotated in a longitudinal direction and stopped thereafter.

Here, as shown in FIG. 26, payline occurrence columns are provided to the left and the right of the display windows 150 in a symmetrical manner. The payline occurrence column on the left side when viewed from the player includes 25 payline occurrence parts 65L (65La, 65Lb, 65Lc, 65Ld, 65Le, 65Lf, 65Lg, 65Lh, 65Li, 65Lj, 65Lk, 65Ll, 65Lm, 65Ln, 65Lo, 65Lp, 65Lq, 65Lr, 65LS, 65Lt, 65Lu, 65Lv, 65Lw, 65Lx, and 65Ly).

On the other hand, the payline occurrence column on the right includes 25 payline occurrence parts 65R (65Ra, 65Rb, 65Rc, 65Rd, 65Re, 65Rf, 65Rg, 65Rh, 65Ri, 65Rj, 65Rk, 65Rl, 65Rm, 65Rn, 65Ro, 65Rp, 65Rq, 65Rr, 65Rs, 65Rt, 65Ru, 65Rv, 65Rw, 65Rx, and 65Ry).

Each payline occurrence part 65L is paired with one of the payline occurrence parts 65R. Paylines L are prescribed, each extending from one of the payline occurrence parts 65L to one of the payline occurrence parts 65R which are paired with each other. Although there are 25 paylines L in the present embodiment, FIG. 26 only shows one payline L for the sake of easier understanding.

Each payline L is activated when the payline L connects a pair of payline occurrence parts 65L and 65R. The payline L otherwise is inactivated. The number of paylines L to be activated is determined based on a bet amount. In such a case where a MAXBET indicating the maximum amount of bet allowed, the maximum number of paylines L, that is, 25 paylines L are activated. An activated payline allows the symbols 501 to establish various types of winning combinations. Details of the winning combinations will be described later.

The present embodiment deals with a case where the slot machine 10 is a so-called video slot machine. However, the slot machine 10 of the present invention may partially adopt a so-called mechanical reel in place of the simulated reels 151 to 155.

Further, as shown in FIG. 16, a touch panel 69 is disposed on a front face of the lower image display panel 141, and a player is able to input various instructions by operating the touch panel 69. From the touch panel 69, an input signal is transmitted to the main CPU 71.

Provided below the lower image display panel 141 is a control panel 30. In addition to various buttons, the control panel 30 has a coin entry 21 which accepts coins into the cabinet 11, and a bill entry 22. The bill entry 22 is connected to the bill processing unit M1 housed in the device. Details of the bill processing unit M1 will be given later.

Specifically, the control panel 30 has a reserve button 31, a collect button 32, and a game rule button 33 to an upper left region thereof. The control panel 30 further includes a 1-bet button 34, a 2-bet button 35, a 3-bet button 37, a 5-bet button 38, and a 10-bet button 39 to a middle left region thereof. Moreover, the control panel 30 further includes a play 2 line button 40, a play 10 lines button 41, a play 20 lines button 42, and a play 40 lines button 43, and a max lines button 44 provided to a lower left region thereof.

Further, the control panel 30 has the coin entry 21 and the bill entry 22 in an upper right region thereof, and a gamble button 45 and a start button 46 in a lower right region thereof.

The reserve button 31 is an operation button used when a player leaves the seat, or when requesting a staff person at the game arcade exchange of money. The collect button 32 is a so-called settlement button which adds credit data related to a credit obtained in various games to credit data stored on the IC card 500 inserted into the PTS terminal 700. Furthermore, the collect button 32 outputs an image or sound on the PTS terminal 700 to ask whether the settlement is made by bills T for the player. The game rule button 33 is pushed when an operation method of a game or the like is unclear. Pushing the game rule button 33 causes a later-described upper image display panel 131 or the lower image display panel 141 to display various types of help information.

Each time a 1-bet button 34 is pushed, a credit is bet on each active payline L, the credit being currently owned by the player. The 2-bet button 35 is for starting a game with two bets placed on each active payline L. The 3-bet button 35 is for starting a game with three bets placed on each active payline L. The 5-bet button 35 is for starting a game with five bets placed on each active payline L. The 10-bet button 35 is for starting a game with ten bets placed on each active payline L. Thus, pushing which one of 1-bet button 34, the 2-bet button 35, the 3-bet button 37, the 5-bet button 38, and the 10-bet button 39 determines the amount of bet to be placed on each active payline L.

Pushing the play 2 line button 40 activates paylines L. Pushing the play 10 lines button 40 thus activates 2 paylines. Pushing the play 10 line button 41 activates paylines L. Pushing the play 10 lines button 41 thus activates ten paylines. Pushing the play 20 line button 42 activates paylines L. Pushing the play 20 lines button 42 thus activates twenty paylines. Pushing the play 2 line button 43 activates paylines L. Pushing the play 40 lines button 43 thus activates forty paylines. Pushing the max lines button 44 activates paylines L. Pushing the max lines button 44 thus activates the maximum number of paylines L: fifty paylines L.

The gamble button 45 is for causing transition from the bonus game to a gamble game or the like after the bonus game has ended. Here, the gamble game is run with an obtained credit.

The start button 46 is for starting scrolling of the symbols 501. The start button 46 also serves as a button for starting a bonus game, adding a credit obtained in the bonus game, and the like. The coin entry 21 is for accepting a coin into the cabinet 11. The bill entry 22 is structured to allow bills T dealt with in the bill processing unit M1 in the cabinet 11 to be dealt with from the outside (e.g., by the player).

As shown in FIG. 16, on a lower front face of the main door 13, that is, below the control panel 30 is a coin receiving slot 18 for inserting coins, and a belly glass 132 with a character related to the slot machine 10 shown thereon.

Provided on a front face of the top box 12 is the upper image display panel 131. The upper image display panel 131 is made of a liquid crystal panel, and it constitutes a display. The upper image display panel 131 displays an image related to an effect, or an image showing introduction or rules of the game. Further, the top box 12 is provided with a speaker 112 and a lamp 111. At the slot machine 10, an effect is executed with an image display and sound and light output.

Below the upper image display panel 131 is a data displayer 174 and the keypad 173. The data displayer 174 is made of a fluorescent display, an LED, and the like. The data displayer 174 displays membership data read our from the IC card 500 inserted into the PTS terminal 700, and data inputted by the player through the keypad 173, for example. The keypad 173 is for inputting data.

(Mechanical Structure of the PTS Terminal)

Figure 19:
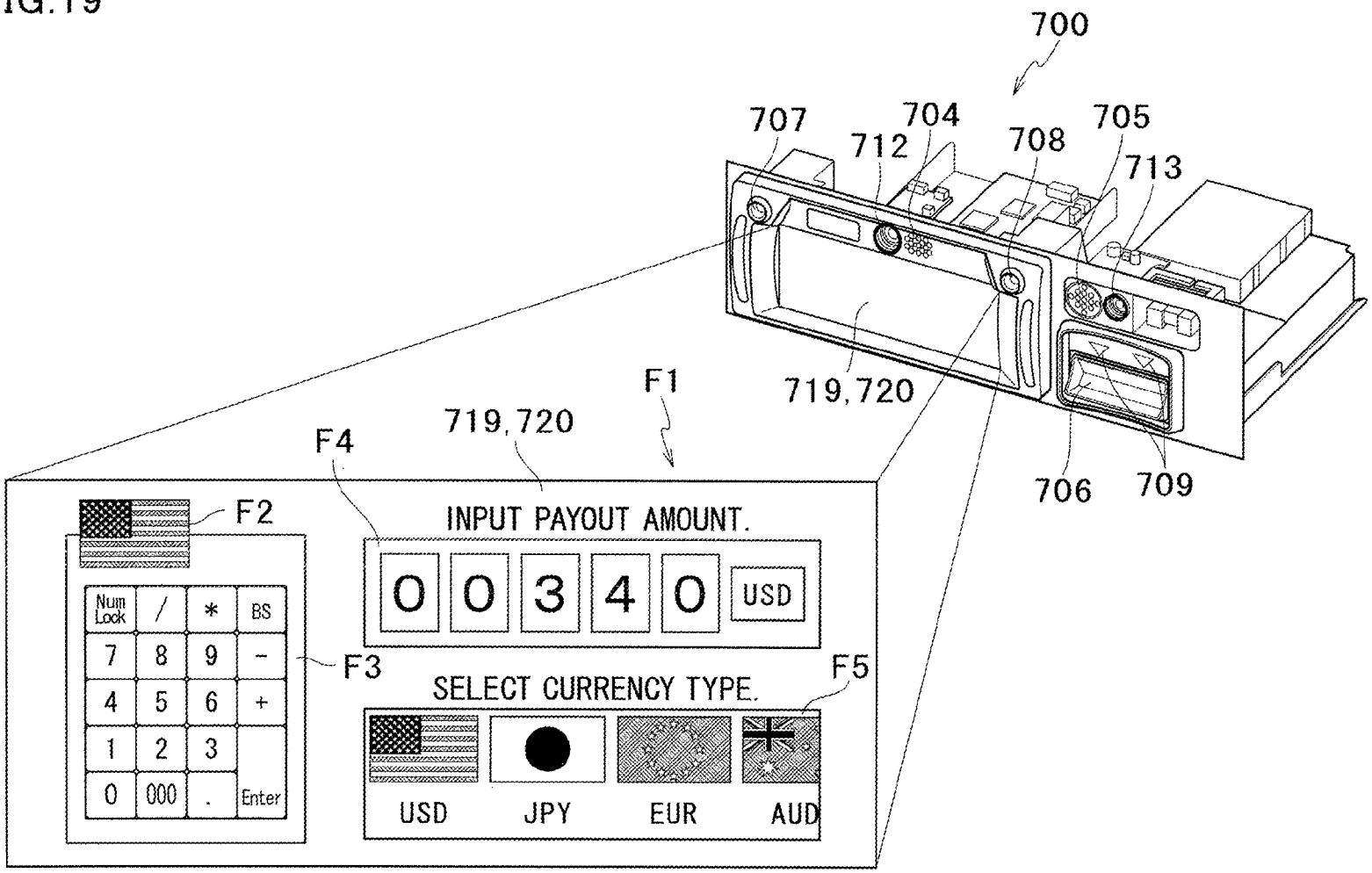
FIG. 19 illustrates a display state of a PTS terminal.

Further, between the lower image display panel 141 and the control panel 30 is the PTS terminal 700. The PTS terminal 700 has an LCD 719, as shown in FIG. 18. The LCD 719 is provided to a center portion of the PTS terminal 700. The LCD 719 displays an effect image which brings an effect into the game, for example. Furthermore, as shown in FIG. 19, the LCD 719 displays a bill payout screen F1.

Figure 17:
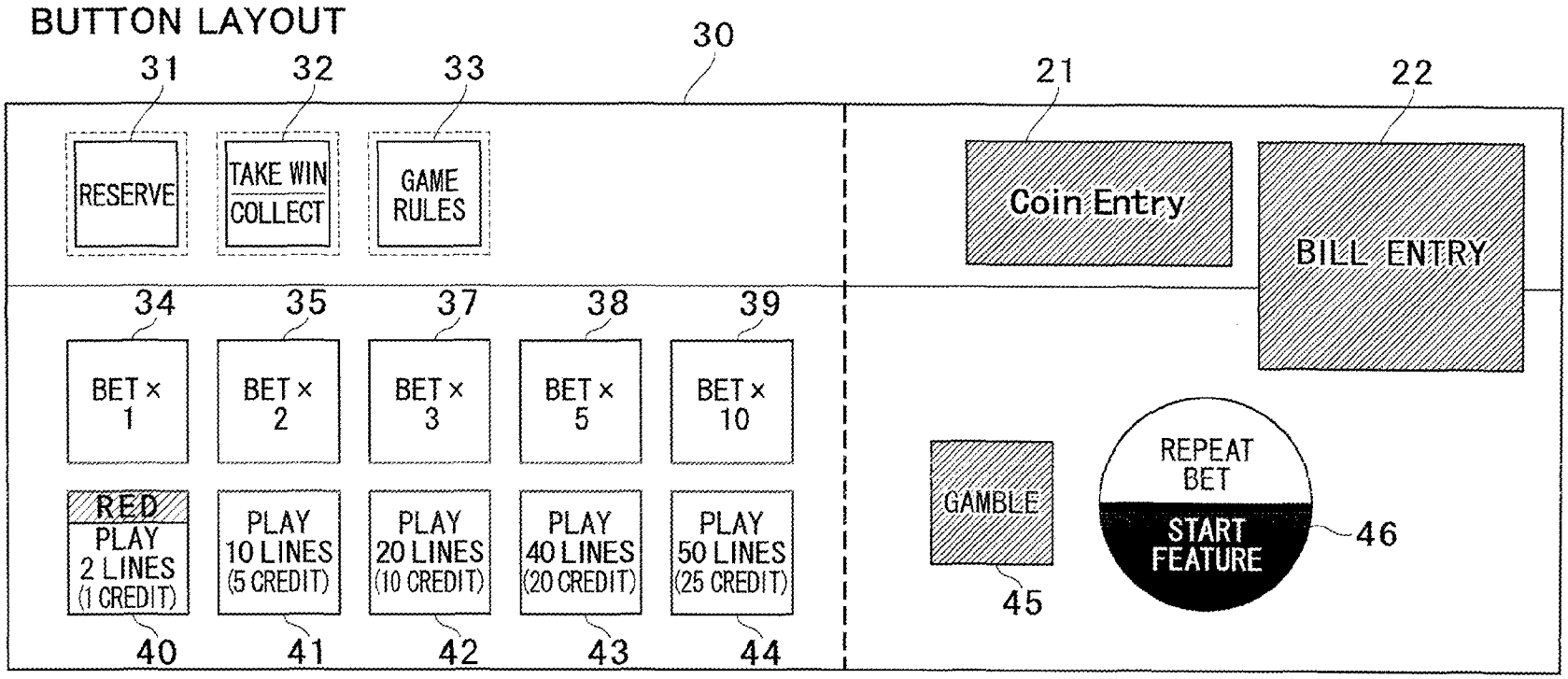
FIG. 17 is an explanatory diagram of a button layout of a control panel.

The bill payout screen F1 is displayed as an initial screen when the collect button 32 shown in FIG. 17 is pressed. The bill payout screen F1 includes a specific currency displaying portion F2, a key input portion F3, a payout amount displaying portion F3, and a currency selection portion F5. The specific currency displaying portion F2 is a region where the currency circulation zone of the currency set as the payout target is indicated by a symbol such as a national flag. The key input portion F3 is a region that allows input of numerical data and various types of key data such as data for confirming an operation and data for instructing cancellation. The payout amount displaying portion F3 includes a payout amount screen F41 configured to display numerical data input through the key input portion F3 and a currency unit screen F42 configured to display a currency unit. The currency selection portion F5 is a region where area display images such as national flags indicating the currency circulation zones of payable currencies are selectably displayed.

On the surface of the LCD 719 is provided a touch panel 720. The touch panel 720 allows the bill payout screen F1 of the LCD 719 to be recognizable from the outside, so as to allow the PTS terminal 700 to function as an externally-operable operation panel of the bill processing unit M1.

Provided to an upper portion of the PTS terminal 700 is human detection cameras 712 and 713, microphones 704 and 705, and bass reflex speakers 707 and 708.

The human detection cameras 712 and 713 detects presence of a player with the camera function thereof, and outputs a signal to a later-described unit controller 730. The microphones 704 and 705 is utilized for allowing a player to vocally participate in a game, authenticating a player through vocal authentication, and the like. The speakers 707 and 708 execute an effect through a sound, and output a notification sound when an IC card 500 is left. The speakers 707 and 708 also output a notification sound when authentication of an IC card 500 inserted fails. Note that the speakers 707 and 708 is disposed to allow a sound to reach beyond the LCD (to the player) 719 from the back of the LCD 719 through a duct. This saves space where the speakers 707 and 708 are provided.

Further, the PTS terminal 700 is provided with an LED 718 and a card insertion slot 706. The LED 718 lights up in multiple colors to report the number of IC cards 500 stored in the later-described card stacker 714. Specifically, the LED 718 lights in yellow when five or fewer IC cards 500 are left, blue when 6 to 24 IC cards 500 are left, and green when 25 or more IC cards 500 are left. Note that when no IC cards 500 is left, or 30 IC cards 500 are left, the LED 718 lights in gray and the ongoing game is halted. Thus, the LED 718 lighting in yellow enables a staff person at the casino hall to immediately determine that there are a few IC cards 500 left so that he/she can replenish IC cards 500. Meanwhile, the LED 718 lighting in green enables a staff person at the casino hall to immediately determine that the card stacker 714 is full of IC cards 500 left, so that he/she can remove some IC cards 500 therefrom. A staff person inserts his/her exclusive IC card 500 into the card insertion slot 706 when replenishing IC cards 500. On the other hand, a staff person inserts what is called a replenish card through the card insertion slot 706 to remove 10 IC cards 500 and the replenish card. Accordingly, staff persons are not required to confirm the number of IC cards 500 left in the slot machine 10 on the management server, or actually open the main door 13 of the slot machine 10 to confirm the number of IC cards 500 left. This improves the security of the casino hall.

The card insertion slot 706 has a mechanism which allows insertion and ejection of IC cards 500. An IC card 500 is inserted with a display unit 510 on its upper side and in such a manner that the IC card 500 faces the direction opposite to the card insertion slot 706. Further, the IC card 500 is completely inside the slot machine 10 while the player is playing a game. The IC card 500 is ejected in such a manner that the display unit 510 is exposed during settlement. This allows the player to confirm credit-related data such as updated cash data. Note that the IC card 500 is not required to completely stay inside the slot machine 10 while the player is playing a game. Instead, the IC card 500 may be kept in such a manner that the display unit 510 is exposed during the game. This allows the player to constantly confirm the credit being updated during the game. When the human detection cameras 712 and 713 detects absence of the player during credit settlement, the IC card 500 is drawn into the slot machine 10 and kept in the card stacker 714. This prevents such an occurrence where the IC card stays inserted into the card insertion slot 706 for a long period of time, even when a player having confirmed few credits left on the IC card 500 displayed on the display unit 510 leaves the seat with the IC card 500 purposely left inserted therein. Note that in the present embodiment, that card stacker 714 is capable of holding 30 and fewer IC cards 500.

As described above, the PTS terminal 700 of the present embodiment is configured as a unit where various devices having the microphone function, the camera function, the speaker function, the display function, and the like are put together integrally. This realizes a small space necessary for the PTS terminal 700. Accordingly, this prevents such an inconvenience which is possible with each mechanism configured as a single device, where an LCD facing the player hinders the speakers to be provided facing the player.

(Electrical Structure of Slot Machine)

Figure 20:
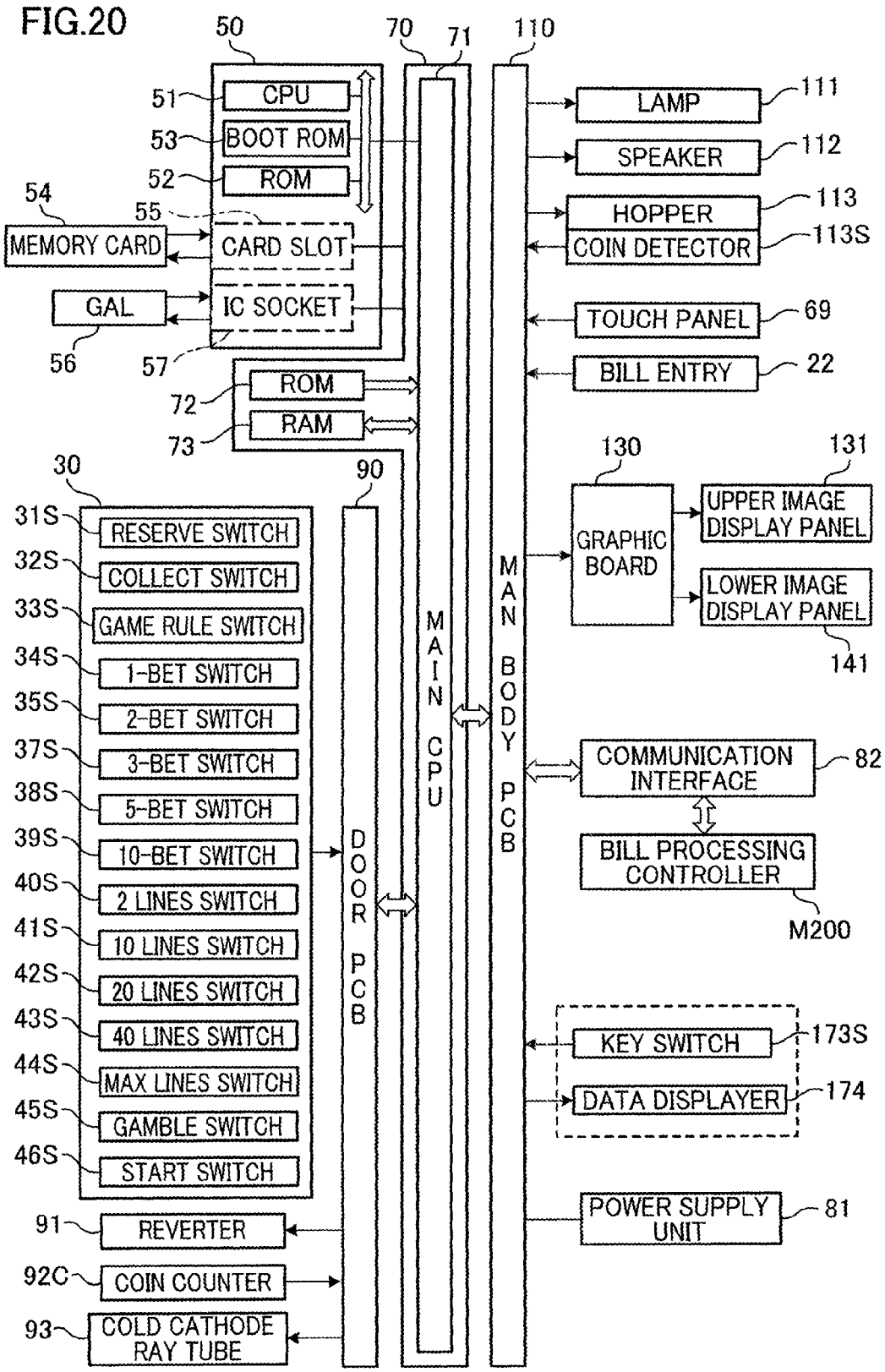
FIG. 20 is an electrical block diagram of the slot machine.

The following describes a circuitry structure of the slot machine 10, with reference to FIG. 20.

The gaming board 50 has a CPU 51, a ROM 52, a boot ROM 53 which are connected via an internal bus, a card slot 55 corresponding to the memory card 54, and an IC socket 57 corresponding to a GAL (Generic Array Logic) 56.

The memory card 54 is of a non-volatile memory, and stores therein a game program and a game system program. The game program includes a program related to progress of a game, and a program for executing an effect with an image and a sound. Further, the game program includes a symbol determination program. The symbol determination program is for determining symbols to be rearranged in the display blocks 28.

Further, the game program includes: a normal game symbol table data showing a normal game symbol table showing each symbol of each symbol column of the display blocks in association with a code number and a random number; a bonus game symbol table data showing a bonus game symbol table showing each symbol of each symbol column of the display blocks in association with a code number and a random number; symbol number determination table data showing a symbol column determination table; a code number determination table data showing a code number determination table; wild symbol increase amount determination table data showing a wild symbol increase amount determination table; trigger symbol increase amount determination table data showing a trigger symbol increase amount determination table; odds data showing the number and types of symbols to be rearranged on a payline in association with a payout amount; and the like.

Further, the card slot 55 is structured to allow insertion and ejection of a memory card 54. The card slot 55 is connected to the motherboard 70 through an IDE bus. Thus, it is possible to remove a memory card 54 from the card slot 53S, write another game program onto the memory card 54, and insert the memory card 54 back into the card slot 53S to change the type or content of a game to be run at the slot machine 10.

The GAL 56 is a type of a PLD (Programmable Logic Device) having an OR fixed array structure. The GAL 56 has input ports and output ports. When an input port receives a predetermined input, corresponding data is outputted through an output port.

Further, the IC socket 57 is structured to allow insertion/removal of the GAL 56. The IC socket 57 is connected to the motherboard 70 through a PCI bus. The content of a game to be run at the slot machine 10 can be changed by replacing a memory card 54 with another one with another program written thereon, or replacing the program written onto the memory card 54 with another program.

The CPU 51, the ROM 52, and the boot ROM 53 connected to each other through internal buses are connected to the motherboard 70 through a PCI bus. The PCI bus transmits signals between the motherboard 70 and the gaming board 50, and supplies power from the motherboard 70 to the gaming board 50.

The ROM 52 stores an authentication program. The boot ROM 53 stores a pre-authentication program, a program (boot code) for the CPU 51 to boot the auxiliary authentication program, and the like.

The authentication program is for authenticating a game program and a game system program (falsification check program). The pre-authentication program is for authenticating the authentication program. The authentication program and the pre-authentication program is described along procedures for authenticating (authentication procedure) that program to be authenticated is not falsified.

The motherboard 70 is constituted with a motherboard for market use (printed circuit board with fundamental parts of a personal computer built thereon), and includes a main CPU 71, a ROM (Read Only Memory) 72, a RAM (Random Access Memory) 73, and a communication interface 82. Note that the motherboard 70 corresponds to the game controller 100 of the present embodiment.

The ROM 72 is made of a memory device such as a flash memory. The ROM 72 stores therein a program such as a BIOS (Basic Input Output System) run by the main CPU 71, and permanent data. When the main CPU 71 runs the BIOS, predetermined peripheral devices are initialized. Further, the game program and the game system program stored in the memory card 54 are installed via the gaming board 50. Note that, in the present invention, the ROM 72 may be rewritable or non-rewritable.

The RAM 73 stores data utilized when the main CPU 71 operates, program such as a symbol determination program, and the like. For example, the game program, game system program, and authentication program are stored in the RAM 73 after the programs are installed. Further, the RAM 73 is provided with an operation region for executing the above programs. Examples of the operation region is a region for storing a counter which manages a game count, a bet amount, a payout amount, and a credit amount, and a region for storing a symbol determined by a lottery (code number).

The communication interface 82 is for communicating with the external controller 621 such as a server and the bill processing unit M1, through the communication line 301. Further, the motherboard 70 is connected to a later-described door PCB (Printed Circuit Board) 90 and the main body PCB 110 via USBs. The motherboard 70 is connected to a power supply unit 81. Further, the motherboard 70 is connected to the PTS terminal 700 via a USB.

When power is supplied from the power supply unit 81 to the motherboard 70, the main CPU 71 of the motherboard 70 is booted, and power is supplied to the gaming board 50 via the PCI bus and the CPU 51 is booted.

The door PCB 90 and the main body PCB 110 are connected to an input device such as a switch and a sensor, and peripheral devices whose operations are controlled by the main CPU 71.

The door PCB 90 is connected to the control panel 30, a reverter 91, a coin counter 92C and a cold cathode tube 93.

The control panel 30 is provided with a reserve switch 31S, a collect switch 32S, a game rule switch 33S, a 1-bet switch 34S, a 2-bet switch 35S, a 3-bet switch 37S, a 5-bet switch 38S, a 10-bet switch 39S, a play 2 lines switch 40S, a play 10 lines switch 41S, a play 20 lines switch 42S, a play 40 lines switch 43S, a max lines switch 44S, a gamble switch 45S, and a start switch 46S, respectively corresponding to the buttons described above. Each switch detects that the corresponding button is pushed by a player, and outputs a signal to the main CPU 71.

Inside the coin entry 36 is provided with the reverter 91 and the coin counter 92C. The reverter 91 detects validity of a coin inserted into the coin entry 21, and discharges those other than genuine coins through a coin payout exit. Further, a coin counter 92C detects genuine coins accepted, and counts the numbers thereof.

The reverter 91 operates based on a control signal outputted from the main CPU 71, and distributes genuine coins determined by the coin counter 92C into a hopper 113 or a not-shown cash box. When the hopper 113 is not full of coins, a valid coin is distributed there. On the other hand, when the hopper 113 is filled with coins, a valid coin is distributed into the cash box.

The cold cathode tube 93 functions as a backlight provided at a back of the upper image display panel 131 and the lower image display panel 141. The cold cathode tube 93 lights based on a control signal from the main CPU 71.

The main body PCB 110 is connected to the lamp 111, the speaker 112, the hopper 113, the coin detection unit 113S, the touch panel 69, the bill entry 22, the graphic board 130, the key switch 173S, and the data displayer 174.

The lamp 111 lights based on a control signal outputted from the main CPU 71. The speaker 112 outputs a sound such as background music, based on a control signal outputted from the main CPU 71.

The hopper 113 operates based on a control signal outputted from the main CPU 71, and pays out the number of coins determined to be paid out to a not-shown coin tray through the coin payout exit. The coin detection unit 113S detects a coin to be paid out from the hopper 113, and outputs a signal to the main CPU 71.

The touch panel 69 detects a position touched on the lower image display panel 141 by a player with a finger, and outputs a signal corresponding to the position detected to the main CPU 71.

The bill entry 22 is for detecting validity of bills T and accepts genuine bills T into the cabinet 11. The bills T accepted into the cabinet 11 is converted into coins, and credits corresponding to the number of coins calculated are added as credits that the player has.

The graphic board 130 controls display of an image to be displayed on the upper image display panel 131 and the lower image display panel 141, based on a control signal outputted from the main CPU 71. The graphic board 130 has a VDP (Video Display Processor) which generates image data, a video RAM which stores the image data generated by the VDP, and the like. Note that the image data utilized when image data is generated by the VDP is included in a game program read out from the memory card 54 and stored in the RAM 73.

Further, the graphic board 130 is provided with a VDP (Video Display Processor) for generating image data on the basis of a control signal from the main CPU 71, a video RAM for temporarily storing the image data generated by the VDP, and the like. Note that the image data utilized when image data is generated by the VDP is included in a game program read out from the memory card 54 and stored in the RAM 73.

The key switch 173S is provided to the keypad 173. The key switch 173 outputs a predetermined signal to the main CPU 71 when the player operates the keypad 173.

Based on a control signal output from the main CPU 71, the data displayer 174 displays data read by the card reader 172, or data input through the keypad 173 by the player.

(Electrical Structure of PTS Terminal)

Figure 21:
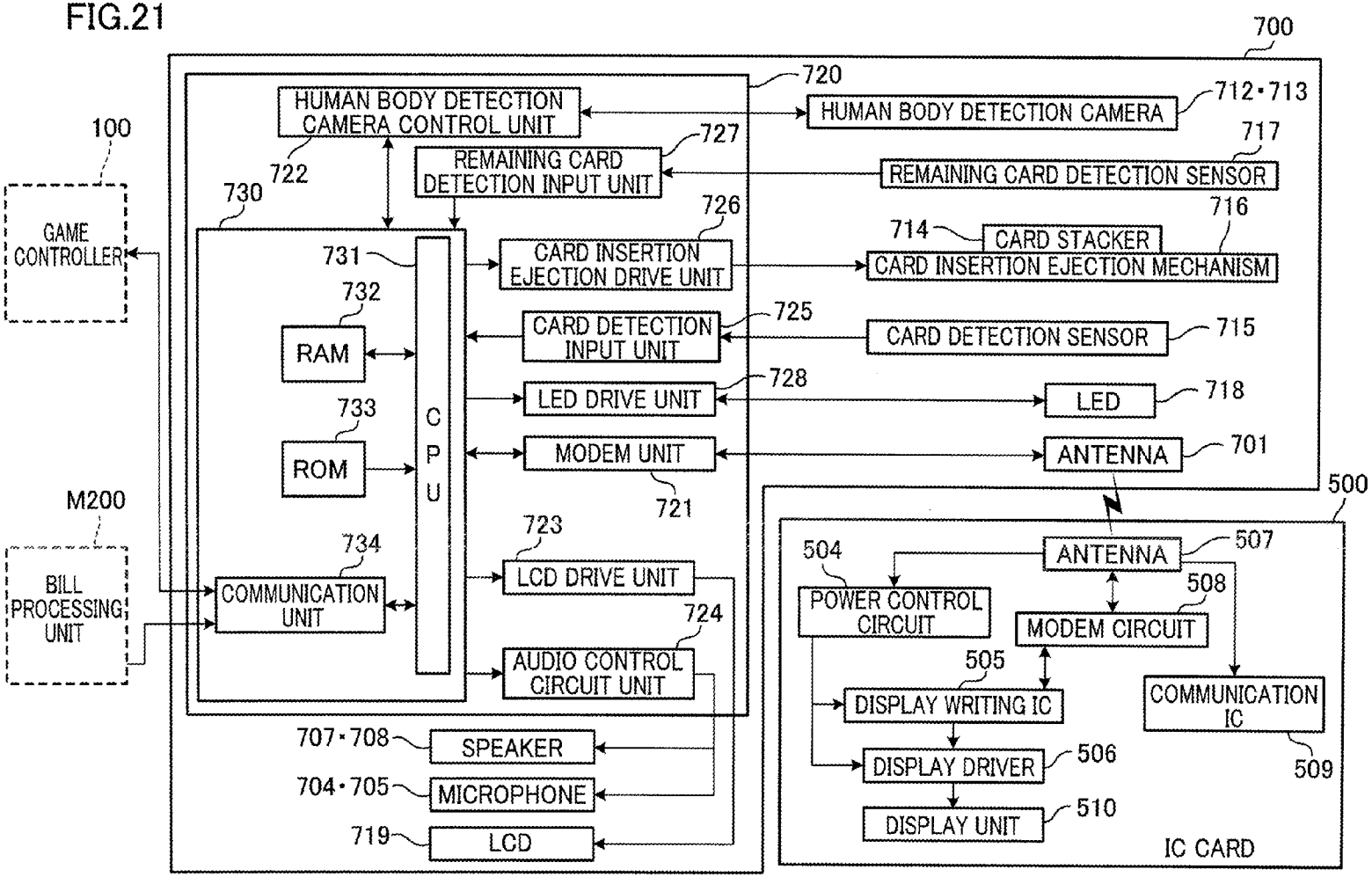
FIG. 21 is an electrical block diagram of a PTS terminal.

The following describes a structure of a circuitry provided to the PTS terminal 700, with reference to FIG. 21.

A PTS controller 720 which controls the PTS terminal 700 is connected to various functional parts as a unit controller 730 its main part. The PTS controller 720 has a CPU 731, a communication unit 734, a ROM 733, and a RAM 732.

The CPU 731 runs various programs stored in the later-described ROM 733, executes calculation, and the like. Specifically, the CPU 731 runs a credit update program and converts credit data retrieved from the game controller 100 into cash data, adds the cash data to broken number cash data in the management server 800, and transmits the data to the IC card 500.

Further, the CPU 731 runs a human body detection operation program. When the credit amount based on the credit data retrieved by the game controller 100 does not equal to "0," the CPU 731 determines whether to accept the IC card 500 into the card stacker 714, with the human detection cameras 712 and 713.

Further, the CPU 731 runs the authentication program to cross verify an identification code on the IC card 500 and the identification code in the management server 800.

Further, the CPU 731 runs an audio control program to control a later-described audio control circuit unit 724 based on a result of the authentication. The audio control here refers to such a control where in the case of authentication failure, the CPU 731 controls the audio control circuit unit 724 and reports authentication failure through the speakers 707 and 708. The communication unit 734 enables communication with the game controller 100 and the bill processing controller M200.

Further, the CPU 731 runs a device program to control operations of the LCD 719, the microphones 704 and 705, and the speakers 707 and 708. The CPU 731 runs the LED control program to cause the LED 718 to light in accordance with the remaining number of IC cards 500.

The ROM 733 is made of a memory device such as a flash memory. The ROM 733 stores therein permanent data to be executed by the CPU 731. For example, the ROM 733 stores therein a credit update program which re-writes credit data stored on the IC card 500 on the basis of an instruction from the game controller 100, a human body detection operation program, an authentication program, an audio control program, a device program, and an LED control program.

The RAM 732 temporarily stores therein data necessary for running the various programs stored in the ROM 733. For example, the RAM 732 stores credit data to be updated, based on a signal from the game controller 100. Further, the RAM 732 stores the time that a player is detected with the human detection cameras 712 and 713, and the period of time which is counted from the point that the player is detected.

Further, the unit controller 730 is connected to a human detection camera control unit 722, an LCD drive unit 723, an audio control circuit unit 724, a remaining card detection input unit 727, a card insertion ejection drive unit 726, a card detection input unit 725, an LED drive unit 728, and a modulator-demodulator unit 721.

The human detection camera control unit 722 controls the operations of the human detection cameras 712 and 713, on the basis of an instruction from the unit controller 730.

The LCD drive unit 723 controls operations of the LCD 719, on the basis of an instruction from the unit controller 730.

The audio control circuit unit 724 controls operations of the microphones 704 and 705, and the speakers 707 and 708, on the basis of an instruction from the unit controller 730.

The remaining card detection input unit 727 inputs to the unit controller 730 a signal for determining the remaining number of IC cards 500 stacked in the card stacker 714 determined by the remaining card detection sensor 717. Here, the remaining card detection sensor 717 has a function of detecting the remaining number of IC cards 500 stacked in the card stacker 714, with a not-shown infrared detection mechanism or the like, for example.

The card insertion ejection drive unit 726 controls operations of the card insertion ejection mechanism 716, on the basis of an instruction from the unit controller 730. Here, the card insertion ejection mechanism 716 has a mechanism for receiving an IC card 500 inside, and a mechanism for ejecting the IC card 500 to outside.

The card detection input unit 725 is for inputting a signal from the card detection sensor 715 to the unit controller 730. Here, the card detection sensor 715 obtains various types of data such as cash data and an identification code, from the inserted IC card 500.

The LED drive unit 728 controls operations of the LED 718 on the basis of an instruction from the unit controller 730, to light the LED 718.

The modulator-demodulator unit 721 converts a high frequency signal from the antenna 701 to a signal controllable by the unit controller 730, and converts a signal from the unit controller 730 to a signal transmittable to the IC card 500 through the antenna 701.

Note that the unit controller 730, the card insertion ejection drive unit 726, the card detection input unit 725, and the modulator-demodulator unit 721 are also referred to as a card unit controller as a unit.

(Electrical Structure of IC Card)

Figure 22:
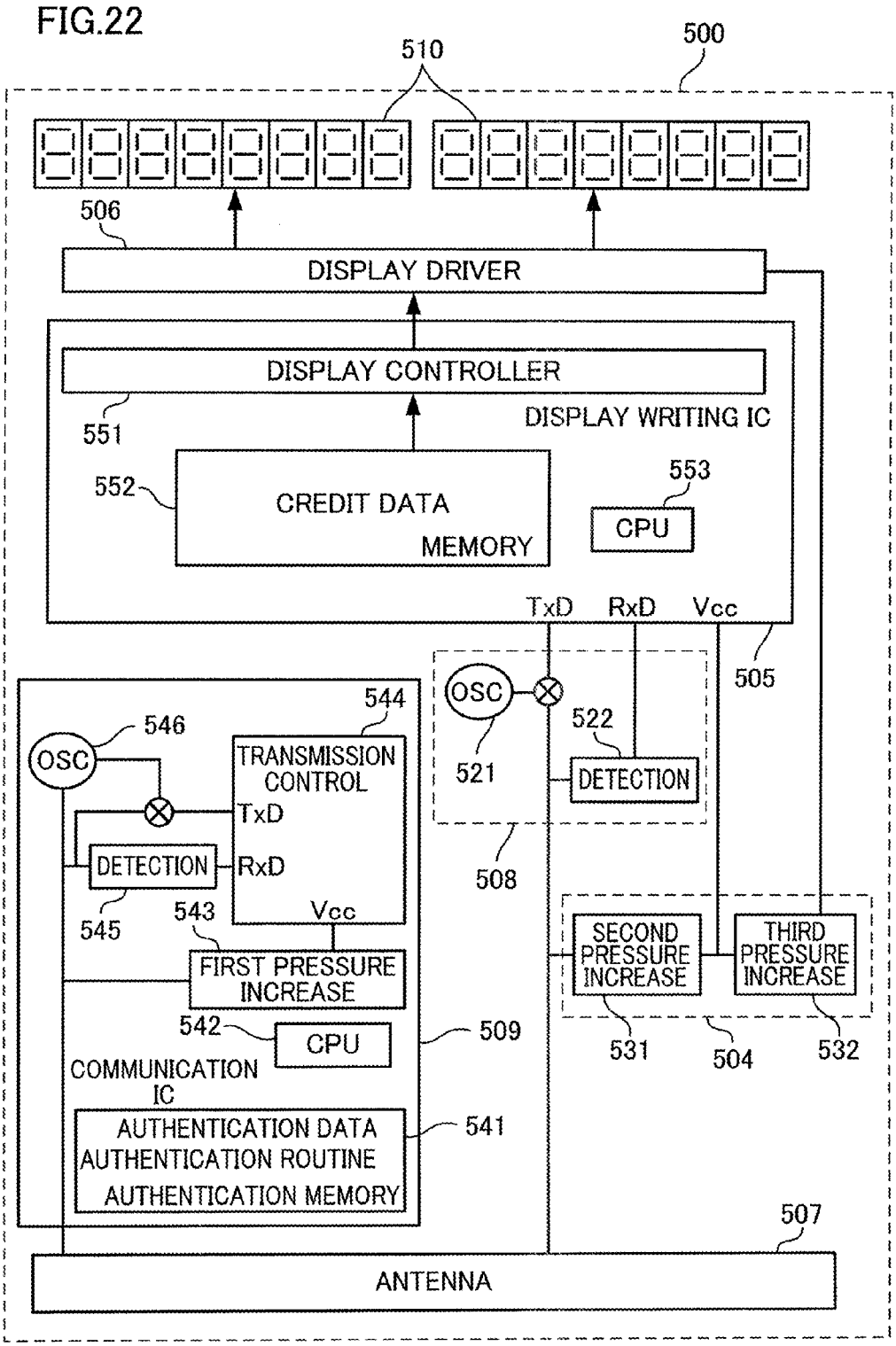
FIG. 22 is an electrical block diagram of an IC card.

The following describes a circuit of the IC card 500, with reference to FIGS. 21 and 22.

The IC card 500 has an antenna 507, a power control circuit 504, a modulator-demodulator circuit 508, a display writing IC 505, a display driver 506, and a display portion 510.

The antenna 507 transmits and receives various signals which belong to the PTS terminal 700, via the antenna 701.

The power control circuit 504 has a second voltage increase circuit 531 and a third voltage increase circuit 532. The second voltage increase circuit 531 raises the voltage of a signal from the antenna 507 to a voltage that the later-described modem circuit 508 can handle. The third voltage increase circuit 532 raises the voltage to a voltage with which the later-described display driver 506 can be driven.

The modem circuit 508 has a transmitter 521 and a detection circuit 522. The transmitter 521 outputs a signal having a specific frequency, and converts the signal to a signal which the later-described display writing IC 505 can handle, by mixing the signal with a signal received from the antenna 507. The detection circuit 522 detects a signal received from the antenna 507.

The display writing IC 505 has a CPU 553, a credit data memory 552, and a display controller 551.

The CPU 553 runs a cash data rewrite and update program to rewrite and update cash data stored in the credit data memory 552, based on cash data retrieved from the PTS terminal 700.

Further, the CPU 553 controls the display controller 551 so as to cause the display controller 551 to use the cash data stored in the credit data memory 552 as data for displaying cash data, and to display the cash data on the display portion 510 through the later-described display driver 506.

The credit data memory 552 stores therein the cash data rewrite and update program, and credit-related data such as cash data, an identification code and cash data for display. Note that the credit-related data stored in the credit data memory 552 is also utilized for calculation and display.

The display controller 551, based on a control signal from the CPU 553, retrieves credit data for display stored in the credit data memory 552, and displays it on the display portion 510 via the display driver 506.

The IC card 500 has a communication IC 509. The communication IC 509 has a first voltage increase circuit 543, a transmitter 546, a detection circuit 545, a transmission control unit 544, a CPU 542, and an authentication memory 541. The first voltage increase circuit 543 increases the voltage of terminal-side authentication data retrieved from the PTS terminal 700 to a voltage that the CPU 542 can handle.

The transmitter 546 outputs a signal having a specific frequency, and converts it to a signal that the CPU 542 can handle, by mixing the signal with a signal received from the antenna 507. The detection circuit 522 detects a signal received from the antenna 507.

The CPU 542 runs an authentication routine program and transmits an identification code stored in a later-described authentication memory 541 to the PTS terminal 700, when an authentication request is issued by the PTS terminal 700. The authentication memory 541 stores therein an authentication routine program used by the CPU 542 and an identification code.

(Symbols, Combinations, and the Like)

The symbols 301 displayed in the display windows 7A to 7E of the slot machine 10 forms symbol columns, each of which having twenty-two symbols. As shown in FIG. 23, one of code numbers 0 to 21 is assigned to each of the symbols constituting each column. Each of the symbol columns is constituted with a combination of symbols of "JACKPOT 7," "BLUE 7," "BELL," "CHERRY," "STRAWBERRY," "PLUM," "ORANGE," and "APPLE."

Three successive symbols in each of the symbol columns are respectively displayed (arranged) on an upper stage 7*a*, a middle stage 7*b*, and a lower stage 7*c* of each of the display windows 7A, 7B, 7C, 7D, and 7E, to forma symbol matrix of five columns and three rows. When the start button is pressed to start a game after the bet button is pressed, the symbols forming a symbol matrix start scrolling. This scrolling of the symbols stops (rearrangement) after a predetermined period from the beginning of the scrolling (rearrange).

Various kinds of winning combinations are set in advance for each symbol. A winning combination is a combination of stopped symbols on the payline which puts the player in an advantageous state. Examples of an advantageous state include: a state where coins according to a winning combination is paid out, a state where the number of coins to be paid out is added to a credit, a state where a bonus game is started.

For example, a combination on the payline including an "APPLE" symbol serves as a bonus trigger which causes a transition of a gaming mode from a basic game to a bonus game. Further, when a combination including a "CHERRY" symbol is formed on the payline in a basic game, twenty coins (values) are paid out for one bet. When a combination including a "PLUM" symbol is formed on the payline in a basic game, five coins are paid out for one bet.

Here, a bonus game is a gaming state which provides a larger advantage than a basic game. Note that another bonus game may be employed in combination, provided that the other bonus game is advantageous to a player, i.e., the other bonus game is more advantageous than a basic game. For example, a bonus game may be a state where more coins are possibly obtained than the basic game, a state where the probability of obtaining coins is higher than in the basic game, a state where fewer coins are consumed than the basic game, free game, or the like.

(Payout Control Table)

FIG. 24 is a payout control table which controls a payout awarded in accordance to a winning combination. The payout control table is stored in the ROM 242 of the main control board 71, and a piece of information of a payout is assigned to a type of winning combination. For example, a payout for a winning combination including a "BELL" symbol is "10." A payout for a winning combination including a "BLUE 7" is "40." Note that payouts for a basic game and a free game are set to be the same in the present embodiment.

(Free Game Quantity Table)

FIG. 25 is a table referred to when determining the number of free games to be played for the number of points acquired in a common game of a basic game. The points awarded in a common game correspond to the number of free games to be played in the free game quantity table. For example, when the total number of accumulated points is 4, the free games are run 80 times. When the total number of accumulated points is 8, the free games are run 160 times. Thus, by succeeding in a common game in a basic game and acquiring many points, it is possible to continue a free game for a long period of time.

(Display State of Slot Game)

The following specifically describes a display state of the lower image display panel 141 while the slot machine 10 is in operation.

FIG. 26 shows an example of a normal game screen which is a display screen showing a normal game displayed on the lower image display panel 141.

More specifically, the normal game screen is arranged in a center portion of the symbol display device 16, and includes: the display window 150 having the five simulated reels 151 to 155, and the payline occurrence parts 65L and 65R which are arranged on both sides of the display window 150 and symmetrical with respect to the display window 150.

Above the display window 150 are: the credit amount display unit 400, a broken number cash display unit 403, the bet amount display unit 401, a wild symbol count display unit 415, a trigger symbol count display unit 416, and the payout display unit 402. These units 400, 401, 415, 416, and 402 are sequentially arranged in this order from the left side to the right side when viewed from a player.

The credit amount display unit 400 displays a credit amount. The broken number cash display unit 403 displays a fractional amount of cash. The bet amount display unit 401 displays a bet amount placed on the current unit game. The wild symbol count display unit 415 displays the number of wild symbols 503*a* in a unit game in progress. With this, it is possible to notify the player in advance that there are five wild symbols 503*a* in the normal game. The trigger symbol count display unit 416 displays the number of trigger symbols 503*b* in a unit game in progress. The trigger symbol count display unit 416 displays the number of trigger symbols 503*b* in a normal game in progress. The payout display unit 402 displays the number of coins to be paid out when a winning combination is achieved.

Blow the display window 150 are: a help button 410; a pay-table button 411; a bet unit display unit 412; a stock display unit 413; and a free game count display unit 414. These units 410, 411, 412, 413, and 414 are sequentially arranged in this order from the left side to the right side when viewed from a player.

The help button 410, when pressed by a player, activates a help mode. The help mode provides a player with information to solve his/her problem regarding the game. The pay-table button 411, when pressed by a player, activates a payout display mode in which an amount of payout is displayed. The payout display mode displays to the player a guidance screen indicating relation of a winning combination to the payout rate.

The bet unit display unit 412 displays a bet unit (payout unit) at the current point. With the bet unit display unit 412, the player is able to know that, for example, he/she is allowed to participate in a game with a bet by an increment of one cent.

The stock display unit 413 displays a bonus game carry-over number. Here, the "bonus game carry-over number" means the remaining number of bonus games runnable subsequently to an end of the currently-run bonus game. That is, when the stock display unit 413 displays "3," three more bonus games are consecutively runnable after the currently-run bonus game. Note that the stock display unit 413 displays the number "0" in the normal game.

The free game count display unit 414 displays the total number of times the bonus game is to be repeated, and how many times the bonus game has been repeated. In other words, when the free game count display unit 414 displays "0 OF 0," the total number of times free games are to be repeated ("free game total number") is 0, that is, the game in progress is not a bonus game. Further, when the free game count display unit 414 displays "5 OF 8," during the bonus game, the free game total number is eight, and the current game in progress is the fifth free game.

(Operation of Setting Bill Processing Unit M1)

The following will describe a case where the slot machine 10 having the bill processing unit M1 is installed in a predetermined currency circulation zone, on the premise of the arrangements above.

To being with, as shown in FIG. 5, the sizes of bills T in the currency circulation zone in which the slot machine 10 is installed are specified. The frequency of use and the type of use are estimated for each type of the bill T, and the size (stored height) corresponding to the maximum number of bills stored in the bill case M300 is determined. For example, for frequently-used bills T, a bill case M300 sized (i.e., having a stored height) as large as plural stages is selected.

Subsequently, for each selected bill case M300, the longitudinal and crosswise sizes of bills T to be stored are specified. As shown in FIG. 6, as the longitudinal size of the bill T is specified, the attaching position of the first partition plate M302 is adjusted so that the bill T stops at a predetermined position in the import direction A when the bill T is imported into the bill case M300. In the meanwhile, as the crosswise size of the bill T is specified, the opposing distance between the second partition plates M307 is adjusted so that the bill T stops at the central position in the width direction orthogonal to the import direction A. In this connection, as shown in FIG. 6, the second partition plates M307 move in a line symmetrical manner about the center line O by the second partition plate supporting mechanism M308 in the width direction. For this reason, when one of the second partition plate M307 is moved, the other one of the second partition plate M307 is moved in the opposite direction for the same distance. As such, the second partition plates M307 are easily positioned.

After the setting of the bill cases M300 is completed as above, the bill cases M300 are attached to the storing frame M100A. Subsequently, the storage state of each bill case M300 is set by means of an unillustrated input terminal, the PTS terminal 700, or the like. That is to say, as shown in FIG. 10, for the bill cases M300 attached to the storing frame M100A, the storage stages are serially set from the uppermost stage to the lowermost stage, and the transportation function, the bill type, and the maximum number of stored bills are set. In the meanwhile, in case of a bill case M300 dedicated for storing bills, the maximum number of stored bills T is set in advance. When the bills T are stored irrespective of the types, "0" is stored in the bill type field.

With this, for example, initial data is written to indicate that the bill case M300 of the first stage is used for importing and exporting bills T and up to 1000 ten-dollar bills can be stored. In the meanwhile, initial data is written to indicate that the bill case M300 of the fourth stage is dedicated to the import of bills T, and up to 300 ten-thousand-yen bills can be stored.

As such, it is possible in the bill processing unit M1 to change the device specifications in accordance with bills T of currency circulation zones by simply changing the device specifications such that the bill cases M300 are selected in consideration of the frequency of use and the storing capacity of bills T so that a large-capacity bill case M300 is selected for bills T of a frequently-used currency circulation zone whereas a small-capacity bill case M300 is selected for bills T of a less-frequency-used currency circulation zone. Therefore in the bill processing unit M1 the frequency of the replacement of the bill cases M300 and the collection of the bills T which are required when each bill case M300 is fully filled with the bills T is restrained, and hence the availability of the slot machine 10 is improved.

(Process Operation of Slot Machine 10: Boot Process)

The following describes a boot process taking place in the slot machine 1.

Figure 30:
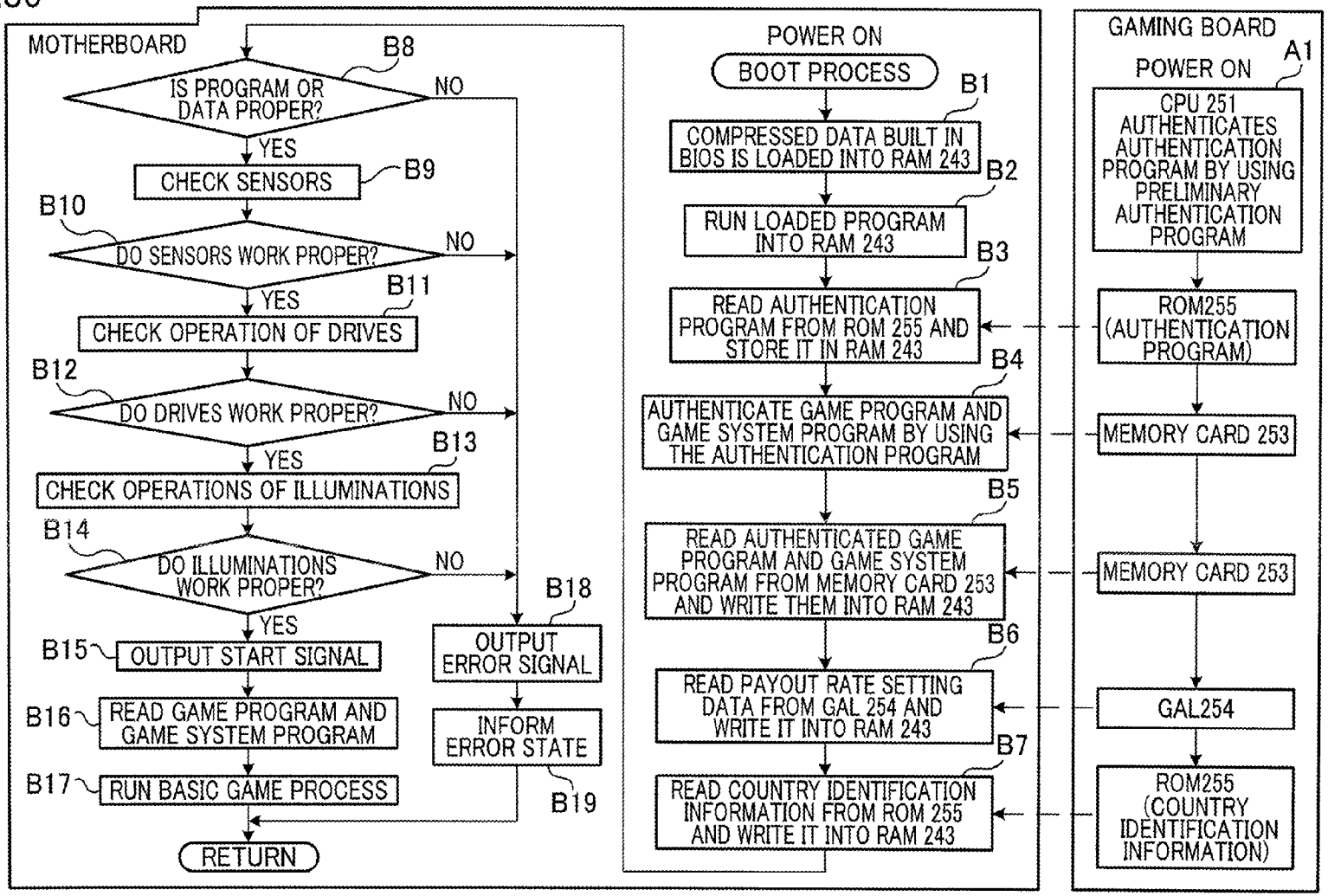
FIG. 30 is a flowchart of a boot process routine.

When power is supplied to the slot machine 10, a boot process routine shown in FIG. 30 takes place in the motherboard 240 and the gaming board 250. In the present embodiment, a memory card is inserted into the card slot 253S of the gaming board 250, and the GAL 254 is attached to the IC socket 254S.

First, when a power switch is turned on (power is supplied) in the power supply unit 245, the motherboard 240 and the gaming board 250 are booted. When the motherboard 240 and the gaming board 250 are booted, different processes are respectively carried out in parallel. That is, in the gaming board 250, the CPU 251 carries out processes of reading a preliminary authentication program stored in the boot ROM 252, and carrying out preliminary authentication by the preliminary authentication program. Note that the preliminary authentication is a process in which the preliminary authentication program is run to confirm and verify that authentication program is not modified in advance before importing the program into the motherboard 240 (A1).

Meanwhile, in the motherboard 240, the main CPU 241 runs BIOS stored in the ROM 242. As a result, the compressed data built in the BIOS is loaded into the RAM 243 (B1). Then, the main CPU 241 runs the BIOS loaded into the RAM 243, and diagnoses and initializes various kinds of peripheral devices (B2).

Afterwards, the main CPU 241 reads, via PCI bus, the authentication program stored in the ROM 255, and stores the read authentication program to the RAM 243 (B3). During this step, the main CPU 241 drives a checksum through an ADDSUM method (a standard check function) which is adopted in standard BIOS. Thus, it is confirmed whether or not the authentication program is stored in the RAM 243 without an error.

The main CPU 241 then confirms a component connected to the IDE bus. Then, the main CPU 241 accesses to the memory card 253 inserted into the card slot 253S via the IDE bus, to read the game program and the game system program from the memory card 253. In this case, data constituting the game program and the game system program are read in units of four bytes. Then, the main CPU 241 confirms and verifies, according to the authentication program stored in the RAM 243, that the read game program and the game system program are not falsified (B4).

When the authentication process ends properly, the main CPU 241 writes and stores the authenticated game program and the game system program in the RAM 243 (B5).

The main CPU 241 then accesses to the GAL 254 attached to the IC socket 254S to read payout rate setting data from the GAL 254, and stores the data in the RAM 243 (B6). Afterwards, the main CPU 241 reads the country identification information stored in the ROM 255 of the gaming board 250, and stores the information to the RAM 243 (B7).

With a result of the above authentication process, the main CPU 241 determines whether the program or data is proper (B8). When the program or data is not proper (B8, NO), an error signal including ID information to specify a slot machine 10 is output to a centralized control device (not shown). The centralized control device specifies a slot machine 10 in an error state based on the error signal. The centralized control device then instructs a staff person standing by near the slot machine 10 to deal with the error, and stores an error history information containing a date and time and a place when/where the error has occurred, or the like (B18). Then, the error state is informed in the form of an audio output from the speaker 23 of the slot machine 10, and in the form of light emitted from the light emitting portion 20. Afterwards, the routine in the motherboard 240 ends.

On the other hand, when the program or data is proper (B8, YES), operations of sensors disposed to the slot machine 10 are checked successively (B9). Then, whether or not all the sensors operate properly is determined (B10). When an error is detected in at least one sensor (B10, NO), the above mentioned B18 and B19 are carried out, and the routine ends thereafter.

On the other hand, when all the sensors operate properly (B10, Yes), operations of all drive mechanisms are checked successively (B11). Then, it is determined whether or not all the drive mechanisms operate properly (B12). When an error is detected in at least one driving mechanism (B12, NO), the above mentioned B18 and B19 are carried out, and the routine ends thereafter. On the other hand, when all the drive mechanisms operate properly (B12, Yes), operations of all illuminations are checked successively (B13). Then, it is determined whether or not all the illuminations operate properly (B14). Then, it is determined whether or not all the illuminations operate properly (B14). When an error is detected in at least one illumination (B14, No), the above mentioned B18 and B19 are carried out, and the routine ends thereafter.

On the other hand, when all the illuminations operate properly (B14, Yes), a boot signal indicating that all the illuminations have been booted properly is output to the centralized control device (not shown) or the like (B15). Afterwards, a basic game process is carried out (B16), and this routine ends. The following describes a basic game process in detail.

(Basic Game Process)

Figure 31:
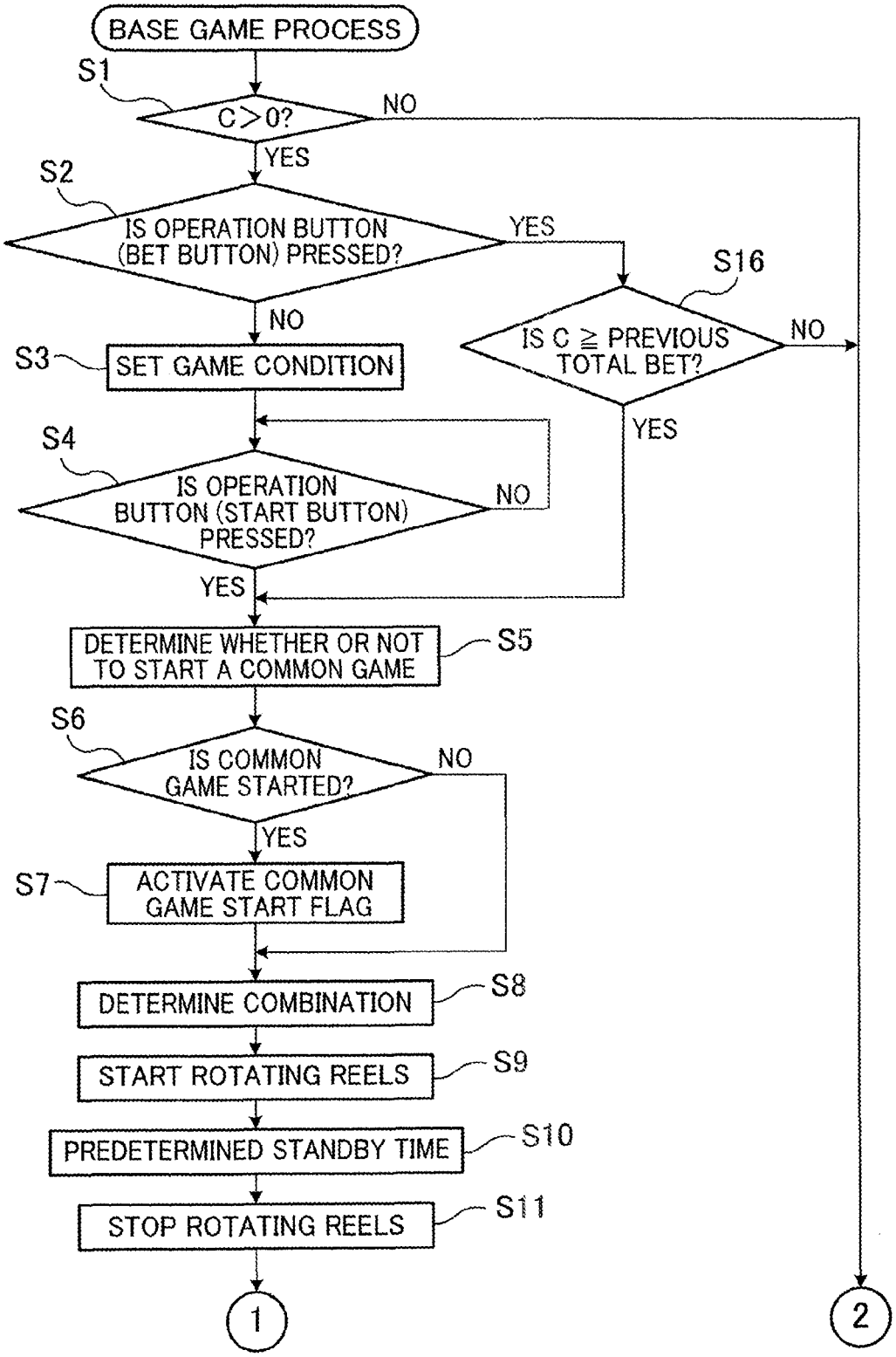
FIG. 31 is a flowchart of a base game process routine.
Figure 32:
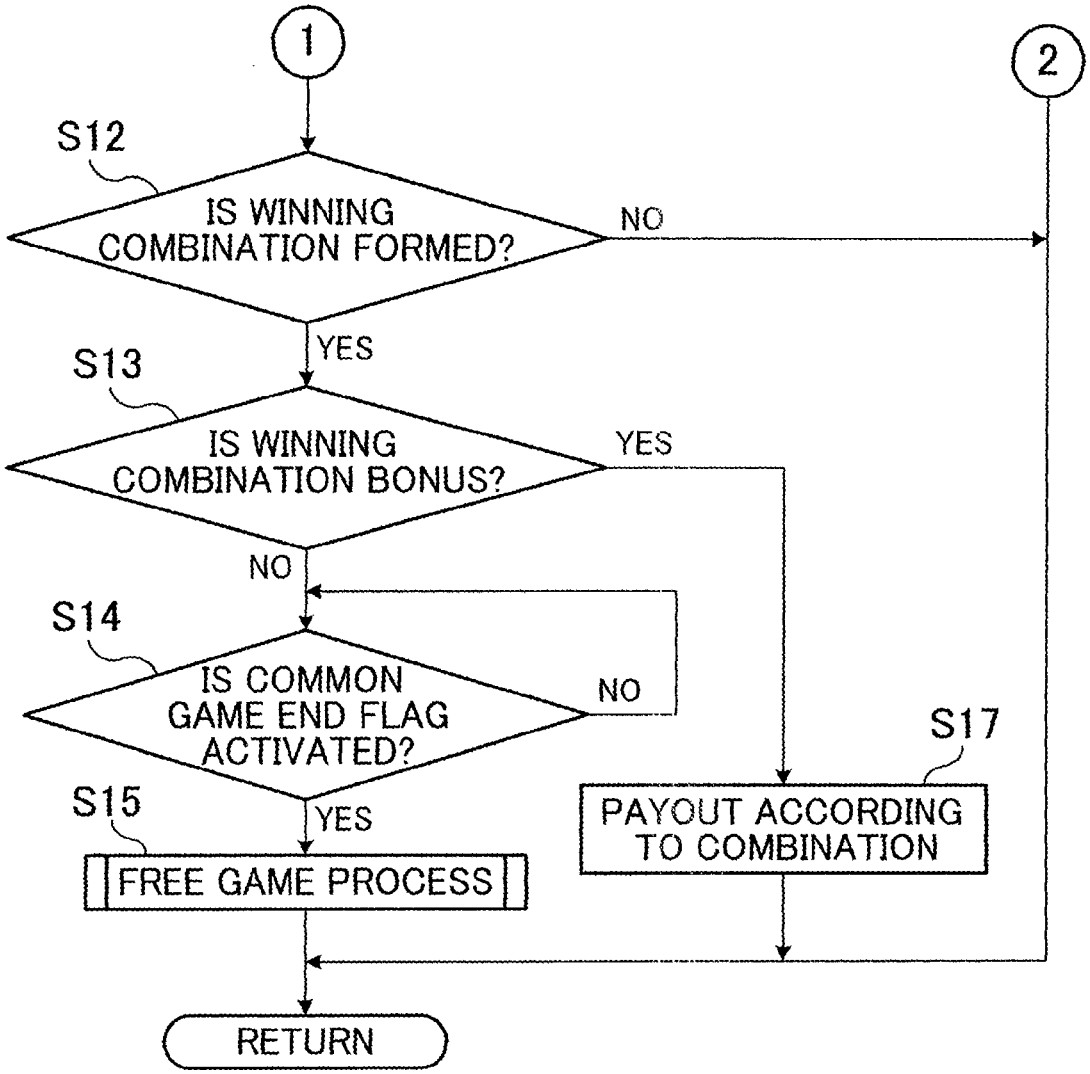
FIG. 32 is a flowchart of a base game process routine.

FIGS. 31 and 32 are flowcharts showing a process carried out by the main CPU 241 of the slot machine 10 during a basic game of the slot machine 10. A unit game includes a routine shown in FIGS. 31 and 32. Note that the slot machine 10 is booted in advance, and a variable used in the main CPU 241 on the game controller 1 side is initialized at a predetermined value. Accordingly, the slot machine 10 is constantly operated.

First, it is determined if there is a remaining credit, i.e., the remaining number of coins having been inserted by the player (S1). Specifically, a credit amount C stored in the RAM 243 is read, and a process according to the read credit amount C is carried out. When the credit amount C is zero (S1, NO), the routine ends without any operation of a process since a game cannot be started. Meanwhile, when the credit amount C is equal to or more than one (S1, Yes), it is determined that there is at least one credit remaining and the process moves to S2.

In S2, it is determined whether or not the operation button 11 (bet button) is pressed (S2). When the operation button 11 (bet button) is not pressed for a predetermined time (S2, NO), a game condition is set (S3). Specifically, the number of coins to be bet on the payline in the game is determined according to the operation of the operation button 11 (bet button). During this operation, an operation signal sent upon an operation of the operation button 11 is received. According to the number of times that the operation signal is received, the bet on the payline is stored in a predetermined memory area of the RAM 243. Then, the credit amount C written into the predetermined memory area of the RAM 243 is read. A total bet where the above bet is added is subtracted from the read credit C. The resulting number is stored in the predetermined memory area of the RAM 243.

Afterwards, it is determined whether or not an operation button 11 (start button) is pressed (S4). When the operation button 11 (start button) is not pressed (S4, NO), S4 is repeated until the bet button 11 is pressed. When the operation button 11 (start button) is pressed (S4, YES), it is determined whether or not to start a common game (S5).

On the other hand, when the operation button 11 (bet button) is pressed in S2 (S2, YES), it is determined whether or not a value of the credit amount C is equal to or more than the value of the total bet in the previous game. In other words, it is determined whether or not it is possible to start a game with the operation button 11 (bet button) being pressed. Specifically, pressing of the operation button 11 (bet button) causes reading out of a bet on the payline in the previous game and a credit amount C written in a predetermined memory area of the RAM 243. According to a relation of the read credit amount C to the bet, a process branches as follows depending on whether the value of the credit amount C is equal to or more than the value of total bet in the previous game. When it is determined that the value of the credit amount C is less than the value of the total bet of the previous game (S16, NO), the routine ends without any operation of a process since a game cannot be started.

Meanwhile, when it is determined that the value of the credit amount C is equal to or more than the value of the total bet of the previous game (S16, YES), the value of the total bet of the previous game is subtracted from the value of the credit C. Then, the resulting value is stored in a predetermined memory area of the RAM 243. Afterwards, it is determined whether or not to start a common game (S5).

When it is determined to start a common game (S6, YES), a common game start flag is activated (S7). Specifically, data showing that the game start flag activated is written into a storage area of a common game start flag of the RAM 243. Meanwhile, when it is determined not to start a common game (S6, NO), a combination determination process is carried out (S8).

In the combination determination process, a combination of symbols to be stopped on the payline is determined first. Specifically, a command to generate a random number is sent to the random number generation circuit. Then, a random number within a predetermined range which is generated by the random number generation circuit, is sampled. The sampled random number is stored in a predetermined memory area of the RAM 243.

Although a random number is generated in the random number generation circuit disposed outside the main CPU 241 in the present embodiment, a random number may be generated through an arithmetic process by the main CPU 241, without the random number generating circuit.

Afterwards, a winning combination table for awarding a payout and a random number table stored in the ROM 242 are read. Those read winning combination table and random number table are stored in a predetermined memory area of the RAM 243. Still-displaying of symbols is controlled for each reel in accordance with the random number table.

Then, the random number table and the winning combination table stored in the predetermined memory area of the RAM 243 are read. The random number written into the predetermined memory area of the RAM 243 is used as a parameter to refer to the random number table. A combination of symbols to be stopped on the payline is then determined.

When a winning combination is determined, the winning combination table is stored into a predetermined memory area of the RAM 243. The random number and the winning combination table written in the predetermined memory area of the RAM 243 are read. In accordance with the random number and the winning combination table, a combination of symbols to be stopped and still-displayed are determined. During this process, the main CPU 241 reads out a symbol arrangement table stored from the ROM 242 and stores the table in a predetermined memory area of the RAM 243. The table is then used as a reference. The determined stop symbol data is stored in a predetermined memory area of the RAM 243. Alternatively, symbols to be stopped may be determined for each reel by using the random number table.

When a combination of symbols to be stopped on the payline is determined, it is determined whether or not the combination is a winning combination. When the combination of symbols to be stopped on the payline is a winning combination, a flag which indicates that a payout corresponding to the type of the winning combination will be awarded, is activated to generate the payout corresponding to the combination of symbols on the payline forming the determined winning combination. The activated flag indicating that a payout will be awarded, is stored in a predetermined memory area of the RAM 243. To the contrary, when a combination of symbols to be stopped on the payline is another combination, that is, a losing combination, the flag indicating that a payout will be awarded is not activated.

After the above combination determination process is carried out, reels 30A to 30E rotate so as to move symbols 301 in the display windows 7A to 7E (S9). Then, the rotation continues for a predetermined time (S10). Then, the rotation of reels 30A to 30E automatically stops (S11).

Then, it is determined whether or not a winning combination is formed through the combination determination process in S8 (S12). Specifically, this is done based on a status of the flag stored in the predetermined memory area of the RAM 243, which flag indicates a prize according to a combination of symbols on the payline is awarded. When the flag is not activated (S12, NO), it is determined that a winning combination is not formed, and the routine ends.

Meanwhile, when the flag is activated (S12, YES), it is determined whether or not the winning combination formed in the combination determination process in S8 includes a "Blue 7." Specifically, when the winning combination includes a "Blue 7" (S13, YES), the routine ends after the number of coins are paid out in accordance to the winning combination (S17).

Meanwhile, when the winning combination does not include a "BLUE 7" (S13, NO), it is determined whether or not a common game end flag is activated (S14). Specifically, it is determined whether or not data showing that the common game end flag is activated is written into a common game end flag area of the RAM 243. S14 is repeated until the common game end flag is activated (S14 NO). When the common game end flag is activated (S14, YES), a free game process is carried out (S15). Then, the routine ends.

(Free Game Process)

Figure 33:
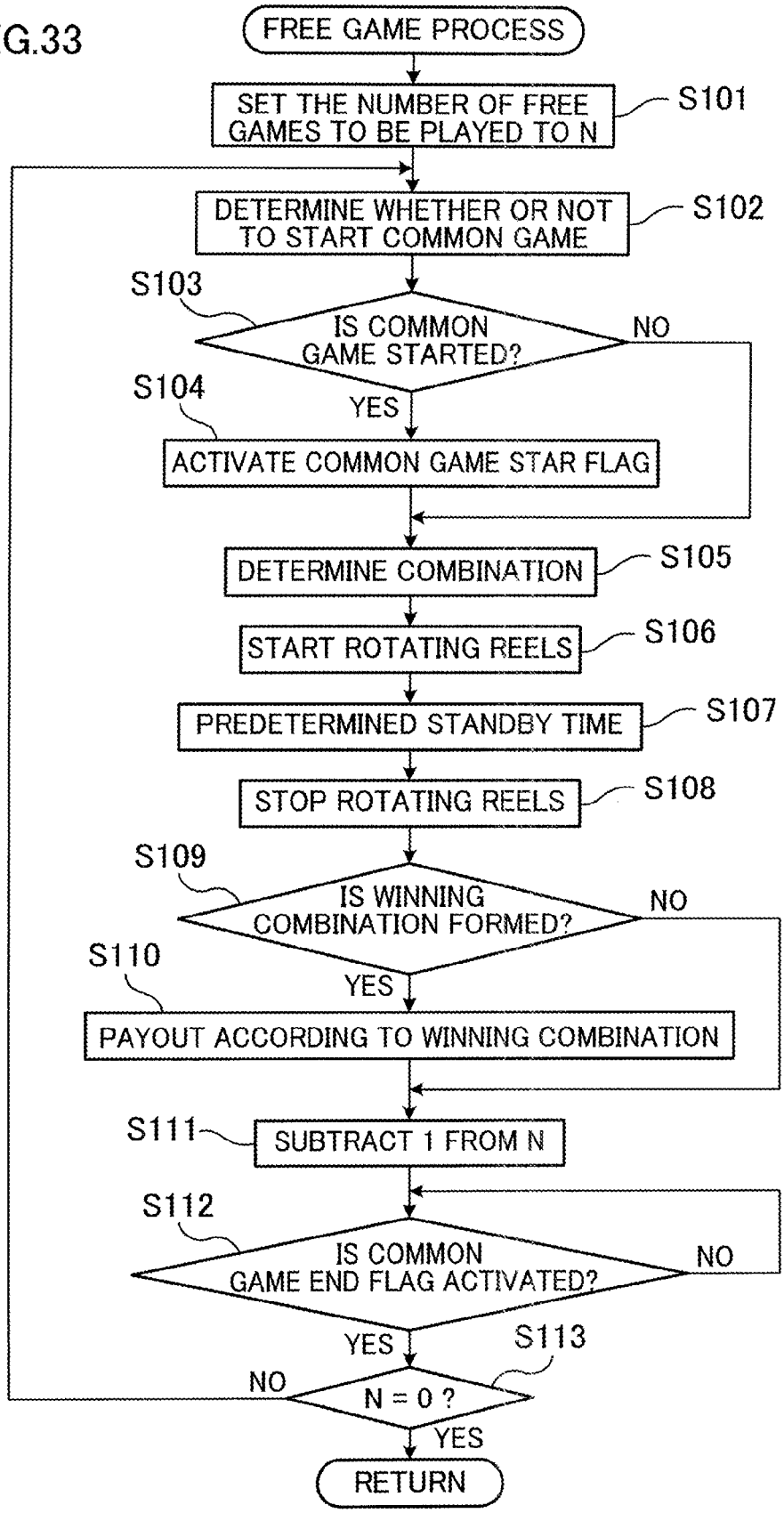
FIG. 33 is a flowchart of a free game process routine.

The following describes a free game process with reference to FIG. 33.

First, N denotes the number of free games (S101). The number of free games is determined according to accumulated points acquired in a common game of a basic game.

Then, whether or not to start a common game is determined (S102). When a common game is determined to start (S103, YES), a common game start flag is activated (S104). Specifically, data indicating that the common game start flag is activated is written into a storage area of the RAM 243 for storing the common game start flag. Afterwards, the process moves to S105.

Meanwhile, when a common game is determined not to start (S103, NO), the process immediately moves to S105. Thus, a combination determination process same as above is carried out (S105). A difference in this combination determination process is that the referred random number table is a free game random number table (not shown). Then, reels 30A to 30E start to rotate (S106). After a predetermined standby time (S107), an image of stopping the rotation of each of the reels 30A to 30E is displayed (S108).

Then, whether or not a winning combination is formed is determined (S109). When a winning combination is not formed (S109, NO), the process moves to S111. Meanwhile, when a winning combination is formed (S109, YES), a game medium according to the winning combination is paid out (S110). Specifically, the number of coins to be paid out for the winning combination is calculated, referring to the payout control table. A credit amount stored in a predetermined memory area of the RAM 243 is then read out. The payout value calculated above is added to the credit. The sum is stored in a predetermined memory area of the RAM 243, and the stored value is displayed on the credit amount display unit 9.

In S111, 1 is subtracted from N (S111). Then, whether or not a common game end flag is activated is determined (S112). Specifically, it is determined whether or not data showing that the common game end flag is activated is written into the common game end flag area of the RAM 243. S112 is repeated when the common game end flag is not activated (S112, NO).

When the common game end flag is activated (S112, YES), whether N is 0 is determined (S113). When N is not 0 (S113, NO), the operation is carried out again from S102. On the other hand, when N is 0 (S113, YES), the routine ends.

(Common Game Process)

Figure 34:
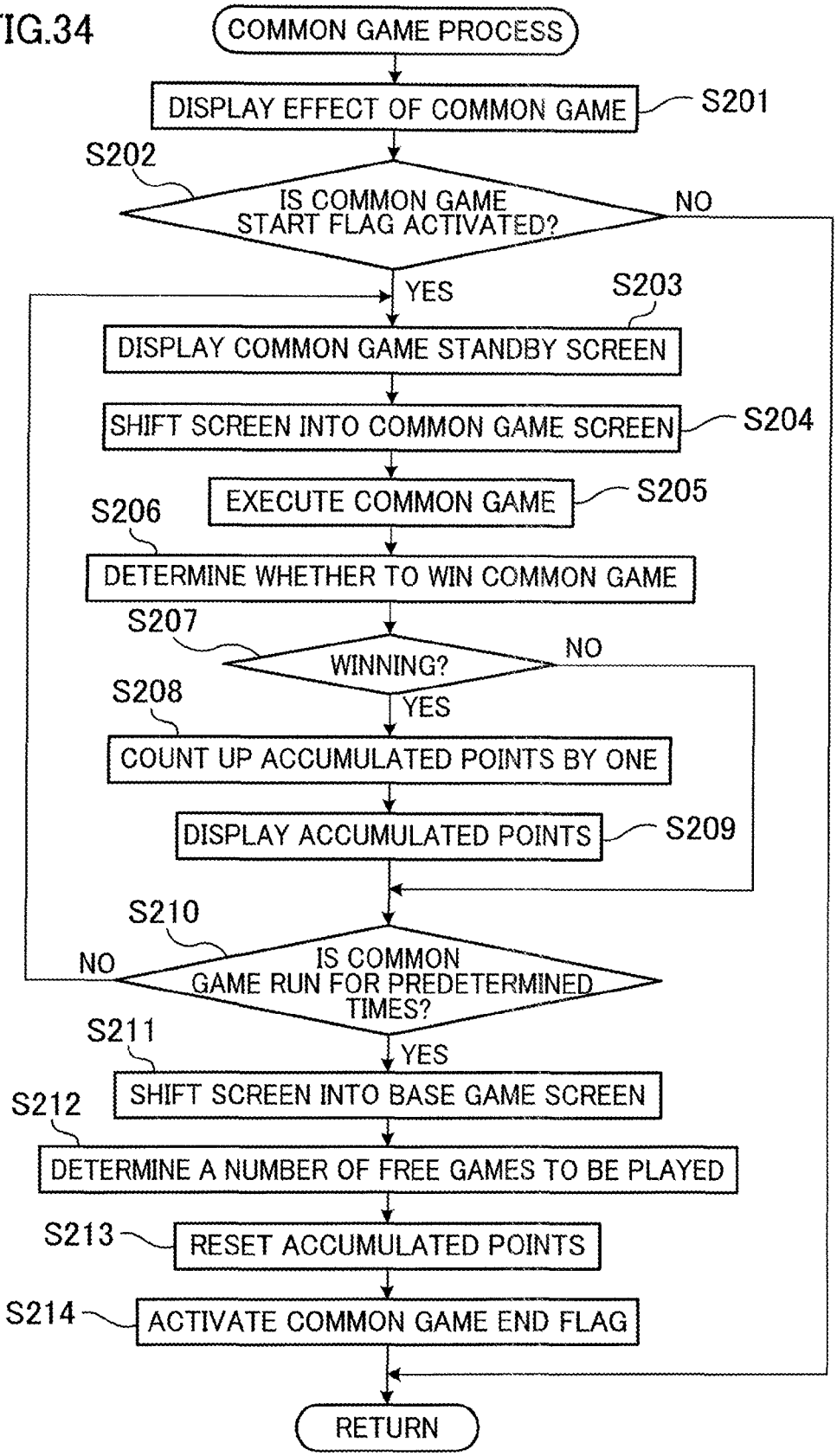
FIG. 34 is a flowchart of a common game process routine.

The following describes a common game process with reference to FIG. 34.

First, a common game screen, which is an effect screen displayed when a common game is not run, is displayed on the upper liquid crystal panel 5A (S201). Then, whether or not the common game start flag is activated is determined. Specifically, it is determined whether data showing that the common game start flag is activated is written into the game start flag area of the RAM 243 (S202).

When the common game start flag is not activated (S202, NO), the routine is terminated. On the other hand, when the common game start flag is activated (S202, YES), an effect screen displayed when a common game is run is displayed on an upper liquid crystal panel 5A (S204).

Thereafter, a common game starts (S205), and whether the player has won in the common game (S206). More specifically, whether to succeed in a common game is determined by using a sampled random number.

Then, it is determined whether or not the player has won in the common game has been determined (S207). When successful (S207, YES), the total number of accumulated points is counted up by 1 (S208), and the total number of accumulated points is displayed (S209). Then, it is determined whether or not the common game is run a predetermined number of times (S210). Meanwhile, when the common game is unsuccessful (S207, NO), the total number of accumulated points is not counted up, and it is determined whether or not the common game is played for predetermined number of times (S210).

When the common game is not played for predetermined number of times (S210, NO), the process is carried out again from S203, and a next common game starts. When a common game is repeated for, for example, ten times (S210, YES), the screen switches to a basic game screen (S211). After determining the number of times the free game is run (S212), the total number of accumulated points is reset (S213). Then, after activating the common game end flag (S214), this routine ends.

(Bill Storing Process)

Figure 35:
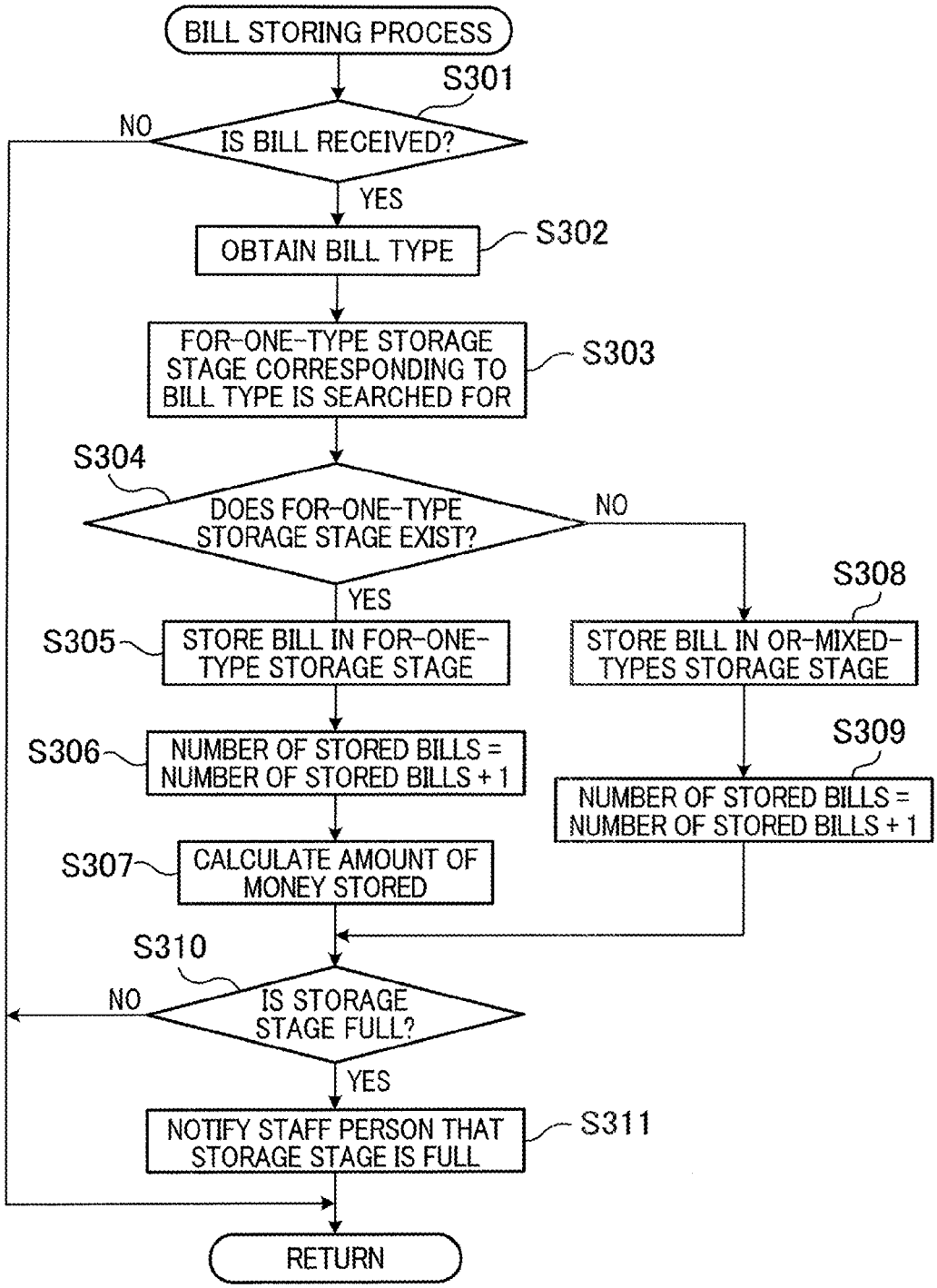
FIG. 35 is a flowchart of a bill storing process routine.

When addition to the credit is to be done by means of bills T while the player is playing a slot game or the like as above, as shown in FIG. 1, a bill T is placed on the bill entry 22 and is then supplied from the insertion slot 22*a* to the bill processing unit M1. In so doing, the bill processing unit M1 is executing the bill storing process routine as shown in FIG. 35 to determine whether the bill T has been received (S301). When the bill T supplied to the bill processing unit M1 is not regarded as a genuine bill because reasons such as it is a counterfeit, does not correspond to any one of the registered types, or is severely damaged, it is determined that the receiving of the bill T is rejected (S301: NO), and the routine is terminated.

On the other hand, when it is determined that the bill T supplied to the bill processing unit M1 is a genuine bill of one of the registered types, the receiving of the bill T is permitted (S301: YES) and the bill type data indicating the type of the bill T having been read is obtained (S302). Thereafter, with reference to the bill type field in the bill management table of FIG. 10, a for-one-type storage stage corresponding to the bill type data is searched for (S303). Then whether a for-one-type storage stage corresponding to the bill type data exists is determined (S304).

When the for-one-type storage stage exists (S304: YES), the bill T is stored in the bill case M300 of the for-one-type storage stage (S305). Thereafter, the number of stored bills data corresponding to the for-one-type storage stage is read from the number of stored bills field of the bill management table, and "1" is added to the number of stored bills data (S306). As the number of stored bills data is multiplied by the face value of the bill T, the monetary amount is calculated and the amount of money stored data in the amount of money stored field of the bill management table is updated (S307).

On the other hand, when there is no corresponding for-one-type storage stage (S304: NO), the bill T is stored in the bill case M300 of the for-mixed-types storage stage, which corresponds to the bill type field of the bill management table, where "0" type data is stored (S308). Thereafter, the number of stored bills data corresponding to the for-mixed-types storage stage is read from the number of stored bills field of the bill management table, and "1" is added to this number of stored bills data (S309).

When the bill T is stored in the for-one-type storage stage or in the for-mixed-types storage stage as described above (S304-S309), then whether at least one of the for-one-type storage stage and the for-mixed-types storage stage is full is determined. That is to say, it is determined whether the maximum number of stored bills data in the maximum number of stored bills field of the bill management table matches the number of stored bills data having been incremented by "1" (S310). When the sets of data are unmatched and no stage is full (S310: NO), the routine is terminated. On the other hand, when the sets of data are matched and the stage is full (S310: YES), a staff person is notified that the stage is full and a maintenance operation such as collection of bills T from the bill case M300 is required (S311). Then the routine is terminated.

(Bill Storing Process)

Figure 36:
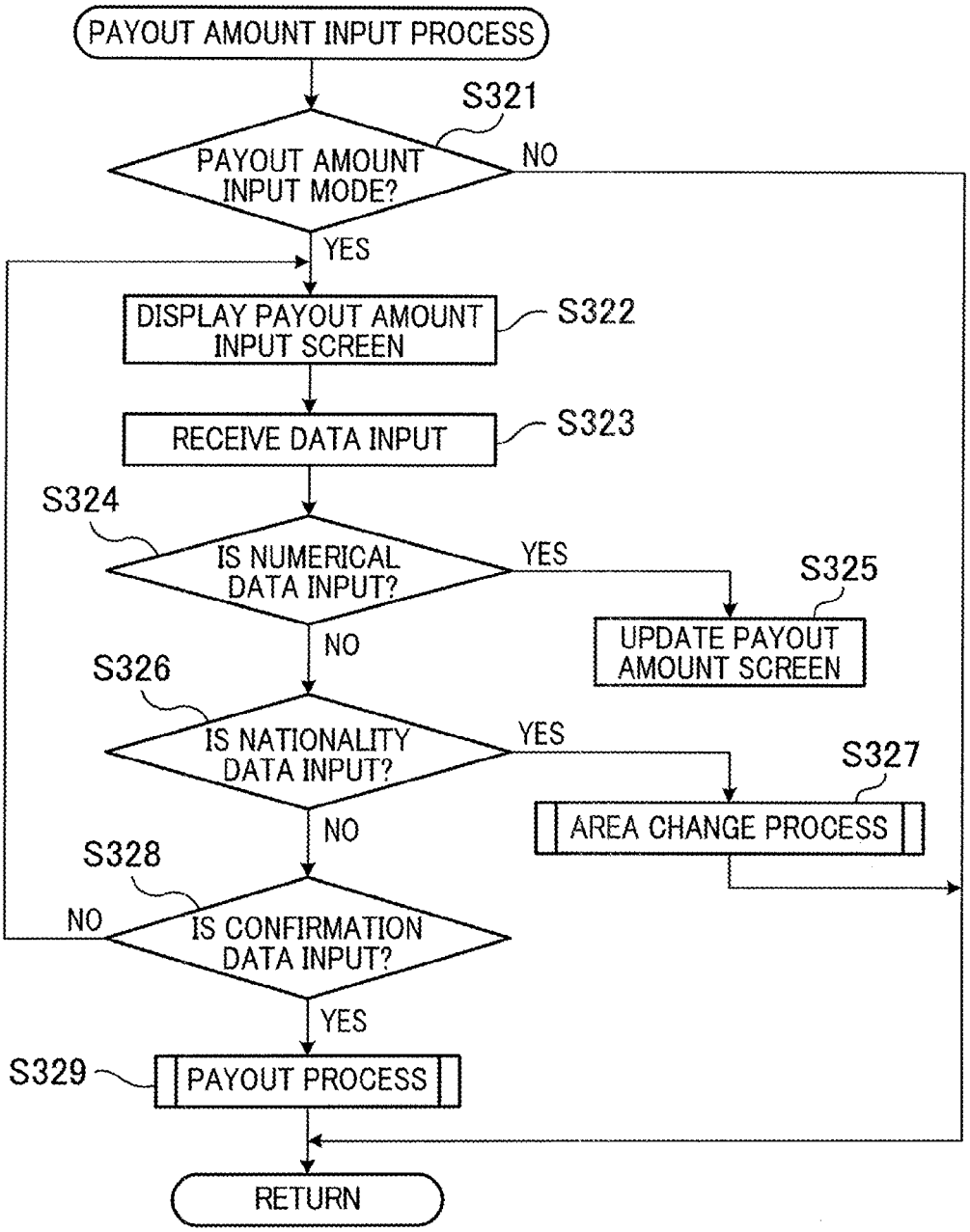
FIG. 36 is a flowchart of a payout amount input process routine.

Subsequently, when the player wishes to receive the credit in the form of bills T, the collect button 32 shown in FIG. 17 is pressed. In so doing, in the bill processing unit M1 the payout amount input process routine is being executed as shown in FIG. 36 to determine whether the payout amount input mode is set, with the assumption that a pressure signal from the collect button 32 being a trigger signal of the payout amount input mode (S321). With this, until the collect button 32 is pressed, it is determined that the payout amount input mode is not set (S321: NO), and the routine is terminated. On the other hand, when the collect button 32 is pressed and it is determined that the payout amount input mode is set (S321: YES), the bill payout screen F1 is displayed on the LCD 719 of the PTS terminal 700 as shown in FIG. 1 and FIG. 19 (S322).

Thereafter, the receiving of data input through the pressing of the touch panel 720 of the PTS terminal 700 starts (S323). When the data input is made, whether the operation data is an input of numerical data is determined (S324). When the input data is numerical data (S324: YES), the bill payout screen F1 is updated (S325). For example, as shown in FIG. 27, each time numerical data which is operation data generated when at least one of numeric key buttons "0"-"9" on the bill payout screen F1 is input, the numerical display on the payout amount displaying portion F3 is updated from "3" to "34" to "340".

On the other hand, when the input operation is not an input of numerical data (S324: NO), then whether the input is an input of nationality data is determined (S326). When the input is an input of nationality data (S326: YES), a later-described area change process is executed (S327). For example, as shown in FIG. 28, operation data generated by an input through the player's touching of a part of the selected area screen which is the entirety of the currency selection portion F5 is determined as nationality data, and the area change process is executed.

On the other hand, when the operation data is not nationality data (S324: YES), then whether the operation data is confirmation data is determined (S328). When the data is confirmation data (S328: YES), a payout process is executed (S329) and then the routine is terminated. On the other hand, when the data is not confirmation data (S328: NO), the routine is re-executed from S322. For example, as shown in FIG. 27, until the "ENTER" key button on the bill payout screen F1 is pressed, the receiving of data input and the processes are repeatedly made executable, and when the "ENTER" key button is pressed, it is determined that the operation data is confirmation data and the results of the processes executed based on the operation data are fixed.

(Bill Storing Process)

Figure 37:
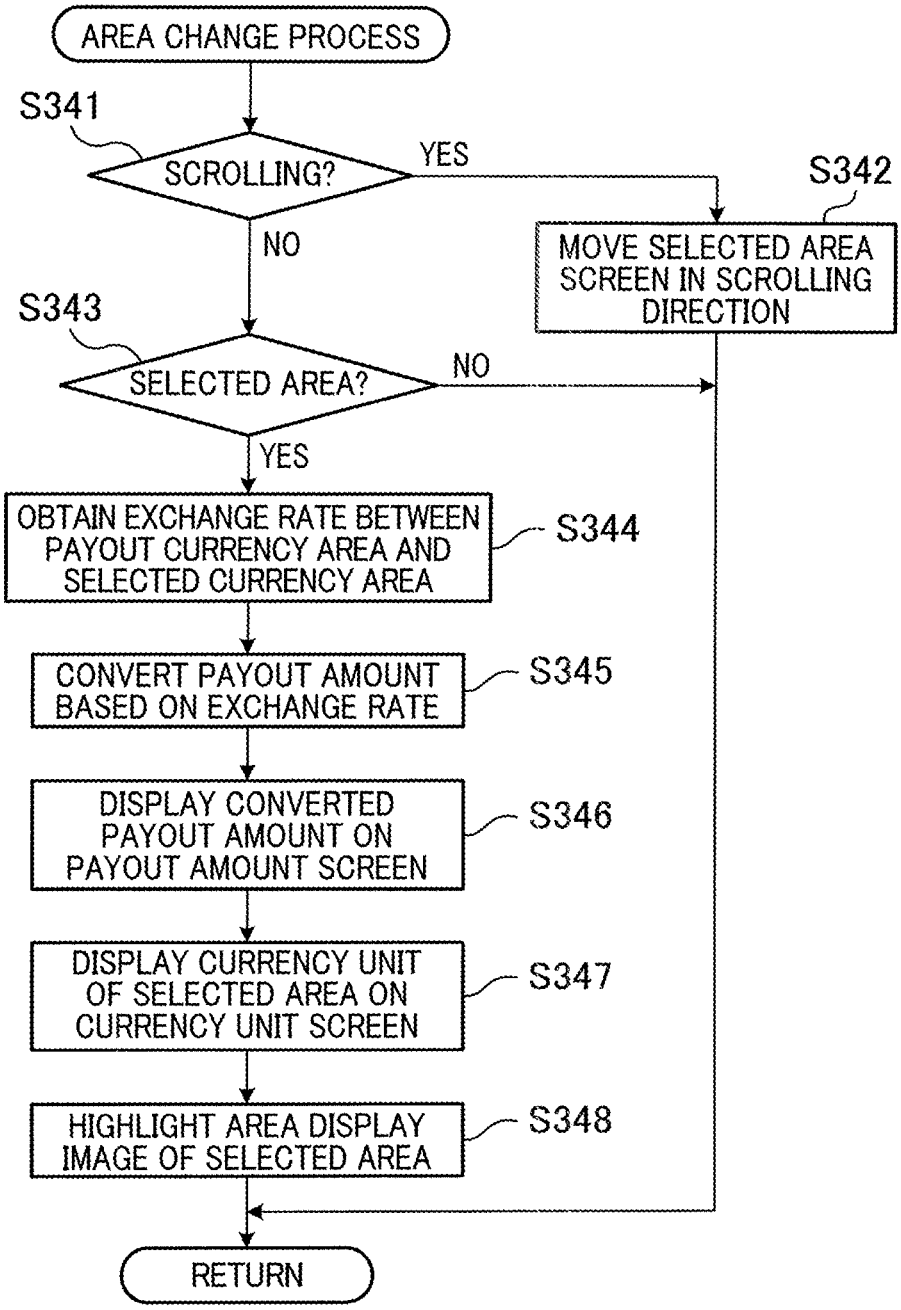
FIG. 37 is a flowchart of an area change process routine.

When the area change process (S327) is executed in the payout amount input process, as shown in FIG. 37, whether the operation data is scroll data indicating scrolling is determined (S341). When the data is scroll data (S341: YES), after the selected area screen of the currency selection portion F5 is moved in the scrolling direction (S342), the routine is terminated. For example, as shown in FIG. 28, when the pressurized point is moved in the crosswise direction in the figure while the pressing of the currency selection portion F5 is maintained, it is determined that the operation data is scroll data and the selected area screen is moved in the direction in which the pressurized point moves. With this, while an area display image outside the display frame of the currency selection portion F5 enters the display frame, an area display image having been displayed in the display frame of the currency selection portion F5 is moved away from the frame.

In the meanwhile, when the data is not scroll data (S341: YES), then whether the operation data is selected area data indicating the specification of the selected area is determined (S343). When the data is not selected area data (S343: NO), the routine is terminated. On the other hand, when the data is selected area data (S343: YES), an exchange rate between the payout currency area and the selected currency area is obtained (S344), and the payout amount is converted based on the exchange rate (S345). Thereafter, the converted payout amount is displayed on the payout amount screen F41 of the payout amount displaying portion F3 (S346). Then the currency unit of the selected area is displayed on the currency unit screen F42 (S347). After the area display image of the selected area is highlighted (S348), the routine is terminated.

With this, for example, as shown in FIG. 28, when the U.S. national flag which is the U.S. area display image is displayed on the specific currency displaying portion F2 and the U.S. dollar bills T are specified as the currency to be dealt with, the currency displayed on the payout amount displaying portion F3 is changed from U.S. dollar to Japanese yen as the player clicks the Japanese national flag which is the Japanese area display image. At the same time, because the specific currency displaying portion F2 is switched to the Japanese area display image, the change of the currency to be dealt with to Japanese bills T is emphasized. This allows the player to easily notice that the currency unit to be dealt with has been switched to the currency unit of the desired area.

(Payout Process)

Figure 38:
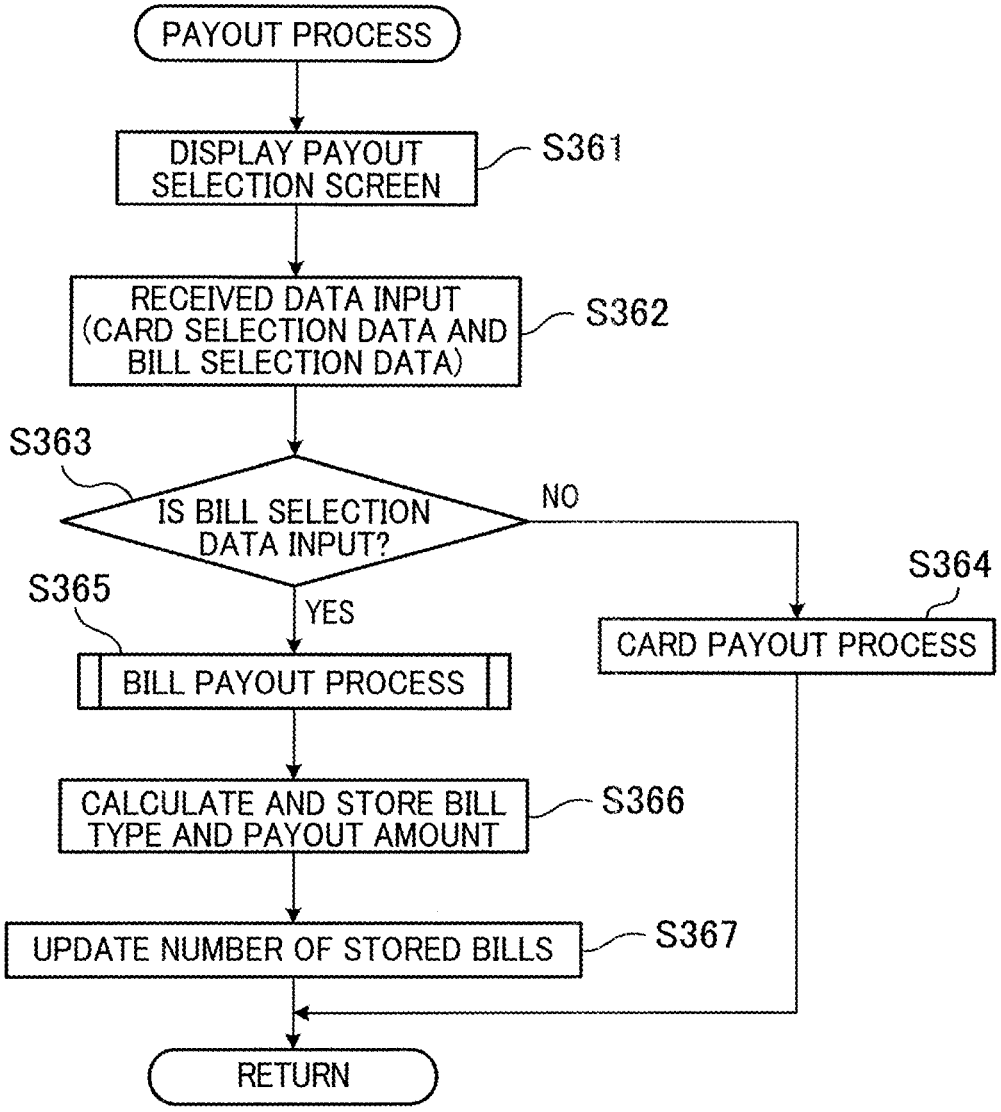
FIG. 38 is a flowchart of a payout process routine.

As a payout process (S329) is executed in the payout amount input process shown in FIG. 36, a payout process routine shown in FIG. 38 is executed. To begin with, a payout selection screen F7 shown in FIG. 27 is displayed (S361). This payout selection screen F7 includes a card button F61 and a bill button F62. As these buttons 731*a* and 731*b* are pressed, the receiving of data input is started (S362). Based on the operation data having been input, whether the data is bill selection data is determined (S363). When it is determined that the input data is not bill selection data as the card button F61 is pressed (S363: YES), a card payout process is executed (S364) and an amount of money displayed on the card is transferred. Then the routine is terminated.

On the other hand, when it is determined that the input data is bill selection data as the bill button F62 is pressed (S363: NO), a bill payment process is executed (S365) and then the bill type and the payout amount are determined, and the number of stored bills corresponding to the bill type in bill management table shown in FIG. 10 is updated (S367).

(Bill Payment Process)

Figure 39:
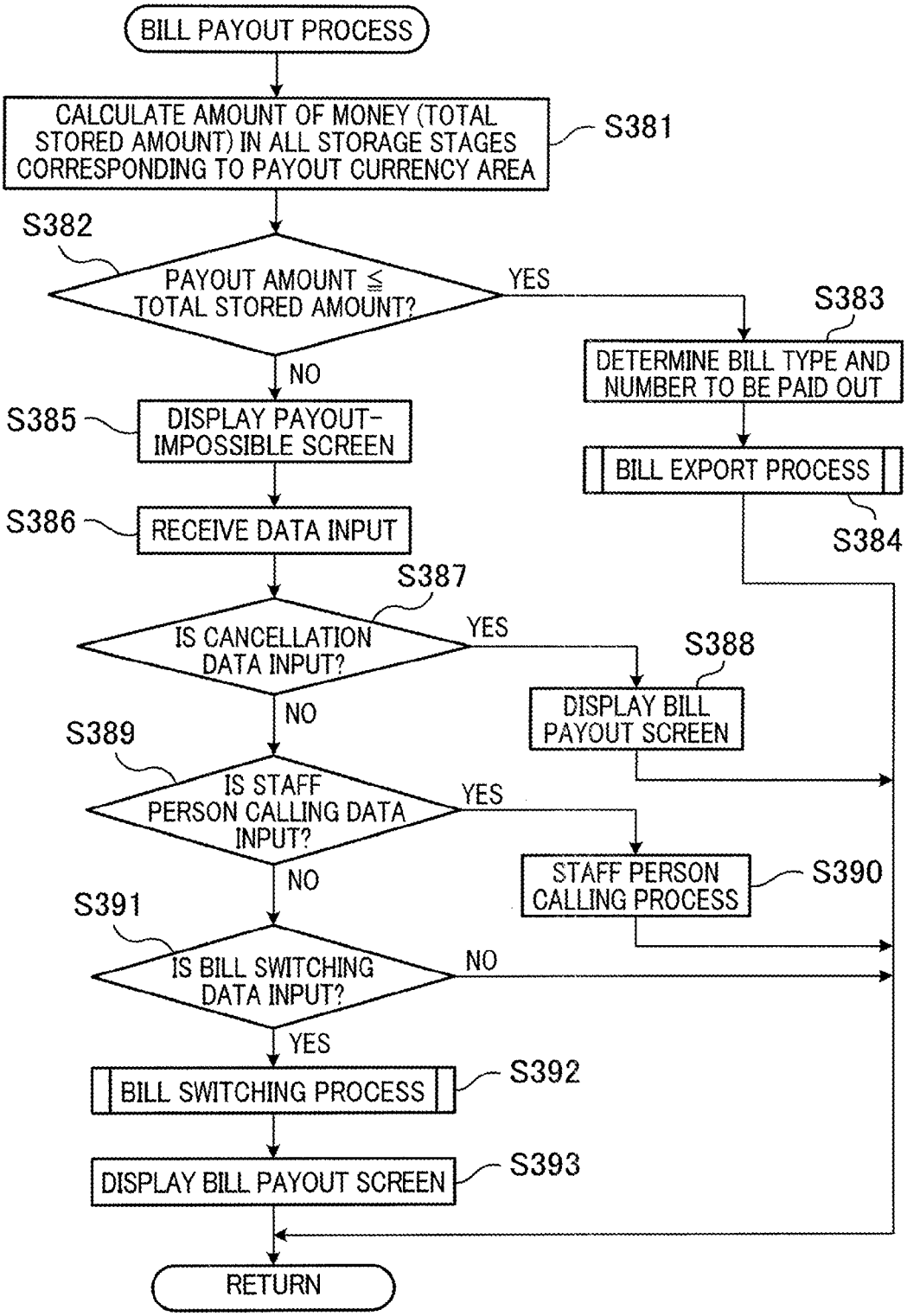
FIG. 39 is a flowchart of a bill payment process routine.

When a bill payment process (S3652) is executed in the payout process shown in FIG. 38, a bill payment process routine shown in FIG. 39 is executed. To begin with, the amounts of money of all storage stages (bill cases M300) corresponding to the currency to be paid out are added up, with the result that the total amount of money stored is calculated (S381). Then whether a payout amount is not larger than the total amount of money stored is determined (S382). When the payout amount is not larger than the total amount of money stored (S382: YES), the bill type and the number of bills T to be paid out are determined (S383). Thereafter, a bill payout process is executed and bills T are paid out to the player (S384), and then the routine is terminated.

On the other hand, when the payout amount is larger than the total amount of money stored (S382: NO), a payout-impossible screen F9 shown in FIG. 29 is displayed (S385). The payout-impossible screen F9 includes a cancellation button F72, a staff person calling button F71, and a bill switching button F73, and the receiving of data input starts as the buttons 731*a* and 731*b* are pressed (S386). Based on the operation data having been input, whether the input data is cancellation data is determined (S387). When it is determined that the input data is cancellation data as the cancellation button F72 is pressed (387: YES), the bill payout screen F1 shown in FIG. 27 is displayed to allow the correction of an amount of money to be paid out (S388), and then the routine is terminated.

On the other hand, when it is determined that the input data is not cancellation data (387: NO), then whether the input data is staff person calling data is determined (S389). When it is determined that the input data is staff person calling data as the staff person calling button F71 is pressed (S389: YES), a staff person calling process is executed (S390) and then the routine is terminated. On the other hand, when it is determined that the input data is not staff person calling data (S389: NO), then whether the input data is bill switching data is determined (S391).

When it is determined that the data is not bill switching data (S391: NO), the routine is terminated. On the other hand, when it is determined that the data is bill switching data as the bill switching button F73 is pressed (S391: YES), a bill switching process is executed (S392). After the image display is switched to the bill payout screen F1 (S393), the routine is terminated.

(Bill Switching Process)

Figure 40:
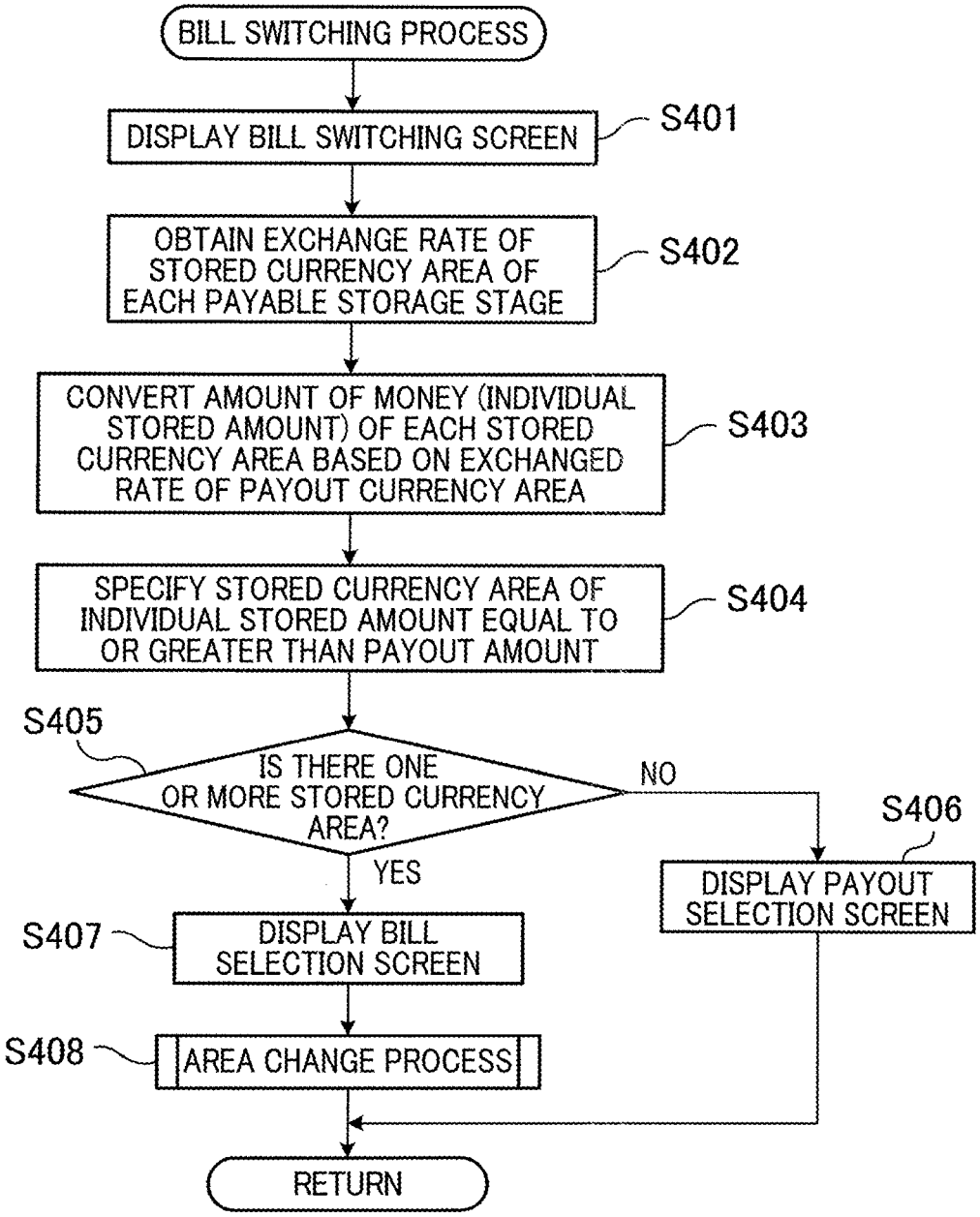
FIG. 40 is a flowchart of a bill switching process routine.

As the bill switching process is executed (S392), as shown in FIG. 40, the image display is switched to a bill selection screen F8 shown in FIG. 29 (S401). Then a currency circulation zone is specified as a stored currency area based on the currency type of each payable storage stage, and an exchange rate of this stored currency area is obtained (S402). An amount of money of each stored currency area is considered as an individual amount of money stored, and such an individual amount of money stored is converted based on an exchange rate of the payout currency area which is the currency circulation zone where the payout is to be conducted (S403). Thereafter, a stored currency area whose individual amount of money stored is not smaller than the payout amount is specified (S404).

Then whether the number of stored currency areas is not smaller than one is determined (S405). When the number of stored currency areas is smaller than one (S405: NO), the payout selection screen F7 is displayed (S406) and the routine is terminated. On the other hand, when the number of stored currency areas is one or more (S405: YES), a bill selection screen F8 shown in FIG. 29 is displayed (S407). After an area change process is conducted (S408), the routine is terminated.

(Bill Discharging Process)

Figure 41:
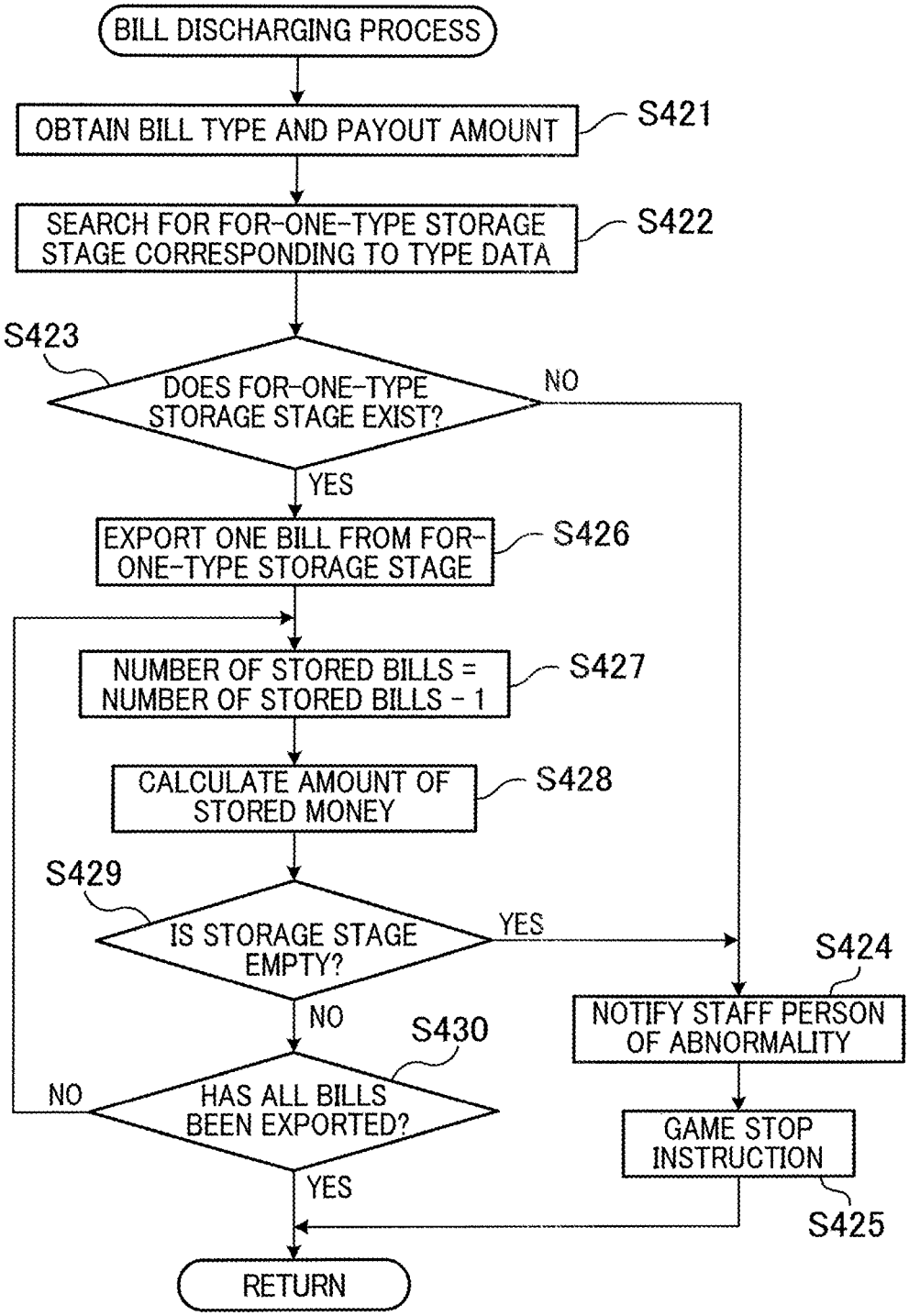
FIG. 41 is a flowchart of a bill discharging process routine.

AS the bill discharging process shown in FIG. 39 is executed (S384), as shown in FIG. 41, the bill type and the payout amount are obtained (S421), and then a for-one-type storage stage corresponding to the type data is searched for (S422). When a corresponding for-one-type storage stage does not exist (S423: NO), a staff person is notified of abnormality (S424). After a game stop instruction is output to the slot machine 10 (S425), the routine is terminated.

On the other hand, when a corresponding for-one-type storage stage exists (S426: YES), a single bill T is exported from this for-one-type storage stage (S426). Then the number of stored bills in bill management table shown in FIG. 10 is decremented by "1" (S427), and the amount of money stored is calculated based on the number of stored bills after the decrement (S428). Thereafter, whether the storage stage is empty is determined (S429). When the storage stage is empty (S429: YES), a staff person is notified of abnormality (S424) and a game stop instruction is made (S425), and then the routine is terminated. ON the other hand, when the storage stage is not empty (S429: NO), then whether the export of all bills has been completed is determined (S430). When the export of all bills has not been completed (S430: NO), the routine is re-executed from S427. On the other hand, when the export of all bills has been completed (S430: YES), the routine is terminated.

The above embodiment thus described solely serves as a specific example of the present invention, and the present invention is not limited to such an example. Specific structures and various means may be suitably designed or modified. Further, the effects of the present invention described in the above embodiment are not more than examples of most preferable effects achievable by the present invention. The effects of the present invention are not limited to those described in the embodiments described above.

Further, the detailed description above is mainly focused on characteristics of the present invention to fore the sake of easier understanding. The present invention is not limited to the above embodiments, and is applicable to diversity of other embodiments. Further, the terms and phraseology used in the present specification are adopted solely to provide specific illustration of the present invention, and in no case should the scope of the present invention be limited by such terms and phraseology. Further, it will be obvious for those skilled in the art that the other structures, systems, methods or the like are possible, within the spirit of the invention described in the present specification. The description of claims therefore shall encompass structures equivalent to the present invention, unless otherwise such structures are regarded as to depart from the spirit and scope of the present invention. Further, the abstract is provided to allow, through a simple investigation, quick analysis of the technical features and essences of the present invention by an intellectual property office, a general public institution, or one skilled in the art who is not fully familiarized with patent and legal or professional terminology. It is therefore not an intention of the abstract to limit the scope of the present invention which shall be construed on the basis of the description of the claims. To fully understand the object and effects of the present invention, it is strongly encouraged to sufficiently refer to disclosures of documents already made available.

The detailed description of the present invention provided hereinabove includes a process executed on a computer. The above descriptions and expressions are provided to allow the one skilled in the art to most efficiently understand the present invention. A process executed in or by respective steps yielding one result or blocks with a predetermined processing function described in the present specification shall be understood as a process with no self-contradiction. Further, the electrical or magnetic signal is transmitted/received and written in the respective steps or blocks. It should be noted that such a signal is expressed in the form of bit, value, symbol, text, terms, number, or the like solely for the sake of convenience. Although the present specification occasionally personifies the processes executed in the steps or blocks, these processes are essentially executed by various devices. Further, the other structures necessary for the steps or blocks are obvious from the above descriptions.

REFERENCE SIGNS LIST

M1 bill processing unit
M2 device main body
M3 bill transportation path
M5 bill insertion slot
M6 bill transportation mechanism
M8 bill reader
M300 bill case
M301 storing frame
M302 first partition plate
M303 first partition plate supporting mechanism
F1 bill payout screen
F2 currency displaying portion
F3 payout amount displaying portion
F5 currency selection portion
F7 payout selection screen
F8 bill selection screen
F9 payout-impossible screen

The invention claimed is:

1. A bill processing unit comprising:

a bill slot allowing bills of a plurality of currency circulation zones to be accepted into the bill processing unit;

a bill transportation mechanism configured to transport the bills between the bill slot and parts of the bill processing unit;

a plurality of bill cases connected to the bill transportation mechanism;

a storage configured to store identification data of each of the bill cases and identification data of each of the currency circulation zones in association with one another;

a bill reader configured to read information from the bills while the bills are being transported by the bill transportation mechanism;

a bill identifying unit configured to identify the currency circulation zone of each of the bills based on bill information data read by the bill reader;

an import control unit configured to specify one of the bill cases associated with the currency circulation zone identified by the bill identifying unit based on the identification data stored in the storage and control the bill transportation mechanism to import the bills to the specified bill case;

a currency circulation zone classification unit configured to classify sets of information data of the respective currency circulation zones stored in the storage into information data of a particular currency circulation zone and information data of other currency circulation zones;

a payout instruction unit configured to receive an instruction to pay out the bills;

an export control unit configured to specify, in response to an instruction from the payout instruction unit, one of the bill cases associated with the particular currency circulation zone based on the identification data stored in the storage, and control the bill transportation mechanism to export the bills by transporting them from the specified bill case to the bill slot; and a payout amount specifying unit configured to receive a payout amount of the bills, wherein the export control unit controls the bill transportation mechanism to export the bills to the bill slot, the number of which corresponds to the payout amount specified in the payout amount specifying unit, and the currency circulation zone classification unit sets a currency circulation zone in which the bill processing unit is installed as the particular currency circulation zone.

2. The bill processing unit according to claim 1, further comprising:

a currency circulation zone selection unit that allows one of the currency circulation zones stored in the storage to be selected, the export control unit setting a selected one of the currency circulation zones as the particular currency circulation zone when one of the currency circulation zones is selected in the currency circulation zone selection unit.

3. The bill processing unit according to claim 2, further comprising:

a total amount calculation unit configured to calculate the total monetary amount of the bills stored in the bill case; and an export determination unit configured to compare the payout amount specified by the payout amount specifying unit with the total monetary amount in the bill case from which payout is conducted, and prohibit the export control unit from controlling the bill transportation mechanism to conduct export when the payout amount is equal to or larger than the total monetary amount.

4. The bill processing unit according to claim 3, further comprising:

a countermeasure information output unit configured to, when the export determination unit prohibits the export, output at least one set of countermeasure information regarding the prohibition of the export to be recognizable by an operator who has instructed payout of the bills;

a countermeasure information selection unit configured to allow the operator to select a set of the countermeasure information; and a countermeasure information execution unit configured to execute a process associated with the set of countermeasure information selected in the countermeasure information selection unit.

5. The bill processing unit according to claim 4, wherein, the at least one set of the countermeasure information includes:

staff person calling information with which a staff person dealing with the bills in the bill cases is called;

selection encouragement information with which the operator is encouraged to select another one of the currency circulation zones with which the payout is possible; and payout cancellation information with which the payout of the bills is canceled.

6. The bill processing unit according to claim 1, wherein, each of the bill cases includes:

a storing frame configured to store the bills in a stacked form;

a partition plate configured to contact an end of each of the bills stored in the storing frame; and a partition plate supporting mechanism configured to support the partition plate to be movable forward and backward with respect to the end of each of the bills.

7. A gaming machine comprising the bill processing unit of claim 1.

8. The bill processing unit according to claim 1, further comprising a skew correction mechanism which is configured to correct tilting of a bill inserted into the bill slot and to align the bill with the bill reader.

* * * * *